US007843118B2

(12) United States Patent
Nukanobu et al.

(10) Patent No.: US 7,843,118 B2
(45) Date of Patent: Nov. 30, 2010

(54) ELECTRON-EMITTING DEVICE, ELECTRON SOURCE USING THE SAME, IMAGE DISPLAY APPARATUS, AND INFORMATION DISPLAYING AND REPRODUCING APPARATUS

(75) Inventors: Koki Nukanobu, Sagamihara (JP); Takuto Moriguchi, Chigasaki (JP); Keisuke Yamamoto, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 11/791,785

(22) PCT Filed: Dec. 21, 2005

(86) PCT No.: PCT/JP2005/024013

§ 371 (c)(1),
(2), (4) Date: May 29, 2007

(87) PCT Pub. No.: WO2006/070849

PCT Pub. Date: Jul. 6, 2006

(65) Prior Publication Data

US 2008/0122336 A1 May 29, 2008

(30) Foreign Application Priority Data

Dec. 28, 2004 (JP) ..... 2004-379955

(51) Int. Cl.
*H01J 9/02* (2006.01)
*H01J 1/62* (2006.01)

(52) U.S. Cl. ..... 313/310; 313/495

(58) Field of Classification Search ..... 313/310, 313/1, 244, 337, 341, 346, 523
See application file for complete search history.

(56) References Cited

U.S. PATENT DOCUMENTS

| | | | | |
|---|---|---|---|---|
| 5,847,495 | A | 12/1998 | Yamanobe et al. | 313/310 |
| 6,005,334 | A | 12/1999 | Mitome et al. | 313/309 |
| 6,147,449 | A | 11/2000 | Iwasaki et al. | 313/495 |

(Continued)

FOREIGN PATENT DOCUMENTS

EP 0 805 472 A 11/1997

(Continued)

OTHER PUBLICATIONS

Korean Official Letter Dated Nov. 11, 2008.

*Primary Examiner*—Joseph L Williams
*Assistant Examiner*—Brenitra M Lee
(74) *Attorney, Agent, or Firm*—Fitzpatrick, Cella, Harper & Scinto

(57) ABSTRACT

An electron-emitting device is provided with improved electron emitting efficiency. An electron-emitting device includes first and second electroconductive films disposed on a surface of a substrate in opposition to each other to form a gap between ends of the first and second electroconductive films. The end of the first electroconductive film includes a portion the minimum distance d1 from which to the second electroconductive film is 10 nm or less. Let d2 denote a minimum distance between the end of the first electroconductive film which is away from the portion the minimum distance d1 from which to the second electroconductive film is 10 nm or less by the minimum distance d1 and the end of the second electroconductive film. The relation of d2/d1≧1.2 is satisfied.

12 Claims, 31 Drawing Sheets

U.S. PATENT DOCUMENTS

| | | | | |
|---|---|---|---|---|
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,246,168 | B1 | 6/2001 | Kishi et al. | 313/495 |
| 6,259,191 | B1 | 7/2001 | Mitome et al. | 313/310 |
| 6,267,636 | B1 | 7/2001 | Onishi et al. | 445/6 |
| 6,334,801 | B1 | 1/2002 | Kawade et al. | 445/24 |
| 6,379,211 | B2 | 4/2002 | Onishi et al. | 445/73 |
| 6,380,665 | B1 | 4/2002 | Motoi et al. | 313/310 |
| 6,409,563 | B1 | 6/2002 | Tamura et al. | 445/3 |
| 6,608,437 | B1 | 8/2003 | Kishi et al. | 313/495 |
| 6,617,773 | B1 | 9/2003 | Yamamoto et al. | 313/310 |
| 6,626,719 | B2 | 9/2003 | Ono et al. | 445/24 |
| 6,633,118 | B1 | 10/2003 | Yamamoto et al. | 313/495 |
| 6,642,649 | B1 | 11/2003 | Yamamoto et al. | 313/495 |
| 6,726,520 | B2 | 4/2004 | Takeda et al. | 445/62 |
| 6,731,060 | B1 | 5/2004 | Yamamoto et al. | 313/495 |
| 6,802,753 | B1 | 10/2004 | Ando et al. | 445/6 |
| 6,831,401 | B1 | 12/2004 | Yamamoto et al. | 313/495 |
| 6,835,110 | B2 | 12/2004 | Mizuno et al. | 445/6 |
| 6,876,156 | B1 | 4/2005 | Yamamoto et al. | 315/169.3 |
| 6,896,571 | B2 | 5/2005 | Mizuno et al. | 445/24 |
| 6,900,581 | B2 | 5/2005 | Kyogaku et al. | 313/310 |
| 7,021,981 | B2 | 4/2006 | Onishi et al. | 445/6 |
| 7,057,336 | B2 | 6/2006 | Kishi et al. | 313/495 |
| 7,067,336 | B1 | 6/2006 | Kyogaku et al. | 438/20 |
| 7,077,716 | B2 | 7/2006 | Mizuno et al. | 445/24 |
| 7,189,427 | B2 | 3/2007 | Takeda et al. | 427/77 |
| 7,230,372 | B2 | 6/2007 | Yamamoto et al. | 313/311 |
| 7,234,985 | B2 | 6/2007 | Kishi et al. | 445/24 |
| 7,264,530 | B2 | 9/2007 | Kobayashi et al. | 445/35 |
| 7,271,529 | B2 | 9/2007 | Takeda et al. | 313/311 |
| 7,276,845 | B2 | 10/2007 | Yamamoto et al. | 313/311 |
| 7,298,079 | B2 | 11/2007 | Danjo et al. | 313/495 |
| 7,312,561 | B2 | 12/2007 | Moriguchi et al. | 313/310 |
| 2003/0161942 | A1 | 8/2003 | Arai et al. | 427/77 |
| 2005/0258734 | A1* | 11/2005 | Nukanobu et al. | 313/495 |
| 2005/0282458 | A1 | 12/2005 | Takeda et al. | 445/46 |
| 2006/0003660 | A1 | 1/2006 | Kobayashi et al. | 445/5 |
| 2006/0252335 | A1 | 11/2006 | Onishi et al. | 445/6 |
| 2007/0018561 | A1 | 1/2007 | Nukanobu et al. | 313/495 |
| 2007/0176532 | A1 | 8/2007 | Yamamoto et al. | 313/496 |
| 2008/0045112 | A1 | 2/2008 | Kishi et al. | 445/24 |

FOREIGN PATENT DOCUMENTS

| | | | |
|---|---|---|---|
| EP | 0 805 472 | B1 | 11/1997 |
| JP | 08 031315 | A | 2/1996 |
| JP | 10-040806 | A | 2/1998 |
| JP | 2000-231872 | | 8/2000 |
| JP | 2000-251642 | | 9/2000 |
| JP | 2000-251643 | A | 9/2000 |
| KR | 10-0252456 | | 1/2000 |

* cited by examiner

PROCESSING BEFORE TEM OBSERVATION

TEM OBSERVATION

ELECTRON-EMITTING DEVICE, ELECTRON SOURCE USING THE SAME, IMAGE DISPLAY APPARATUS, AND INFORMATION DISPLAYING AND REPRODUCING APPARATUS

This application is a national stage filing under 35 U.S.C. 371, based on International Patent Application No. PCT/JP2005/024013, filed Dec. 21, 2005, published in English on Jul. 6, 2006 as International Publication No. 2008/070894 A1, which International Application claims priority to Japanese Patent Application No. 2004-379955, filed Dec. 28, 2004.

TECHNICAL FIELD

The present invention relates to an electron-emitting device, electron source using the same, and image display apparatus. The present invention also relates to an information displaying and reproducing apparatus such as a television set for receiving a broad casted signal such as television broadcasting, and for displaying and reproducing image information, character information, audio information, which are included in the broad casted signal.

BACKGROUND ART

Electron-emitting devices include such as field emission electron-emitting devices and surface conduction electron-emitting devices. As disclosed in Patent Documents 1 to 3, there are some cases where a surface conduction electron-emitting device is performed a process referred to as "activation". "Activation" process is a process for forming an electroconductive film (typically a carbon film) in a gap between a pair of electroconductive films and on the electroconductive films adjacent to the gap. FIG. 21 is a schematic sectional view of an electron-emitting device disclosed in Patent Documents 3 and 4. In FIG. 21, reference numeral 1 denotes a substrate, reference symbols 4*a* and 4*b* denote electroconductive thin films, reference numerals 7 and 8 denote first and second gaps, respectively, reference symbols 21*a* and 21*b* denote carbon films, and reference numeral 22 denotes a concave formed in the substrate 1.

An image display apparatus can be formed by opposing a substrate provided with an electron source having a plurality of such electron-emitting devices arranged thereon to a substrate provided with a phosphor film formed of a phosphor or the like and by maintaining vacuum inside.

[Patent Document 1] JP 2000-251642 A
[Patent Document 2] JP 2000-251643 A
[Patent Document 3] JP 2000-231872 A
[Patent Document 4] U.S. Pat. No. 6,380,665

DISCLOSURE OF THE INVENTION

However, an image display apparatus has been recently required to provide a brighter display image for a long time with stability. Therefore, an electron-emitting device which can realize higher electron emitting efficiency with more stability is desired. Here, the electron emitting efficiency is the ratio of current emitted to the vacuum (hereinafter referred to as emission current Ie) to current flowed between the pair of electroconductive films (hereinafter referred to as device current If) when voltage is applied between the pair of electroconductive films. In other words, an electron-emitting device with the lowest possible device current If and the highest possible emission current Ie is desired. If such high electron emitting efficiency can be achieved with stability for a long time, the above-mentioned image display apparatus can be a high quality image display, apparatus providing a brighter image and consuming less power (e.g., a flat TV set).

Accordingly, an object of the present invention is to provide an electron-emitting device with high electron emitting efficiency which materializes satisfactory electron emitting characteristics for a long time and an electron source and an image display apparatus using the same.

The present invention has been made to solve the above-mentioned problems. According to the present invention, there is provided an electron-emitting device including: a substrate; and first and second electroconductive films disposed on the substrate in opposition to each other to form a gap between ends of the first and second electroconductive films, in which the end of the first electroconductive film have a protrusion protruding toward the second electroconductive film such that a minimum distance d1, which in defined as a distance between an end of the protrusion and the second electroconductive film and which is 10 nm or less, and a minimum distance d2, which is defined as a distance between the second electroconductive film and an edge portion of the first electroconductive film being away from the end of the protrusion by d1, meets a relation: $d2/d1 \geqq 1.2$.

According to the present invention, an electron-emitting device includes: a substrate; and first and second electroconductive films disposed on the substrate in opposition to each other to form a gap between ends of the first and second electroconductive films, in which the first electroconductive film has a first portion at which a minimum distance between the first and second electroconductive films is defined as d1, which is 10 nm or less, and wherein the first electronconductive film has a second portion being away from the first portion by d1, at which a minimum distance between the first and second electroconductive films is defined as d2, and wherein the distance d1 and the distance d2 meet a relation: $d2/d1 \geqq 1.2$.

Further, according to the present invention, the electron-emitting device includes: "the edge portion of meet is in a plane including the protrusion and being parallel to a surface of the substrate"; "the first electroconductive film has a plurality of protrusions arranged so as not to be overlapped with each other in a direction normal to a surface of the substrate"; "the plurality of protrusions are arranged at an interval of 3 d1 or more"; "the plurality of the protrusions are arranged at an interval of 2000 d1 or more"; "the gap extends in a staggering manner"; "the first and second electroconductive films contain carbon"; and "the substrate has a concave on a surface thereof between the first and second electroconductive films".

According to the present invention, an electron source includes a plurality of the electron-emitting devices according to the present invention and an image display apparatus including the electron source and a phosphor are provided.

According to the present invention, an information displaying and reproducing apparatus includes: a receiver for outputting at least one of an image information, a character information and an audio information contained in a broadcasted signal received; and an image display apparatus connected to the receiver, wherein the image display apparatus is prepared.

According to the present invention, an electron-emitting device with dramatically improved electron emitting efficiency can be provided. As a result, an image display apparatus and an information displaying and reproducing apparatus with excellent display quality for a long time can be provided.

Further, according to the present invention, since, when voltage is applied between the first and second electroconductive films to emit electrons, d2/d1 is 1.2 or more, changing the distribution of electric potential in proximity to the end of the first electroconductive film changes the trajectory of the emitted electrons, and as a result, increases the emission current Ie which reaches an anode (the efficiency becomes higher).

BEST MODE FOR CARRYING OUT THE INVENTION

Embodiments of an electron-emitting device according to the present invention will be described in the following. First, an exemplary basic structure of an electron-emitting device according to the present invention is described with reference to FIG. 30A.

Figure 30A:
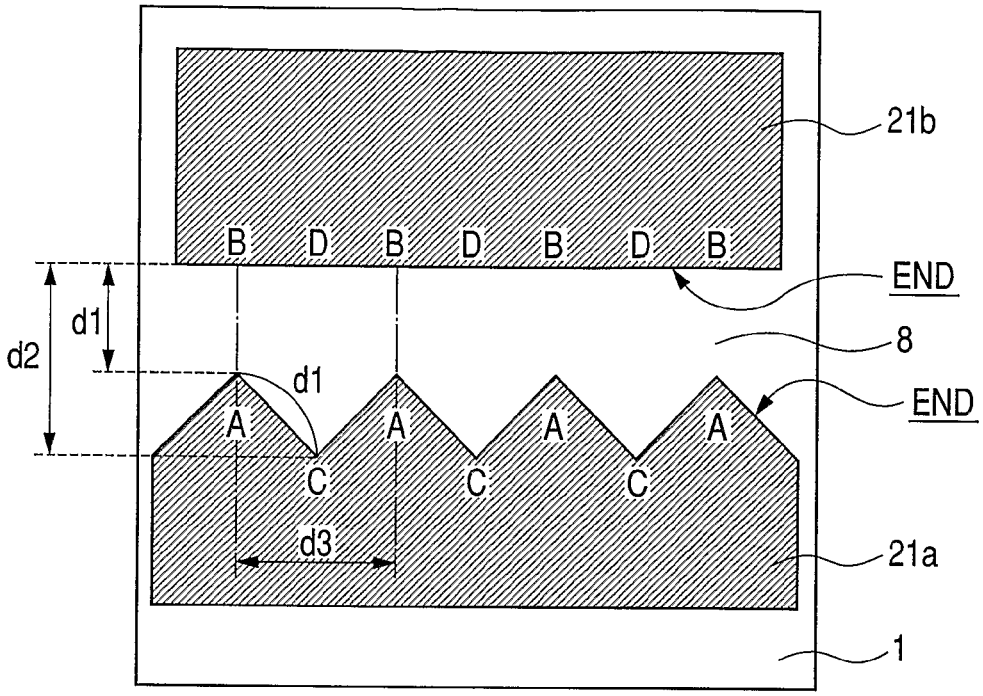
FIGS. 30A and 30B are plan views schematically illustrating exemplary structures of the electron-emitting device according to the present invention.

FIG. 30A is a schematic plan view illustrating a typical structure of an electron-emitting device according to the present invention. A first electroconductive film 21*a* and a second electroconductive film 21*b* are disposed on an insulating substrate 1 formed of glass or the like. An end of the first electroconductive film 21*a* and an end of the second electroconductive film 21*b* are in opposition to each other with a gap 8 therebetween. In other words, the end of the first electroconductive film 21*a* on the side of the second electroconductive film 21*b* and the end of the second electroconductive film 21*b* on the side of the first electroconductive film 21*a* form periphery (edge) of the gap 8.

In FIG. 30A, reference symbols A and B denote portions of the end of the first electroconductive film 21*a* and the second electroconductive film 21*b*, respectively, which are in opposition to each other with the gap 8 therebetween being smaller than that of other portions (where the electric field is stronger than that of other portions). Therefore, portions A of the first electroconductive film 21*a* can also be referred to "protrusions".

Figure 30B:
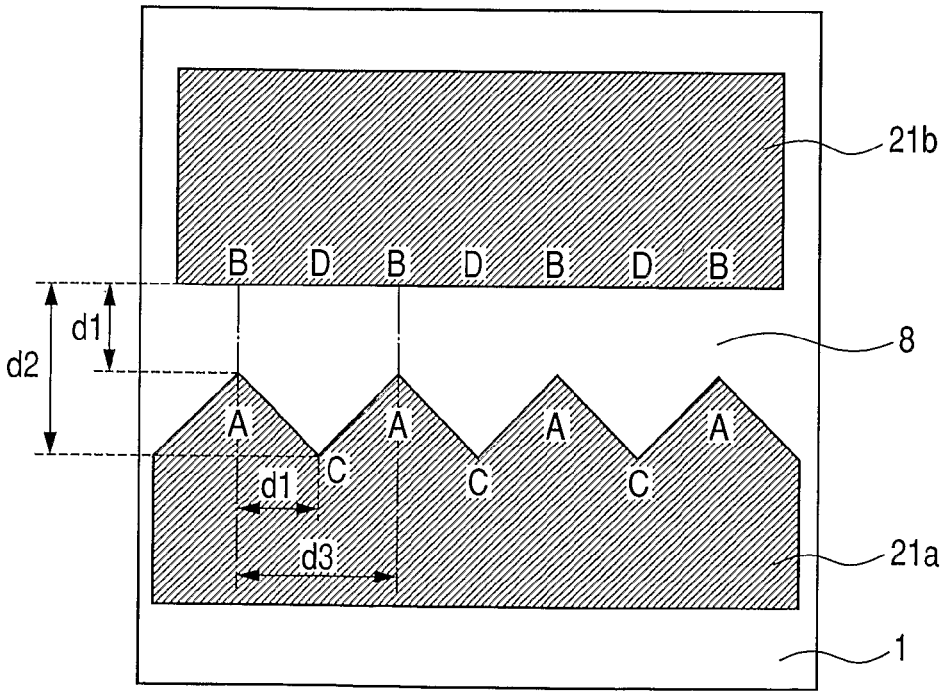

When the electron-emitting device as shown in FIGS. 30A and 30B is driven (made to emit electrons), voltage is applied between the first and second electroconductive films 21*a* and 21*b* such that the electric potential of the second electroconductive film 21*b* is higher than that of the first electroconductive film 21*a*. Therefore, typically, the portions A of the first electroconductive film 21*a* may be referred to as electron-emitting portions.

It is preferable that, in view of the stability of the emission current, the end of the first electroconductive film 21*a* on the side of the second electroconductive film 21*b* is provided with a lot of such protrusions (portions A) toward the second electroconductive film 21*b* as illustrated in FIG. 30A. In other words, it is preferable that a lot of portions are provided where the gap between the first and second electroconductive films 21*a* and 21*b* is smaller than that of other portions.

The portions B of the second electroconductive film 21*b* can be typically referred to as portions of the second electroconductive film 21*b* and also referred to as portions of the second electroconductive film 21*b* which are nearest to the portions A. The gap between a portion A and a portion B can be defined as "d1". In order to set drive voltage necessary for emitting electrons to be 50 V or lower, preferably 20 V or lower, d1 is set to be 10 nm or less, preferably 5 nm or less. In view of the stability when the electron-emitting device is driven and reproducibility in manufacturing, d1 is preferably set to be 1 nm or more, and more preferably set to be 3 nm or more.

The minimum distance between an end of the first electroconductive film 21*a* on the side of the second electroconductive film 21*b* (a portion C) and an end of the second electroconductive film 21*b* on the side of the first electroconductive film 21*a* (a portion D) in opposition to the end (the portion C), which is away from a protrusion (a portion A) of the first electroconductive film 21*a* by the distance "d1" is defined as "d2". More specifically, the minimum distance between the end of the first electroconductive film 21*a* on the side of the second electroconductive film 21*b* (the portion C) and the end of the second electroconductive film 21*b* on the side of the first electroconductive film 21*a* (the portion D) in opposition to the end (the portion C), which is away from a protrusion of the first electroconductive film 21*a* along the end of the first electroconductive film 21*a* forming the periphery (edge) of the gap 8 in a plane substantially in parallel to the surface of the substrate 1 by the same distance as d1 is defined as "d2".

It is to be noted that d1 is sufficiently small (10 nm or less). Therefore, the above-described "d2" may be defined as the minimum distance between an end of the first electroconductive film 21*a* on the side of the second electroconductive film 21*b* (a portion C) which is away by the same distance as "d1" in a direction perpendicular to a line through the portions A and B defining the above-described "d1" and an end of the second electroconductive film 21*b* on the side of the first electroconductive film 21*a* (a portion D) in opposition to the end (the portion C). More specifically, the above-described "d2" may be defined as the minimum distance between the end of the first electroconductive film 21*a* on the side of the second electroconductive film 21*b* (the portion C) which is away by the same distance as d1 in the direction perpendicular to the line through the portions A and B defining the above-described d1 in the plane substantially in parallel to the surface of the substrate 1 and the end of the second electroconductive film 21*b* on the side of the first electroconductive film 21*a* (the portion D) in opposition to the end (the portion C) (see FIG. 30B).

It is to be noted that "d2" may be 10 nm or less. However, the end of the first electroconductive film 21*a* (the portion C) which defines "d2" does not correspond to the above-described protrusion (a portion A). More specifically, suppose that the portion C is the above-described protrusion (the portion A), the above-described portion A would exist within "d2" from the portion C, and the distance from the portion A to the second electroconductive film 21*b* is less than d2. Therefore, according to the present invention, if a portion is defined as the portion A, there would exist no portion where the distance between the first electroconductive film 21*a* and the second electroconductive film 21*b* is less than d1 within d1 from the portion A.

Further, as described above, according to the present invention, it is preferable that the electron-emitting device has a lot of such portions A. In such a case, the distance from the portion A to the surface of the substrate 1 (the height of the portion A from the surface of the substrate 1) may be varied. However, in view of the stability of the electron emitting characteristics, it is preferable that the difference in the distance from the plurality of portions A to the surface of the substrate 1 is effectively within d1. Further, the portions A are preferably not arranged perpendicularly to the surface of the substrate 1. In other words, it is preferable that the plurality of portions A are not arranged in the direction of the film thickness of the first electroconductive film 21*a*.

The thickness of the electroconductive films (21*a* and 21*b*) is very small, and practically 1 μm or less and 1 nm or more, preferably 500 nm or less and 1 nm or more, and more preferably 200 nm or less and 1 nm or more. Therefore, arrangement of a lot of such portions A in the perpendicular direction may lead to fluctuations in the electron emitting characteristics over time. This is the reason why it is preferable that the portions A are not arranged perpendicularly.

According to the present invention, d1 is 10 nm or less, and at the same time, the above-described ratio of d1 to d2 (d2/d1) is set to be 1.2 or more. Under these conditions, large emission current Ie and high electron emitting efficiency can be obtained.

Figure 31A:
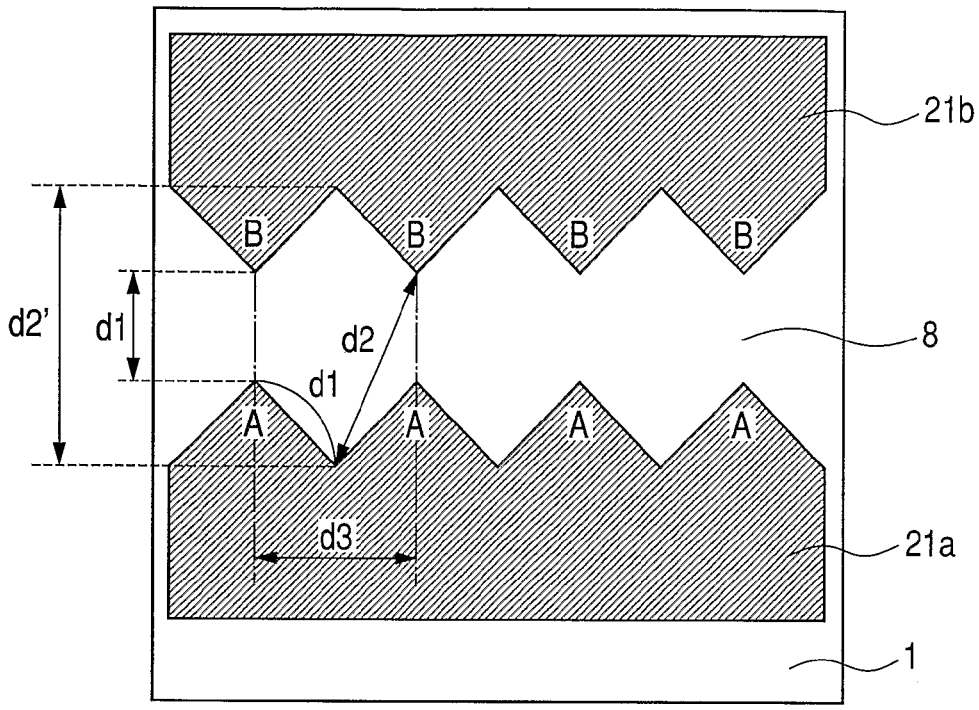
FIGS. 31A and 31B are plan views schematically illustrating other exemplary structures of the electron-emitting device according to the present invention.
Figure 31B:
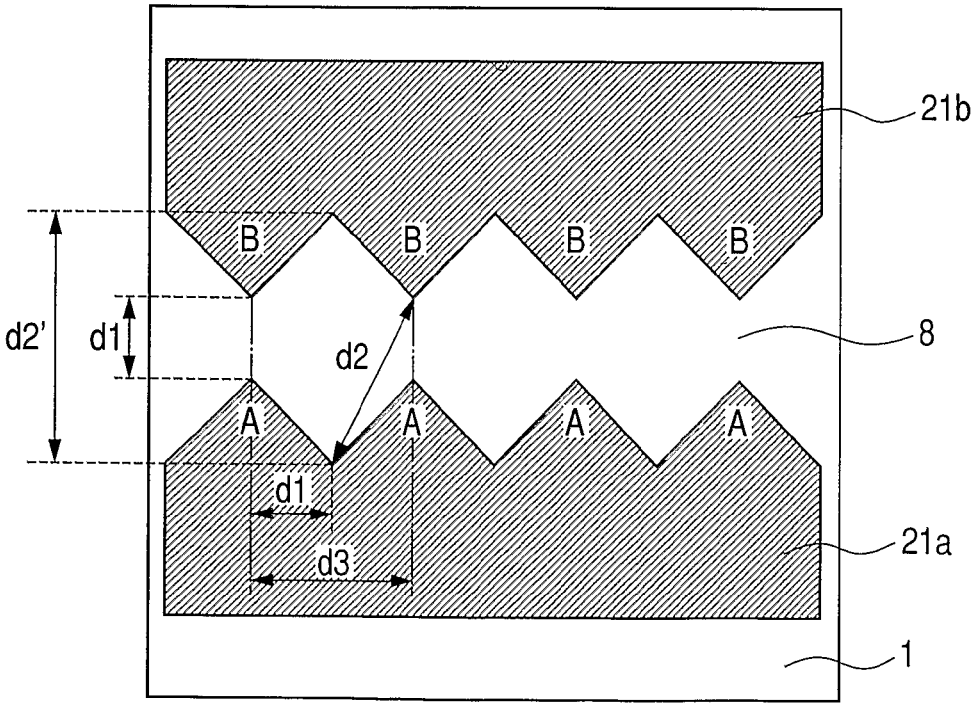

It is to be noted that FIGS. 30A and 30B illustrate embodiments where the end of the second electroconductive film 21*b* on the side of the first electroconductive film 21*a* is linear. However, according to the present invention, the end of the second electroconductive film 21*b* on the side of the first electroconductive film 21*a* may be uneven (nonlinear) as illustrated in FIGS. 31A and 31B. In such embodiments, it is particularly preferable that protrusions at the end of the second electroconductive film 21*b* on the side of the first electroconductive film 21*a* are to be arranged to correspond to the above-described portions B in order to improve the electron emitting efficiency. It is to be noted that FIG. 31A corresponds to an explanation of FIG. 30A while FIG. 31B corresponds to an explanation of FIG. 30B.

Further, in the configurations illustrated in FIGS. 30A, 30B, 31A, and 31B, macroscopically, a gap (or a space) 8 extends perpendicularly to the direction in opposition to the first and second electroconductive films 21*a* and 21*b*. However, as described in the following, macroscopically, a gap 8 may be nonlinear (typically serpentine, or snaking). If the gap 8 is nonlinear, a plurality of protrusions (portions A) can be arranged in high density at the end of the first electroconductive film 21*a* on the side of the second electroconductive film 21*b*. As a result, a change in the amount of emitted electrons over time can be further suppressed, which is preferable.

Still further, a distance d3 between the portions (protrusions) is preferably set to be 3 d1 or more and 2000 d1 or less. In view of an increase of the emission current Ie and/or suppressing fluctuations in the amount of emitted electrons, it is more preferable that the distance d3 is set to be uniform.

When such an electron-emitting device is used in a high definition display, an area assigned to one electron-emitting device is small. Therefore, there is a tendency that fluctuations in the emission current (Ie) become larger with regard to an electron-emitting device having the smaller number of the portions A (protrusions) compared with an electron-emitting device having the larger number of the portions A. As a result, uniformity of an image displayed on the display is lowered. As a practical range, the distance d3 between the portions A (protrusions) is set to be 2000 d1 or less, and more preferably, to be 500 d1 or less. If the distance d3 is in this range, the fluctuations of the emission current Ie can be suppressed. Although it is preferable that the distance d3 between the portions A (protrusions) is uniform, it may have a distribution to some extent.

Figure 1A:
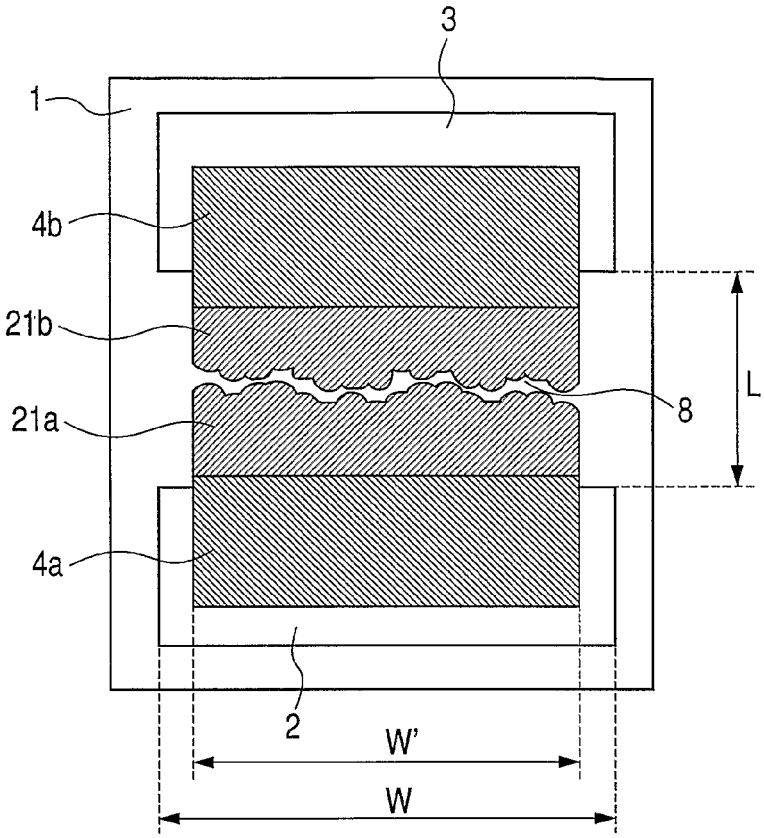
FIGS. 1A, 1B and 1C are a plan view, a plan view, and a sectional view, respectively, schematically illustrating an exemplary structure of an electron-emitting device according to the present invention.
Figure 1B:
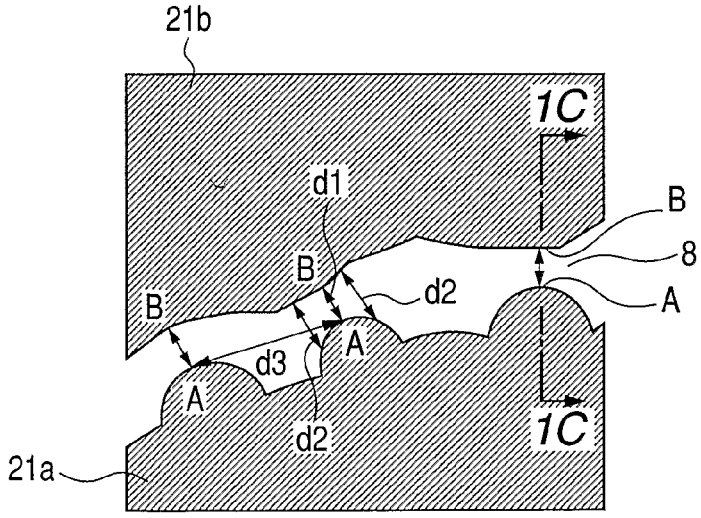

Next, a variation of the above-described electron-emitting device according to the present invention will be described with reference to FIGS. 1A, 1B, and 1C. FIG. 1A is a schematic plan view of an exemplary variation of the electron-emitting device according to the present invention. FIG. 1B is an enlarged view of the gap 8. The differences between this variation and the configurations illustrated in FIGS. 30 and 31 are: (1) the gap 8 is nonlinear and the acuteness (linearity) of the shape of the ends of the first electroconductive film 21*a* and the second electroconductive film 21*b* is low; and (2) the first electroconductive film 21*a* is connected to a first electrode 4A which is connected to a first auxiliary electrode 2, and similarly, the second electroconductive film 21*b* is connected to a second electrode 4*b* which is connected to a second auxiliary electrode 3. Except for the above item (1) and (2), this variation is basically comparable to the configurations of the electron-emitting device described above with reference to FIGS. 30 and 31.

In such a manner as the above item (1), if the protrusions (portions A) are arranged at uniform intervals, as compared with a case where the gap 8 is linear, more protrusions (portions A) can be provided, and thus, the electron emitting characteristics are thought to be made more stable. Further, in such a manner as the above item (2), voltage can be applied between the electroconductive films 21*a* and 21*b* with stability.

In this configuration, the first and second auxiliary electrodes (2 and 3) and the first and second electrodes (4*a* and 4*b*) are used. However, according to the present invention, as in the configurations described with reference to FIGS. 30 and 31, the electron-emitting device requires at least the first electroconductive film 21*a* and the second electroconductive film 21*b*. In other words, according to the present invention, the auxiliary electrodes (2 and 3) and the electrodes (4*a* and 4*b*) are not indispensable components of the electron-emitting device.

However, in order to connect with stability a power source (voltage supply source) for driving the electron-emitting device according to the present invention to the electroconductive films (21*a* and 21*b*) which are very thin, it is preferable to use the auxiliary electrodes (2 and 3) and/or the electrodes (4*a* and 4*b*). By connecting terminals of the power source to the electrodes (4*a* and 4*b*) or the auxiliary electrodes (2 and 3), voltage can be applied between the electroconductive films (21*a* and 21*b*) with stability. Therefore, the auxiliary electrodes (2 and 3) and/or the electrodes (4*a* and 4*b*) can be suitably applied also to the configurations of the electron-emitting device described with reference to FIGS. 30 and 31.

FIG. 1B is a schematic enlarged view of the gap 8 of FIG. 1A. Reference symbols A, B, d1, d2, and d3 of FIG. 1B are similar to those described with reference to FIGS. 30 and 31.

Figure 1C:
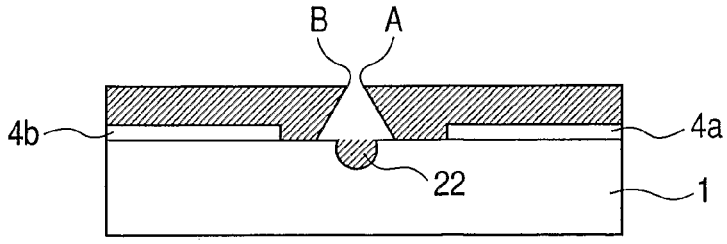
Figure 2A:
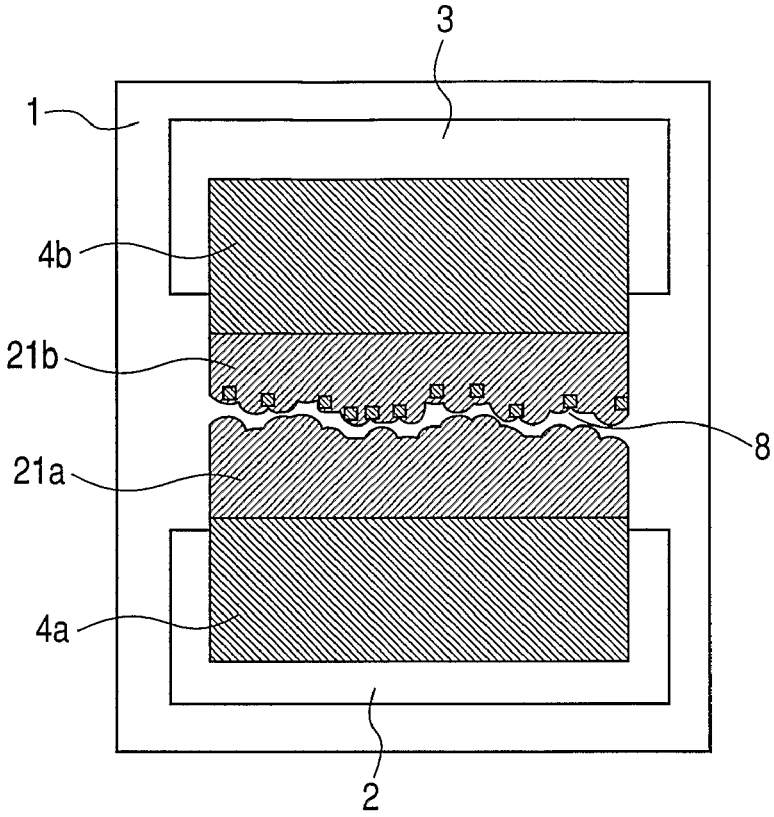
FIGS. 2A, 2B, 2C and 2D are a plan view, a plan view, a sectional view, and a sectional view, respectively, schematically illustrating another exemplary structure of an electron-emitting device according to the present invention.
Figure 2B:
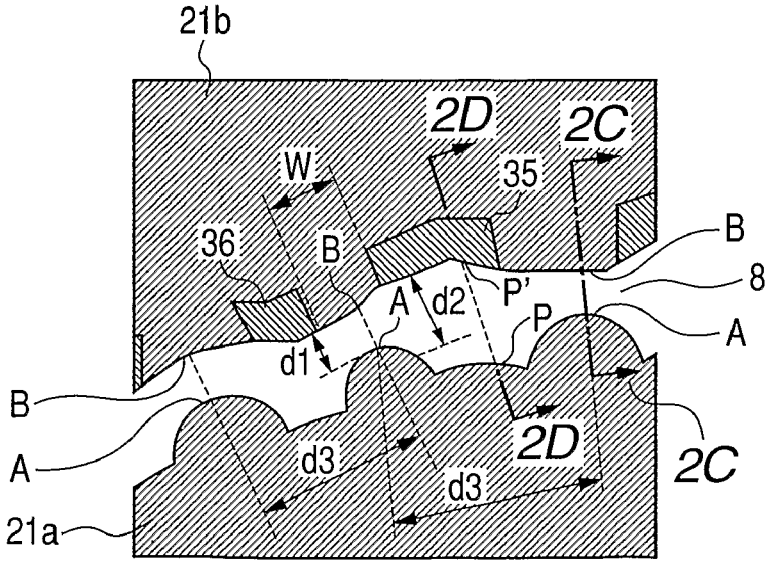
Figure 2C:
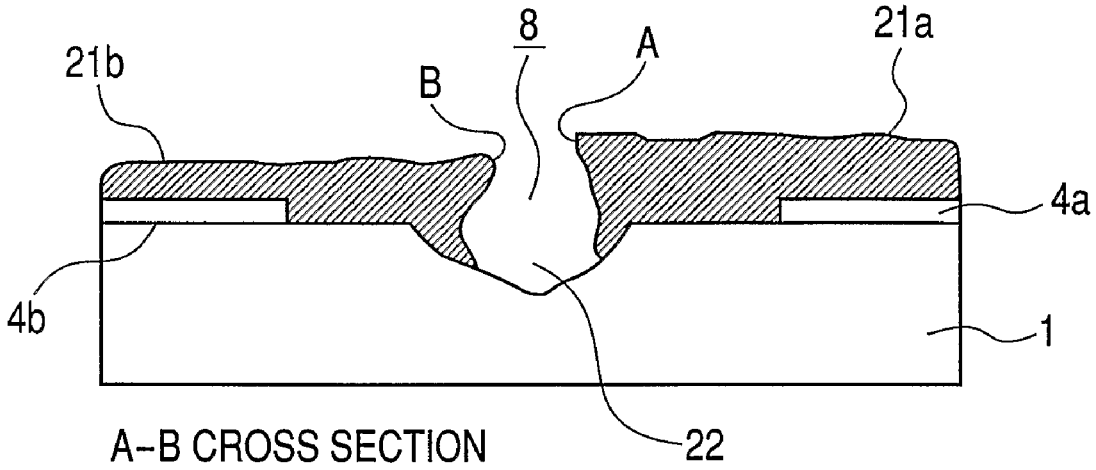
Figure 2D:
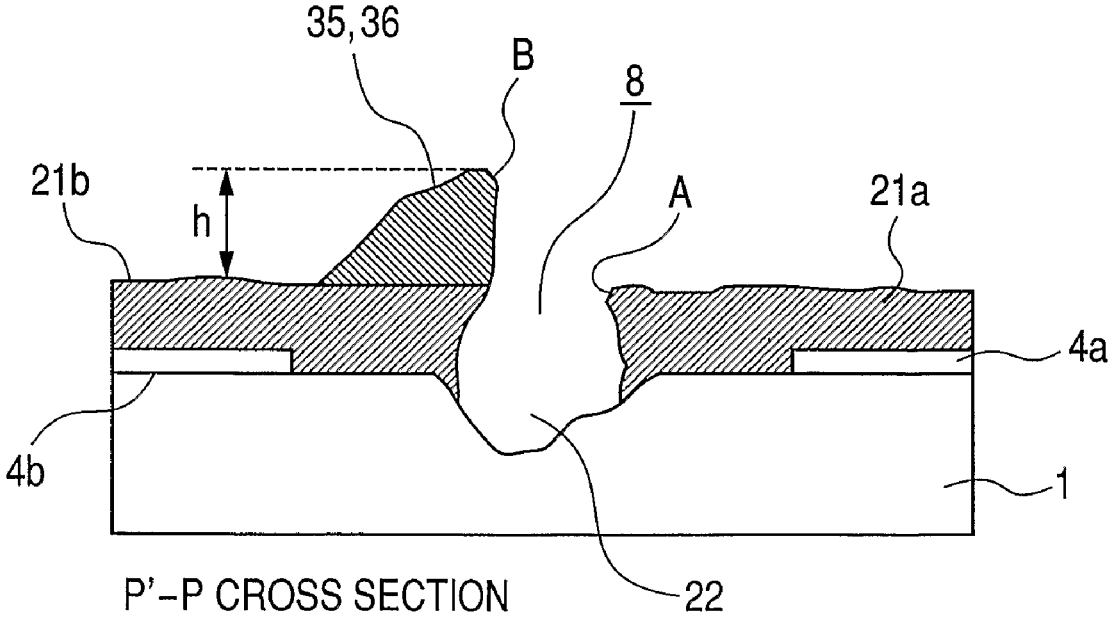

FIG. 1C is a schematic sectional view illustrating a portion between the portions A and B. Although the surface of the electroconductive films (21*a* and 21*b*) is parallel to the surface of the substrate 1, as illustrated in FIGS. 2C and 2D which will be described in the following, the surface is not necessarily required to be parallel to the surface of the substrate.

According to the present invention, it is preferable that the electron-emitting device including the configurations described with reference to FIGS. 30 and 31 has a concave 22 in the surface of the substrate 1 between the first electroconductive film 21*a* and the second electroconductive film 21*b* (the gap 8).

By providing such a concave 22, ineffective current between the first electroconductive film 21*a* and the second electroconductive film 21*b* which is not the emission current Ie is thought to be suppressed. Further, according to the present invention, it is preferable that, as illustrated in FIG. 1C, the distance between the first and second electroconductive films 21*a* and 21*b* (the distance between the portions A and B) away from the surface of the substrate 1 is smaller than that on the surface of the substrate 1. By adopting such a structure, the distance between the portions A and B along the surface can be made larger, and as a result, ineffective current between the first electroconductive film 21*a* and the second electroconductive film 21*b* is thought to be further suppressed. In addition, it is thought that electrons can be emitted from portions nearer to the surface of the electroconductive film 21*a* (positions away from the surface of the substrate 1) to increase the electron emission current Ie.

Figure 3:
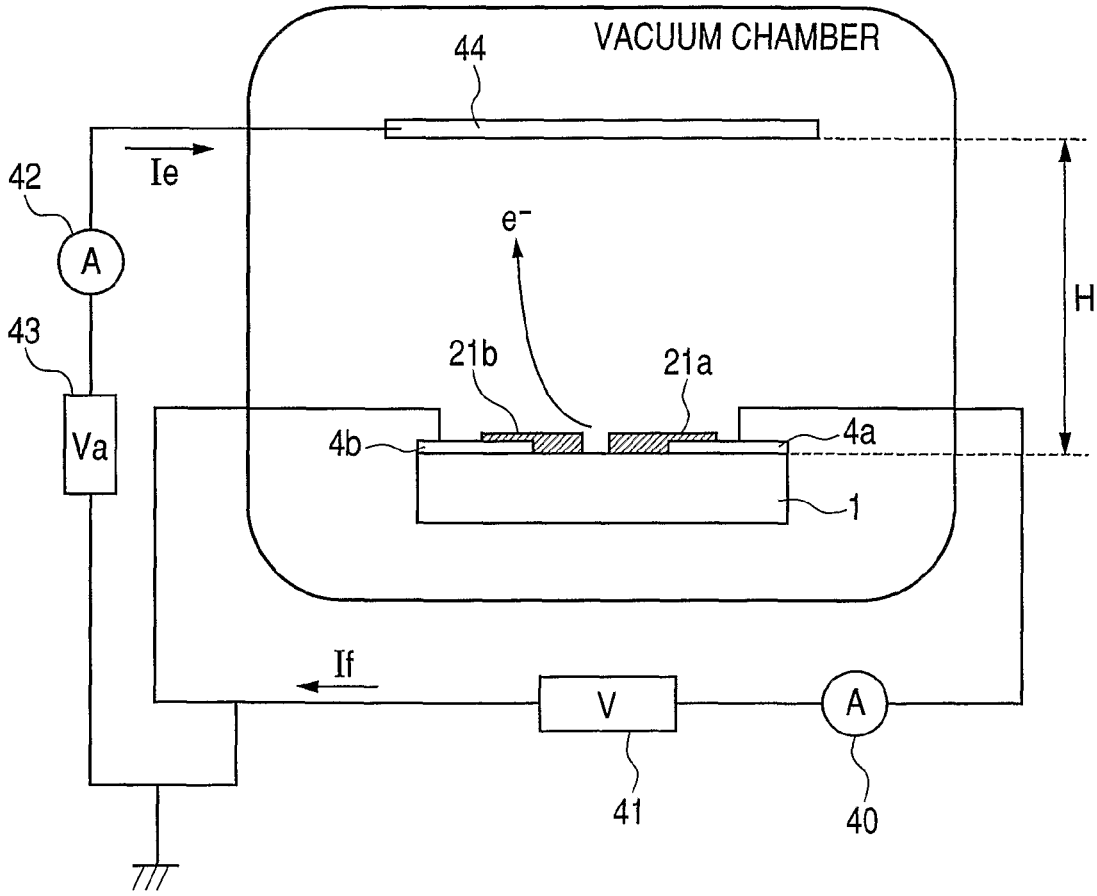
FIG. 3 is a schematic view illustrating an exemplary vacuum chamber with measurement and evaluation functions of an electron-emitting device.

When the above-described electron-emitting device according to the present invention is driven, for example, as illustrated in a schematic structural view of FIG. 3, the electron-emitting device according to the present invention is disposed in opposition to an anode electrode 44 and is driven in a vacuum (a space with a total pressure lower than the atmospheric pressure). By disposing the anode electrode over the electron-emitting device at a distance of H [m] from the electron-emitting device, an electron-emitting apparatus is formed. Then, drive voltage Vf [V] is applied between the first and second electroconductive films 21*a* and 21*b* such that the electric potential of the second electroconductive film 21*b* is higher than that of the first electroconductive film 21*a*. At the same time, voltage Va [V] is applied between the anode electrode 44 and the first electroconductive film 21*a* so that the electric potential of the anode electrode 44 is higher than that of the first and second electroconductive films (typically higher than that of the first electroconductive film 21*a*). This generates an electric field between the end of the first electroconductive film 21*a* and the end of the second electroconductive film 21*b* (in the gap 8). By setting the field intensity sufficiently enough for tunneling (quantum mechanical tunneling) of electrons, electrons from portions at the end of the first electroconductive film 21*a* which are arranged nearer to the end of the second electroconductive film 21*b* (portions A illustrated in FIGS. 1A and 1B) are thought to tunnel with higher priority. Most electrons which have tunneled scatter in proximity to the portions B, and at least part of the scattered electrons are thought to reach the anode electrode 44. It is to be noted that most electrons which do not reach the anode electrode 44 among electrons which have tunneled are thought to be absorbed in the second electroconductive film 21*b* to be ineffective current flowing between the first electroconductive film 21*a* and the second electroconductive film 21*b* (device current If).

Here, the field intensity used when the electron-emitting device according to the present invention is driven (when electrons are emitted) (the intensity of electric field applied between the first and second electroconductive films 21*a* and 21*b*) is effectively $1\times10^{9}$ V/m or more and less than $2\times10^{10}$ V/m. If the field intensity is less than this range, the number of electrons which tunnel becomes considerably small, and if the field intensity is more than this range, the first electroconductive film 21*a* and/or the second electroconductive film 21*b* may be deformed by the intense electric field, and often electrons are not emitted with stability.

According to the present invention, by setting d2/d1 to be 1.2 or more as described above, the electron-emitting device can decrease the number of electrons absorbed in the second electroconductive film 21*b*. As a result, the electron emitting efficiency ((current which reaches the anode)/(current which flows between the first and second electroconductive films 21*a* and 21*b*)) can be improved. The reason for this is that strong force away from the surface of the substrate 1 (toward the anode) acts on electrons which have tunneled from the portions A toward the portions B (including electrons scattered in proximity to the portions B) due to the electric field formed by setting d2/d1 to be 1.2 or more.

A variation of the electron-emitting device described with reference to FIGS. 1A to 1C is now described with reference to FIGS. 2A to 2D. FIG. 2A is, similarly to FIG. 1A, a schematic plan view. FIG. 2B is, similarly to FIG. 1B, a schematic enlarged plan view of the gap 8. FIG. 2C is, similarly to FIG. 1C, a schematic sectional view through portions A and B. FIG. 2D is a schematic sectional view taken along the line P-P' of FIG. 2B (through a protrusion of the second electroconductive film 21*b* and an end of the first electroconductive film 21*a* in opposition to the protrusion in a direction perpendicular to the surface of the substrate 1).

According to this configuration, the electron-emitting device has, in addition to the features described with reference to FIGS. 1A to 1C, protrusions in a direction substantially perpendicular to the surface of the substrate 1 (portions 35 and 36) as a part of the second electroconductive film 21*b*. It is to be noted that the protrusions (portions 35 and 36) are disposed so as to sandwich the portion B. Except for the above, this configuration is the substantially same as the electron-emitting device described with reference to FIGS. 1A to 1C.

With this configuration, as compared with the electron-emitting device described with reference to FIGS. 1A to 1C, the electron emitting efficiency can be further improved. It is to be noted that, since the protrusions (portions 35 and 36) are a part of the second electroconductive film 21*b*, it is not necessary that the material for forming the protrusions is different from the material for forming the portion other than the protrusions.

The thickness of the second electroconductive film 21*b* at the portion B is set to be smaller than that of the second electroconductive film 21*b* at the portions 35 and 36 (see FIGS. 2C and 2D). Since the portions 35 and 36 of the second electroconductive film 21*b* are away from the surface of the substrate 1 than the other portions of the second electroconductive film 21*b* (typically the portion B), they may be referred to as "projected portions" or "prominent portions".

Therefore, there is a difference of "h" between the height of the surface of the portions 35 and 36 of the second electroconductive film 21*b* from the surface of the substrate 1 and the height of the surface of the portion B from the surface of the substrate 1 ("h" may be referred to as the height of the projected portions).

Further, the second electroconductive film 21*b* has at least two projected portions, and there is a width "w" between the two projected portions. The width w can be, effectively, defined as a gap between portions of the respective "projected portions" which are farthest away from the surface of the substrate (defined as a gap between points (tops or apexes or summits) of the respective "projected portions"). Further, it is preferable that the width w between the above-described "projected portions" is effectively set to be 2 d1 or more and 50 d1 or less. If the width w is in this range, large emission current Ie and high electron emitting efficiency can be obtained. It is to be noted that the height of the point of the portion 35 from the surface of the substrate 1 and the height of the point of the portion 36 from the surface of the substrate 1 may be different from each other.

The height h of the above-described "projected portions" can be, effectively, defined as a value determined by subtracting the distance between the portion B and the surface of the substrate 1 from the distance between the portion of one of the "projected portions" (typically one "projected portion" of the two projected portions (35 and 36) sandwiching the portion B the height of which from the surface of the substrate 1 is smaller than that of the other projected portion) which is farthest away from the surface of the substrate 1 and the surface of the substrate 1. It is preferable that the height h of the "projected portions" is set to be 2 d1 or more and 200 d1 or less.

According to the present invention, as described above, the portions A and B form a part of the periphery of the gap 8 of the electron-emitting device. In order to improve the electron emitting efficiency, it is preferable that the portions 35 and 36 of the second electroconductive film 21*b* also form the periphery of the gap 8.

Further, according to the present invention, it is preferable that, where the gap between the first and second electroconductive films 21*a* and 21*b* is smaller than that of other portions (between the portions A and B in FIG. 2C), the thickness of the first electroconductive film 21*b* (the thickness at the portion B) is set to be equal to or smaller than the thickness of the second electroconductive film 21*a* (the thickness at the portion A) (preferably is set to be smaller than the thickness at the portion A).

This can improve the electron emitting efficiency of the electron-emitting device as described with reference to FIGS. 1A to 1C, 30, and 31. In addition, stronger force away from the surface of the substrate 1 (toward the anode) can act on electrons which tunnel from the portions A toward the portions B (including electrons scattered in proximity to the portions B) due to the electric field formed by the above-described "projected portions". As a result, the number of electrons absorbed in the second electroconductive film 21*b* can be decreased. As a result, as compared with the electron-emitting device described with reference to FIGS. 1A to 1C, 30, and 31, the electron emitting efficiency ((current which reaches the anode (Ie))/(current which flows between the first and second electroconductive films 21*a* and 21*b* (If))) can be dramatically improved.

It is to be noted that FIGS. 30, 31, 1A to 1C, and 2A to 2D illustrate embodiments where the first and second electroconductive films 21*a* and 21*b* are in opposition to each other in a direction in parallel to the surface of the substrate 1 and are completely separated with the gap 8 therebetween. However, according to the present invention, the first and second electroconductive films 21*a* and 21*b* of the electron-emitting device may connect at a portion thereof. In other words, the gap 8 may be formed in a part of one electroconductive film. More specifically, although complete separation is ideal, it is sufficient that satisfactory electron emitting characteristics can be obtained even if the first and second electroconductive films 21*a* and 21*b* connect at a minute region.

A conductive material such as a metal or a semiconductor including Ni, Au, PdO, Pd, Pt, and C may be used as the material for the electroconductive films (21*a* and 21*b*). More preferably, the electroconductive films are films containing carbon in view of a large amount of electron emission and stability over time. Further, practically, it is preferable that the films containing carbon as the main component (more specifically, films containing 70 atoms percent of carbon) are used. When, in this way, the electroconductive films (21*a* and 21*b*) are formed by films containing carbon, the electroconductive films (21*a* and 21*b*) may be referred to as carbon films.

Next, a method of manufacturing an electron-emitting device according to the present invention will be described.

Although there are many manufacturing methods, the electron-emitting device according to the present invention can be manufactured by, for example, the following processes (1) to (5). Of course, the electron-emitting device according to the present invention is not limited to one manufactured by the below-described manufacturing method.

Exemplary manufacturing methods are described with reference to schematic views of FIGS. 4 to 9. In the following examples, the above-described first and second electroconductive films 21*a* and 21*b* are formed of first and second carbon films 21*a* and 21*b*, respectively. Further, in the following, the first carbon film 21*a* is connected to the first electrode 4*a* which is connected to the first auxiliary electrode 2. Similarly, the second carbon film 21*b* is connected to the second electrode 4*b* which is connected to the second auxiliary electrode 3.

(Process 1)

Figure 4A:
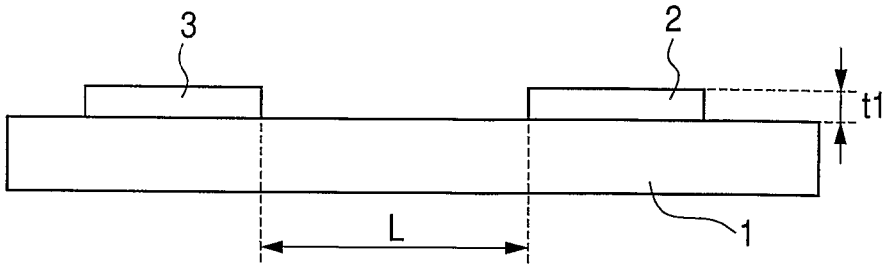
FIGS. 4A, 4B, 4C and 4D are schematic views illustrating a method of manufacturing the electron-emitting device according to the present invention.

After the substrate 1 is sufficiently cleaned, a material for forming the auxiliary electrodes 2 and 3 is deposited using vacuum evaporation, sputtering, or the like. Then, the first and second auxiliary electrodes 2 and 3 are formed by using photolithography or the like (FIG. 4A).

Exemplary materials for the substrate 1 includes quartz glass, soda lime glass, a glass substrate having silicon oxide (typically $SiO_2$) laminated thereon, the silicon oxide being formed by a known film forming method such as sputtering, and a glass substrate with its alkali component decreased. In this way, according to the present invention, a material containing silicon oxide (typically $SiO_2$) is preferable for the material of the substrate.

A length L between the auxiliary electrodes 2 and 3, a length W (see FIGS. 1A and 1C), a thickness t1, and the shape of the auxiliary electrodes 2 and 3 are appropriately designed depending on the application of the electron-emitting device. For example, when the electron-emitting device is used in an image display apparatus such as a television set described below, the design is made according to the resolution. In particular, with regard to high definition (HD) television, the pixel size is small and high preciseness is required. Therefore, in order to obtain satisfactory brightness with the size of the electron-emitting device being limited, design is made to obtain satisfactory emission current Ie. The length L between the auxiliary electrodes 2 and 3 is practically 5 μm or more and 100 μm or less. The thickness t1 of the auxiliary electrodes 2 and 3 is practically 5 nm or more and 10 μm or less.

(Process 2)

Figure 4B:
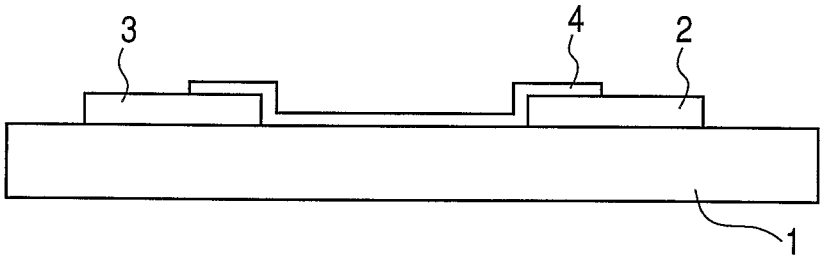

An electroconductive thin film 4 for connecting the first and second auxiliary electrodes 2 and 3 provided on the substrate 1 is formed (FIG. 4B). Exemplary methods of manufacturing the electroconductive thin film 4 include a method where, after an organic metal film is formed by applying and drying an organic metal solution, the organic metal film is heated and burned, and patterned by lift-off, etching, or the like.

Exemplary materials for the electroconductive thin film 4 include electroconductive materials such as metals and semiconductors. For example, metals such as Ni, Cr, Au, Mo, W, Pt, Ti, Al, Cu, Pd, Ag and the like and alloys thereof, metal oxides such as PdO, $RuO_2$, transparent conductors such as $In_2O_3$—$SnO_2$, and semiconductors such as polysilicon can be used.

It is to be noted that exemplary organic metal solutions include solutions of organic metal compounds the main element of which is Pd, Ni, Au, Pt, or the like of the above-described conductive film material. Although a method of forming the electroconductive thin film 4 by applying an organic metal solution is described here, the method of forming the electroconductive thin film 4 is not limited thereto, and the electroconductive thin film 4 may be formed also by vacuum evaporation, sputtering, CVD, dispersion and application, dipping, spinning, ink jet, or the like.

When "forming" process is carried out in the next process, it is preferable that Rs (sheet resistance) of the electroconductive thin film 4 is in the range of $10^2$ Ω/□ to $10^7$ Ω/□. It is to be noted that Rs is a value expressed as R=Rs (l/w) where R is resistance in the length direction of a film having the thickness t, the width w, and the length l. When the resistivity is ρ, Rs=ρ/t. Specifically, the film thickness having the above resistance ranges from 5 nm to 50 nm. Further, the width W' of the electroconductive thin film 4 (see FIGS. 1A and 1B) is preferably set to be smaller than the width W of the auxiliary electrodes.

(Process 3)

Figure 4C:
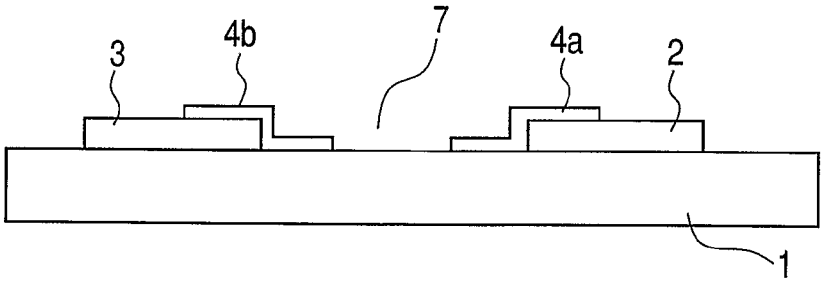

Next, process called as "forming" is carried out by applying voltage between the auxiliary electrodes 2 and 3. Application of the voltage forms a second gap 7 in a part of the electroconductive thin film 4. As a result, the first and second electrodes 4*a* and 4*b* can be disposed in opposition to each other in a lateral direction with respect to the surface of the substrate 1 with the second gap 7 therebetween (FIG. 4C).

Electric processing after the "forming" process can be carried out by, for example, disposing the substrate 1 in a measurement/evaluation apparatus illustrated in FIG. 3 described above. It is to be noted that the measurement/evaluation apparatus illustrated in FIG. 3 is a vacuum chamber. The vacuum chamber is provided with equipment necessary for a vacuum chamber such as a vacuum pump and a vacuum gauge (not shown) such that various kinds of measurement/evaluation can be carried out under a desired vacuum condition. The vacuum pump can be formed of a high vacuum system including an oil-free pump such as a magnetic levitation turbo pump or a dry pump, and/or an ultra-high vacuum system including an ion pump. Further, the measurement/evaluation apparatus is provided with a gas introducing apparatus (not shown), thereby making it possible to introduce a desired organic material with a desired pressure into the vacuum chamber. The substrate 1 provided at the vacuum chamber and in the vacuum chamber can be heated by a heater (not shown).

The "forming" process may be carried out by repeatedly applying a voltage pulse the pulse height value of which is a constant voltage (constant). Alternatively, the "forming" process may be carried out by applying a voltage pulse with the pulse height value gradually increased.

Figure 7A:
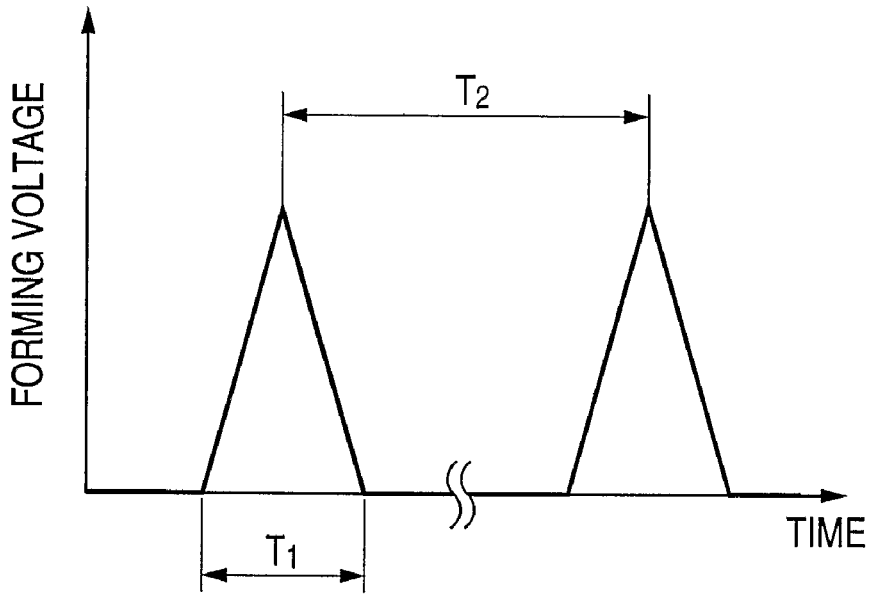
FIGS. 7A and 7B are schematic graphs illustrating an exemplary forming pulse when the electron-emitting device according to the present invention is manufactured.

FIG. 7A illustrates an exemplary pulse wave when the pulse height value is constant. In FIG. 7A, T1 and T2 denote a pulse width and a pulse interval (quiescent period), respectively, of the voltage pulse waveform. T1 can be 1 μsec to 10 msec while T2 can be 10 μsec to 100 msec. As for the applied pulse waveform itself, a triangular wave or a square wave may be used.

Figure 7B:
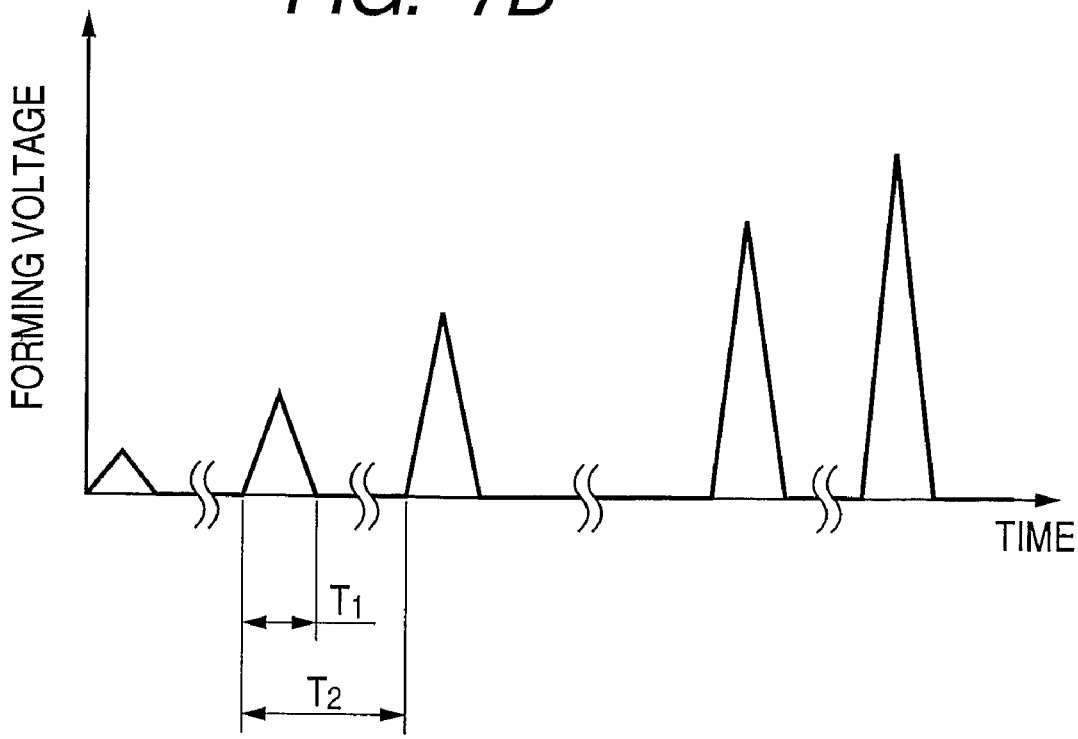

Next, FIG. 7B illustrates an exemplary pulse wave when the pulse voltage is applied with the pulse height value increased. In FIG. 7B, T1 and T2 denote a pulse width and a pulse interval (quiescent period), respectively, of the voltage waveform. T1 can be 1 μsec to 10 msec while T2 can be 10 μsec to 100 msec. As for the applied pulse waveform itself, a triangular wave or a square wave may be used. The pulse height value of the applied voltage pulse is, for example, increased by about 0.1 V.

In the examples described above, when the gap 7 is formed, pulse-like voltage (voltage pulse) is applied between the auxiliary electrodes 2 and 3 to carry out the "forming" process. However, the waveform of the pulse applied between the auxiliary electrodes 2 and 3 is not limited to triangular, and a desired waveform such as a square one may be used. Further, the pulse height value, the pulse width, the pulse interval, and the like are not limited to the above-described values. Appropriate values can be selected according to the resistance of the electroconductive film 4 and the like such that the gap 7 is satisfactorily formed.

Here, a method is illustrated where the first and second electrodes 4*a* and 4*b* are formed by carrying out the "forming" process with respect to the electroconductive thin film 4. However, according to the present invention, the first and second electrodes 4*a* and 4*b* can be formed using a known patterning technique such as photolithography. Further, when the first and second carbon films 21*a* and 21*b* are formed using "activation" process described below, since it is preferable that the gap 7 between the first and second electrodes 4*a* and 4*b* is small, the above-described "forming" process is preferably adopted. However, a method where the gap 7 is formed in the electroconductive thin film 4 by irradiating the electroconductive thin film 4 with focused ion beams (FIB) or electron beam lithography may be used to form the first and second electrodes 4*a* and 4*b* with a small gap 7 therebetween. Further, if the gap L between the first and second auxiliary electrodes 2 and 3 can be made small (comparable to gap 7) by the various techniques described above, the first and second electrodes 4*a* and 4*b* are not necessarily required. However, in order to manufacture the electron-emitting device according to the present invention at a low cost, it is preferable to use the above-described auxiliary electrodes 2 and 3 as electrodes for supplying with stability potential to the carbon films (21*a*, 21*b*) formed by the "activation" process described below, and to use the first and second electrodes 4*a* and 4*b* as electrodes for depositing with stability at high speed the carbon films (21*a*, 21*b*) at the beginning of the "activation" process.

(Process 4)

Figure 4D:
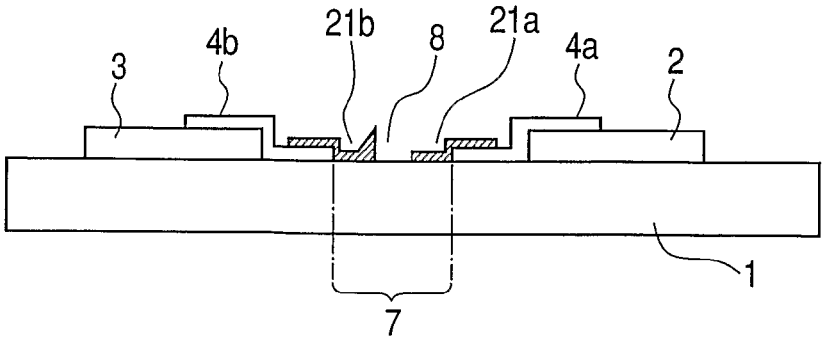
Figure 5A:
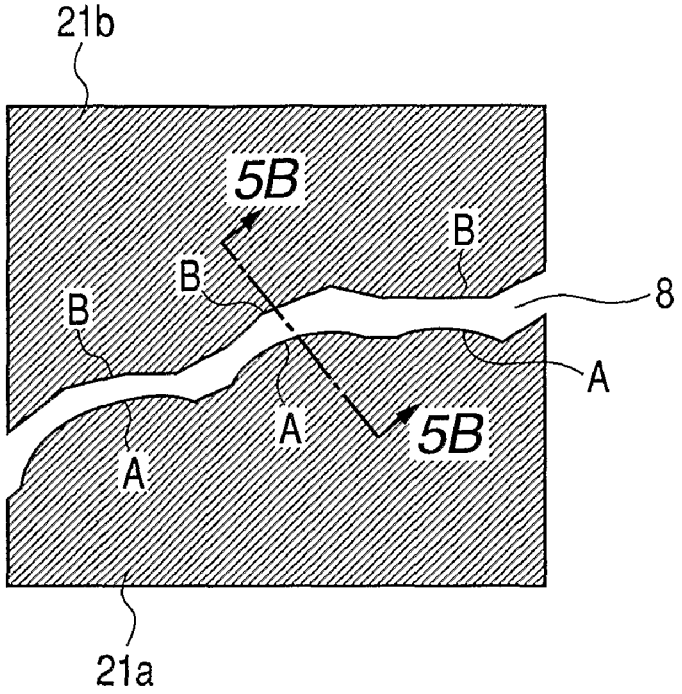
FIGS. 5A and 5B are a plan view and a sectional view, respectively, schematically illustrating an electron-emitting device after "activation" process according to Example 1 of the present invention.
Figure 5B:
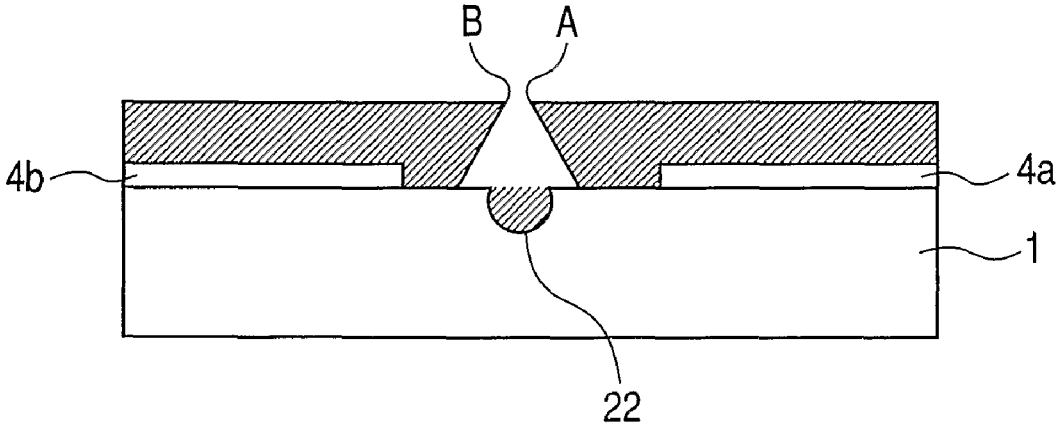

Next, "activation" process is carried out (FIG. 4D). The "activation" process can be carried out by, for example, introducing a carbon-containing gas into the vacuum chamber illustrated in FIG. 3 and applying voltage of both polarities (applying bipolar voltage) between the auxiliary electrodes 2 and 3 in an atmosphere containing the carbon-containing gas. This process allows deposition of the electroconductive films (21*a* and 21*b*) which are composed of carbon-containing films (carbon films) on the substrate 1 between the first and on second electrodes 4*a* and 4*b* (on the substrate 1 located in the gap 7) and on the first and second electrodes 4*a* and 4*b* in the vicinity of the substrate 1 (in the vicinity of the gap 7).

An organic material gas may be used as the above-mentioned carbon-containing gas. Organic materials may include: aliphatic hydrocarbons composed of alkanes, alkenes, and alkynes; aromatic hydrocarbons; and organic acids such as alcohols, aldehydes, ketones, amines, phenol, carboxylic acid, and sulfonic acid. Specifically, organic materials including: saturated hydrocarbons represented by Cn H2n+2 such as methane, ethane, and propane; unsaturated hydrocarbons represented by Cn H2n such as ethylene and propylene; benzene; toluene; methanol; ethanol; formaldehyde; acetaldehyde; acetone; methylethylketone; methylamine; ethylamine; phenol; formic acid; acetic acid; and propionic acid can be used.

It is preferable that the above-described carbon-containing gas is introduced into the vacuum chamber after being once depressurized to be on the order of $10^{-6}$ Pa. The preferable partial pressure of the carbon-containing gas depends on the form of the electron-emitting device, the shape of the vacuum chamber, the carbon-containing gas to be used, and the like, and is set appropriately.

Figure 8A:
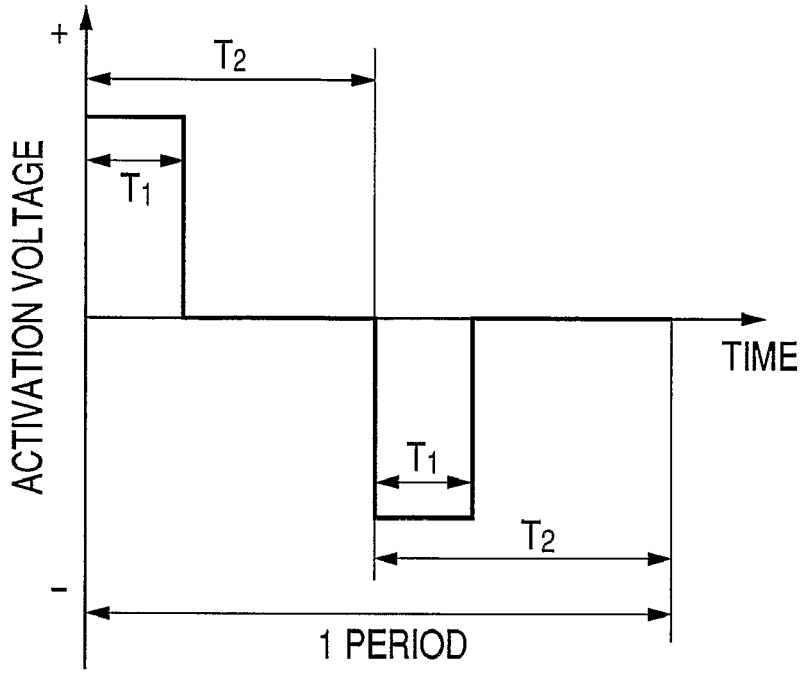
FIGS. 8A and 8B are schematic views illustrating an exemplary activation pulse when the electron-emitting device according to the present invention is manufactured.
Figure 8B:
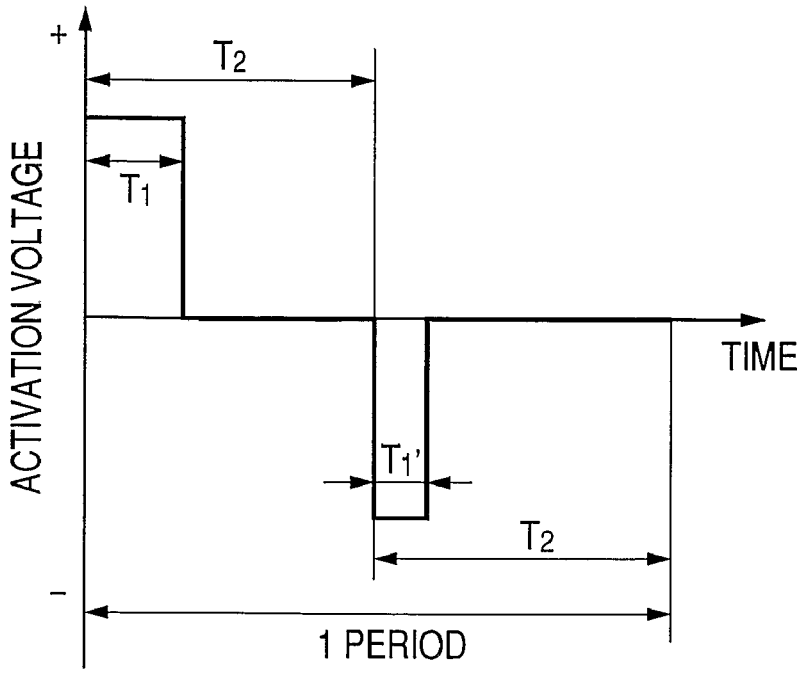

As the waveform of the voltage applied between the auxiliary electrodes 2 and 3 during the above-described "activation" process, it is preferable to use, for example, a pulse waveform having both polarities (a bipolar voltage pulse) illustrated in FIG. 8A or FIG. 8B. It is to be noted that, when such pulse is applied, one of the auxiliary electrodes is preferably grounded, while the pulse voltage illustrated in FIG. 8A or FIG. 8B is applied to the other of the auxiliary electrodes. It is preferable that the maximum voltage (absolute value) to be applied is selected appropriately in a range of 10 V to 25 V. In FIG. 8A, T1 denotes a pulse width and T2 denotes a pulse interval of the pulse voltage to be applied. Although, in this example, the absolute values of the positive voltage and of the negative voltage are equal to each other, they may be different from each other. In FIG. 8B, T1 denotes a pulse width of the pulse voltage that is a positive voltage and T1' denotes a pulse width of the pulse voltage that is a negative voltage. T2 denotes a pulse interval. Although, in this example, T1>T1' is set and the absolute values of the positive voltage and of the negative voltage are equal to each other, the absolute values may be different from each other.

Figure 9:
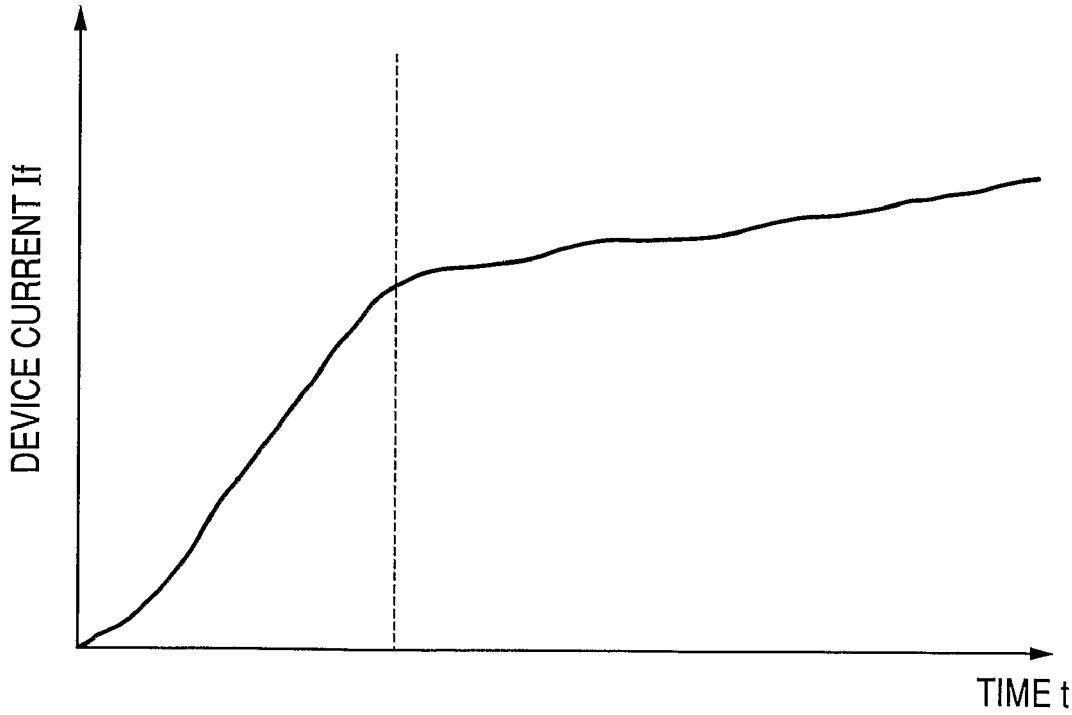
FIG. 9 is a schematic graph illustrating current in the "activation" process of the electron-emitting device according to the present invention.

FIG. 9 illustrates a profile of device current (If) between the auxiliary electrodes 2 and 3 during the "activation" process. It is preferable that the "activation" process ends after the increase of the device current becomes gentle (after the graph enters a region on the right side of a dotted line of FIG. 9).

By applying voltage having the waveform illustrated in FIG. 8A between the auxiliary electrodes 2 and 3 during the "activation" process, the shape illustrated in FIGS. 1C and 2C where the thickness of the first carbon film 21*a* is approximately equal to that of the second carbon film 21*b* can be formed. The carbon films formed in this way can be suitably applied to formation of the embodiment of the electron-emitting device illustrated in FIGS. 1A to 1C.

Figure 6A:
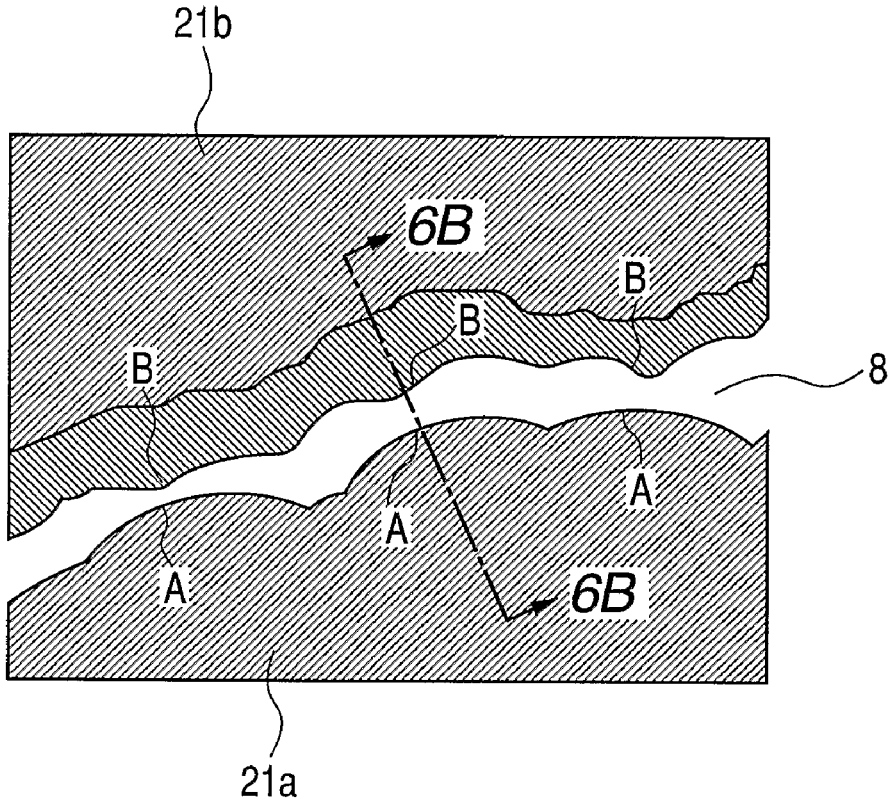
FIGS. 6A and 6B are a plan view and a sectional view, respectively, schematically illustrating an electron-emitting device after the "activation" process according to Example 2 of the present invention.
Figure 6B:
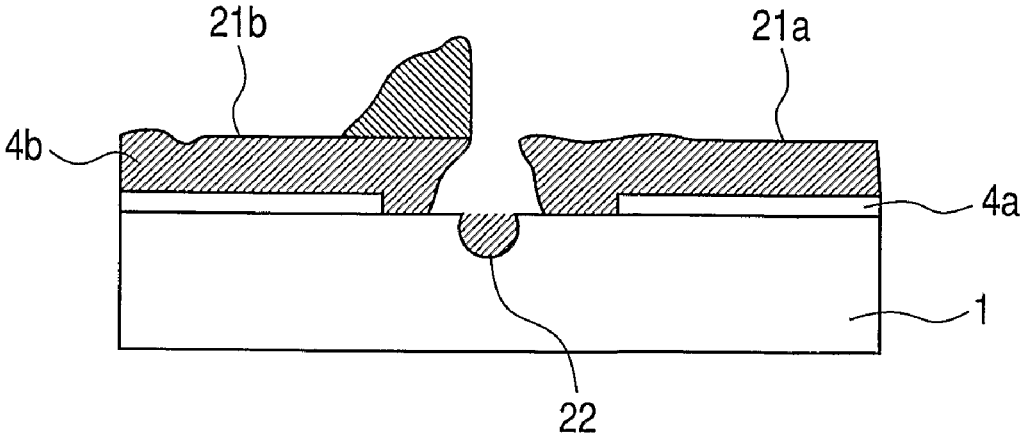

On the other hand, by applying voltage having the asymmetrical waveform illustrated in FIG. 8B between the auxiliary electrodes 2 and 3 during the "activation" process, the thickness of the end of the second carbon film 21*b* forming the periphery (edge) of the gap 8 can be made larger than that of the end of the first carbon film 21*a* forming the periphery of the gap 8 (an asymmetrical structure can be manufactured) as illustrated in FIGS. 2D, 6A, and 6B. FIG. 6B is a schematic sectional view taken along the line 6B-6B of FIG. 6A. For purposes of clarity, in FIGS. 2D, 6A, and 6B, a portion of the second carbon film 21*b* having a larger thickness than that of the end of the first carbon film 21*a* and the other portion of the second carbon film 21*b* are shown so as to be distinguished. However, it does not mean that there are actual differences in the material and in the structure. The carbon films formed in this way can be suitably used in formation of the electron-emitting device illustrated in FIG. 2.

Either the waveform illustrated in FIG. 8A or the waveform illustrated in FIG. 8B can be used to form a transformed portion of the substrate (concave) 22, by, for example, carrying out the "activation" process until the graph enters a region on the right side of the dotted line of FIG. 9 and is away enough from the dotted line. Further, by carrying out the "activation" process until the graph enters a region on the right side of the dotted line in FIG. 9, the distance between the end of the first carbon film 21*a* and the end of the second carbon film 21*b* away from the surface of the substrate 1 can be made smaller than that on the surface of the substrate 1. With regard to the transformed portion of the substrate (concaved (pitted) portion of the substrate) 22, the following consideration is made.

When the temperature of the substrate rises under the presence of $SiO_2$ (material of the substrate) in the vicinity of carbon, Si is consumed:

$$SiO_2+C \rightarrow SiO\uparrow+CO\uparrow.$$

It is thought that this chemical reaction consumes Si in the substrate to form the shape where the surface of the substrate is cut (the concave).

The transformed portion of the substrate (concave) 22 increases the distance between the first and second carbon films 21*a* and 21*b* along the surface of the substrate. Therefore, electric discharge due to the strong electric field applied between the first and second carbon films 21*a* and 21*b* when the device is driven and excess device current If can be suppressed.

Carbon in the first and second carbon films 21*a* and 21*b*, which are films containing carbon according to the present invention is now described. Carbon contained in the carbon films (21*a* and 21*b*) is preferably graphite-like carbon. Graphite-like carbon according to the present invention includes carbon having the complete crystal structure of graphite (so-called HOPG), carbon having slight irregularities with the grain size of about 20 nm, (PG), carbon having larger irregularities with the grain size of about 2 nm (GC), and amorphous carbon (amorphous carbon and/or a mixture of amorphous carbon and above-described graphite crystallite). In other words, even there are irregularities in layers such as grain boundaries between graphite grains in the graphite-like carbon, it can be suitably used.

(Process 5)

Next, processing for shaping the first and second carbon films 21*a* and 21*b* into the shape illustrated in FIGS. 1A to 1C and 2A to 2D is carried out.

More specifically, by a method using, for example, an atomic force microscope (AFM) illustrated in FIGS. 10A, 10B, 11A, 11B, and 11C, the carbon films can be shaped into the shape illustrated in FIGS. 1A to 1C or FIGS. 2A to 2D. Although, here, an AFM is used in the processing for shaping the first and second carbon films 21*a* and 21*b*, the processing is not limited to one using a probe of the AFM.

The above-described processing using the AFM can be carried out as in the following, for example.

First, a case where the electron-emitting device illustrated in FIGS. 1A and 1B are formed is described.

Figure 10A:
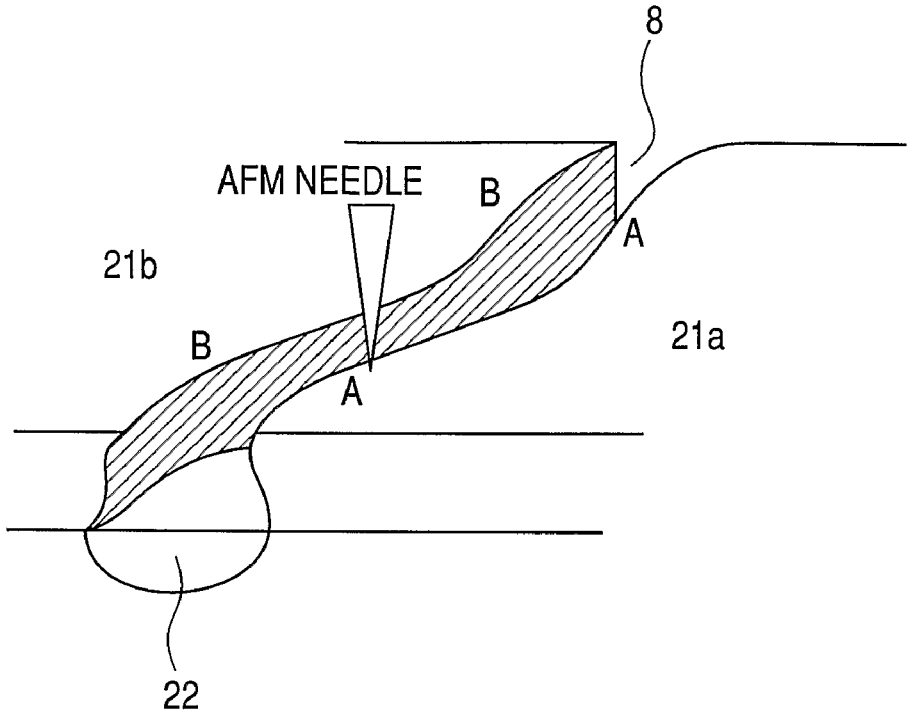
FIGS. 10A and 10B are schematic views illustrating exemplary process of cutting a carbon film of the electron-emitting device according to the present invention.
Figure 10B:
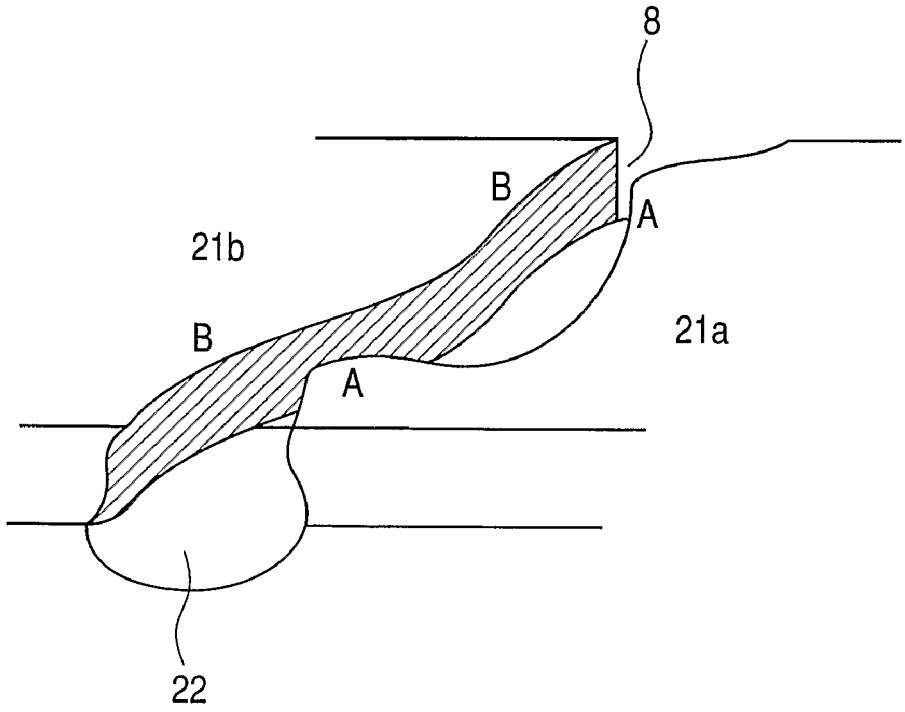

As described above, when the electron-emitting device illustrated in FIGS. 1A and 1B are formed, in the above-described Process 4 ("activation" process), it is preferable to use the method of repeatedly applying voltage pulse of both polarities having the same voltage value and the same pulse widths. As a result, the thickness of the second carbon film 21*b* can be approximately the same as that of the first carbon film 21*a*. Then, a probe of the AFM is aligned with the first carbon film 21*a* (FIG. 10A). Then, the probe of the AFM is brought into contact with the end of the first carbon film 21*a* (the portion forming the periphery of the gap 8) to cut a part of the end of the carbon film 21*a* (FIG. 10B). When the end of the carbon film 21*a* is cut, the AFM can be in a contact mode (contact pressure is controlled by the voltage). This allows the formation of the portion A (protrusion) illustrated in FIGS. 1A and 1B. This processing is carried out along the gap 8 at a plurality of locations at the end of the first carbon film 21*a* (the end of the carbon film 21*a* forming the periphery of the gap 8) at intervals d3. This allows manufacture of the electron-emitting device having the structure illustrated in FIGS. 1A and 1B.

Next, a case where the electron-emitting device illustrated in FIGS. 2A to 2D is formed is described.

Figure 11A:
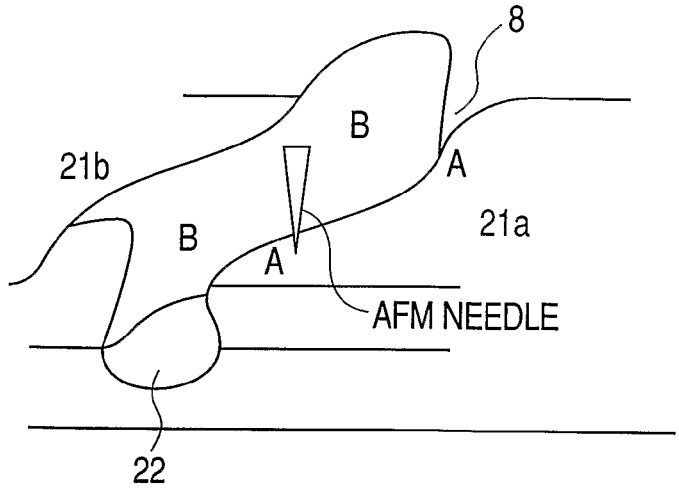
FIGS. 11A, 11B and 11C are schematic views illustrating another exemplary process of cutting a carbon film of the electron-emitting device according to the present invention.
Figure 11B:
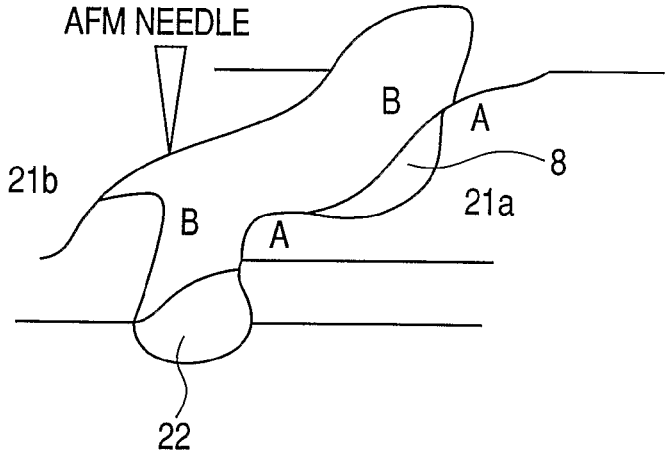
Figure 11C:
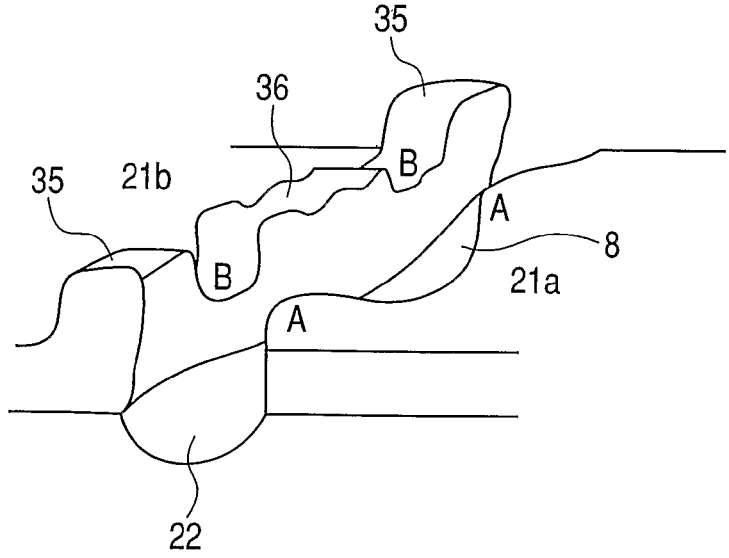

As described above, when the electron-emitting device illustrated in FIGS. 2A to 2D is formed in the above-described Process 4 ("activation" process), it is preferable to use the method of repeatedly applying pulse voltage of both polarities having the asymmetrical voltage values and/or the asymmetrical pulse widths. Typically, it is sufficient that the pulse height value (voltage value) and/or the pulse width in which the potential of the auxiliary electrode connected to the carbon film to be formed thicker than the other carbon film (the auxiliary electrode 3 in the case illustrated in FIGS. 2A to 2D) is set to be higher than the potential of the auxiliary electrode connected to the other carbon film (the auxiliary electrode 2 in the case illustrated in FIGS. 2A to 2D) is set to be larger than the pulse height value (voltage value) and/or the pulse width in which the inverse relationship of the potentials is set. It is to be noted that, since the protrusions (portions 35 and 36) are a part of the second electroconductive film 21*b*, it is not necessary that the material for forming the protrusions is different from the material for forming the portion other than the protrusions. As a result, as illustrated in FIGS. 6A and 6B, the thickness of the second carbon film 21*b* can be larger than that of the first carbon film 21*a*. Then, a probe of the AFM is aligned with the first carbon film 21*a*. Then, the probe of the AFM is brought into contact with the end of the first carbon film 21*a* (the portion forming the periphery of the gap 8) to cut a portion of the end of the carbon film 21*a* (FIG. 11A). This allows the formation of the portion A (protrusion) illustrated in FIGS. 2A to 2D. After that, the probe of the AFM is aligned with the second carbon film 21*b* (FIG. 11B). Then, the probe of the AFM is brought into contact with the end of the second carbon film 21*b* (the portion forming the periphery of the gap 8) to cut a part of the end of the carbon film 21*b* (FIG. 11C). This allows the formation of the portions 35 and 36 (projected portions) with the portion B (in opposition to the portion A) therebetween. The above processing is carried out along the gap 8 at a plurality of locations at the end of the second carbon film 21*b* (the end of the carbon film 21*b* forming the periphery of the gap 8) at intervals d3. This allows manufacture of the electron-emitting device having the structure illustrated in FIGS. 2A to 2D (FIG. 11C).

The electron-emitting device according to the present invention having the structure illustrated in FIGS. 1A to 1C or FIGS. 2A to 2D may be manufactured without using the processing described above (Process 5). As an example of such a case, a method of forming the electron-emitting device illustrated in FIGS. 1A to 1C or FIGS. 2A to 2D using an electron beam is described in the following (hereinafter, referred to as an "electron beam process").

Process 1 to Process 3 are similar to the above-described case. The "activation" process in Process 4 may use a similar carbon-containing gas. This process is similar to the above-described Process 4 except that a symmetrical pulse waveform illustrated in FIG. 8A is used. In the method described here, in the "activation" process, after the graph enters a region where the increase of the device current If becomes gentle (a region on the right side of a dotted line in FIG. 9), the voltage pulse is applied in an atmosphere containing the carbon-containing gas while an electron beam is irradiated.

Figure 23:
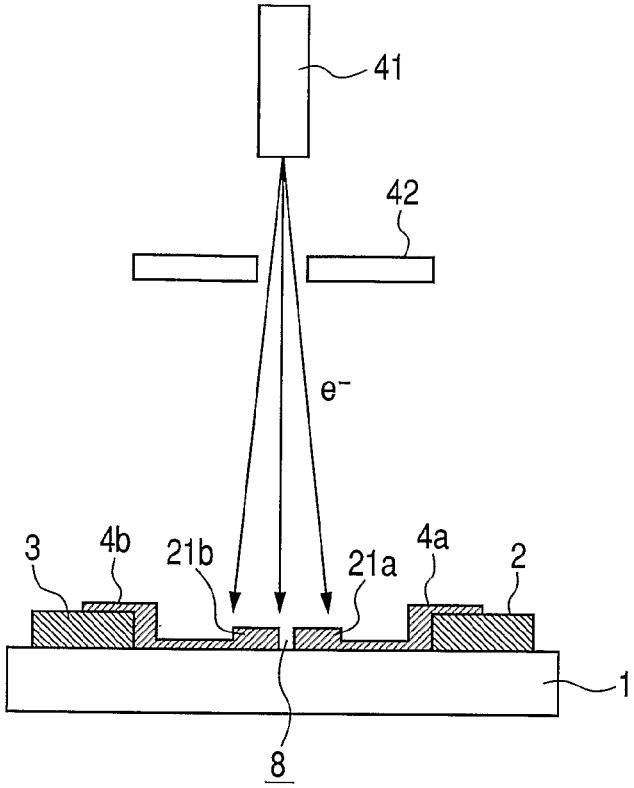
FIG. 23 is a schematic view for explaining electron beam treatment.

This method is described in the following with reference to FIG. 23.

A diameter of an electron beam emitted from an electron emitting means 41 need not be narrowed to the gap 8, and preferably has a range of 1 μm or larger with the gap 8 being the center, taking into consideration the voltage applied between the auxiliary electrodes 2 and 3, the partial pressure of the carbon-containing gas during the "activation" process, and the like. However, if the range of irradiation with the electron beam is too large, the carbon compound may deposit even on a region where it is unnecessary. Therefore, it is preferable to block the electron beam emitted from the electron emitting means 41 by an electron beam blocking means 42 to suppress the spread of the electron beam. The electron beam irradiation is preferably continuous (DC-like) with the voltage applied between the auxiliary electrodes being pulse-like. The pulse voltage applied between the auxiliary electrodes 2 and 3 preferably has a waveform and voltage values illustrated in FIG. 8A and similar to those before the electron beam irradiation which are controlled over time. It is sufficient that the period of the electron beam irradiation is within a range where the current in the region where the increase of the device current becomes gentle (the region on the right side of the dotted line in FIG. 9) is substantially maintained, and the period is preferably 10 minutes to 60 minutes.

This also allows manufacture of the electron-emitting device having the structure illustrated in FIGS. 1A and 1B.

Another exemplary method of manufacturing the electron-emitting device illustrated in FIGS. 1A to 1C or FIGS. 2A to 2D through electron beam irradiation is described in the following with reference to FIGS. 26A, 26B, and 26C. Although an example where the above-described electrodes 4*a* and 4*b* are not used is described here, of course, the electrodes 4*a* and 4*b* may be used.

(Process 1')

Figure 26A:
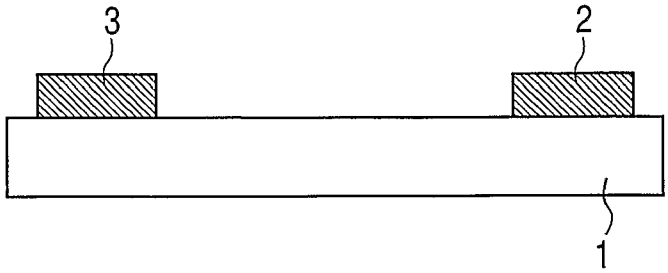
FIGS. 26A, 26B and 26C are schematic views for explaining a method of forming a carbon film by irradiation with an electron beam according to an example of the present invention.

The auxiliary electrodes 2 and 3 are formed on the substrate 1 in a similar way as in the above-described Process 1 (FIG. 26A).

(Process 2')

Figure 26B:
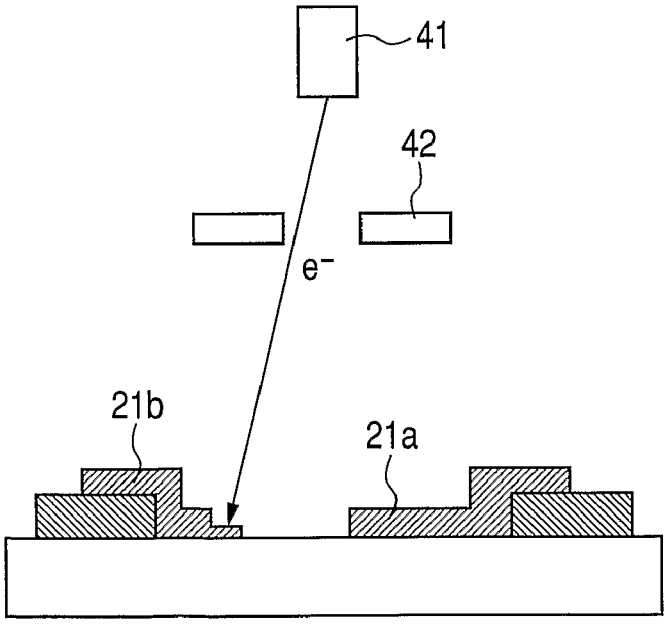
Figure 26C:
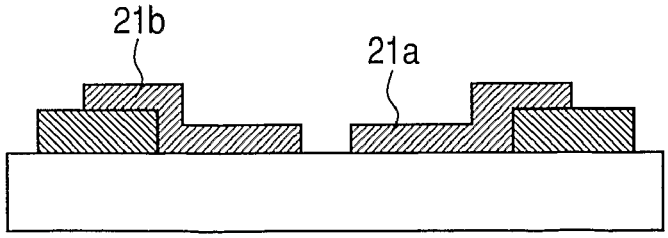

Next, the first carbon film 21*a* and the second carbon film 21*b* are formed in a desired shape between the first and second auxiliary electrodes 2 and 3 through electron beam irradiation (FIGS. 26B and 26C).

The carbon films 21*a* and 21*b* can be formed with the substrate 1 disposed within the above-described measurement/evaluation apparatus illustrated in FIG. 3. The electron emitting means 41 and the electron beam blocking/deflecting means 42 illustrated in FIG. 26B are provided in the apparatus. By irradiating desired locations with the electron beam from the electron emitting means 41 with the carbon-containing gas introduced into the apparatus, the carbon films 21*a* and 21*b* in the desired shape can be deposited.

As the carbon-containing gas, a gas similar to the carbon-containing gas described above (Process 4) may be used. When the carbon films 21*a* and 21*b* are formed, no voltage is applied to the auxiliary electrodes 2 and 3, and the auxiliary electrodes 2 and 3 are set at the ground voltage. By irradiating the surface of the first and second auxiliary electrodes 2 and 3 and the surface of the substrate between the auxiliary electrodes 2 and 3 with an electron beam narrowed and deflected by the electron beam blocking/deflecting means 42, the carbon films 21*a* and 21*b* in the shape illustrated in FIGS. 1A to 1C or FIGS. 2A to 2D can be deposited (FIGS. 26B and 26C).

The reason that the carbon films 21*a* and 21*b* are deposited is thought to be that the carbon-containing gas existing in the atmosphere or a carbon compound attached to the electrodes 2 and 3 and the substrate 1 due to adsorption of the carbon-containing gas on the electrodes 2 and 3 and the substrate 1 are decomposed by irradiating the electron beam, which results in deposition of carbon.

The acceleration voltage of the electron beam is preferably set to be about 1 kV to 20 kV. The electron beam irradiation is preferably continuous (DC-like). The current of the electron beam is preferably in the range of 0.1 μA to 100 μA.

In this way, the electron-emitting device according to the present invention can be manufactured.

It is to be noted that the method of manufacturing the electron-emitting device according to the present invention described with reference to FIGS. 1A to 1D and FIGS. 2A to 2D, or the like should not be limited to the above processing and electron beam irradiation. By, for example, appropriately controlling (I) the kind of the carbon-containing gas, (II) the partial pressure of the carbon-containing gas, (III) the waveform of applied voltage, (IV) the relationship between the timing of exhausting of the carbon-containing gas and the timing of stopping the voltage application, (V) the temperature during "activation", and the like, the electron-emitting device having the structure described with reference to FIGS. 1A to 1D and FIGS. 2A to 2D or the like may be formed with only the "activation" process without using the methods described here. Therefore, such a method of forming the electroconductive films 21*a* and 21*b* illustrated in FIGS. 1A to 1D and FIGS. 2A to 2D using the "activation" process is not precluded by the present invention.

Excess carbon and organic substances attached to or deposited on the surface of the substrate 1 and other locations of the electron-emitting device according to the present invention manufactured as described above due to the above-described "activation" process and the like are preferably removed before the device is practically driven (when applied to an image display apparatus, before a phosphor is irradiated with an electron beam) by, preferably, carrying out "stabilization" process, which is heating process in a vacuum.

More specifically, in a vacuum container, excess carbon and organic substances are discharged. It is desirable that the organic substances in the vacuum container are discharged as much as possible, and it is preferable that the organic substances are eliminated such that the partial pressure thereof is $1\times10^{-8}$ Pa or lower. Further, the total pressure in the vacuum container of gases including gases other than the organic substances is preferably $3\times10^{-6}$ Pa or lower, and particularly preferably $1\times10^{-7}$ Pa or lower. Further, when discharge is carried out from within the vacuum container, it is preferable that the whole vacuum container is heated.

When the electron-emitting device is driven after the "stabilization" process, it is preferable that the atmosphere when the "stabilization" process is completed is maintained, but the present invention is not limited thereto. So far as the organic substances are sufficiently removed, even if the pressure itself becomes higher, sufficiently stable characteristics can be maintained.

Next, basic properties of the electron-emitting device according to the present invention are described with reference to FIGS. 3 and 12.

Figure 12:
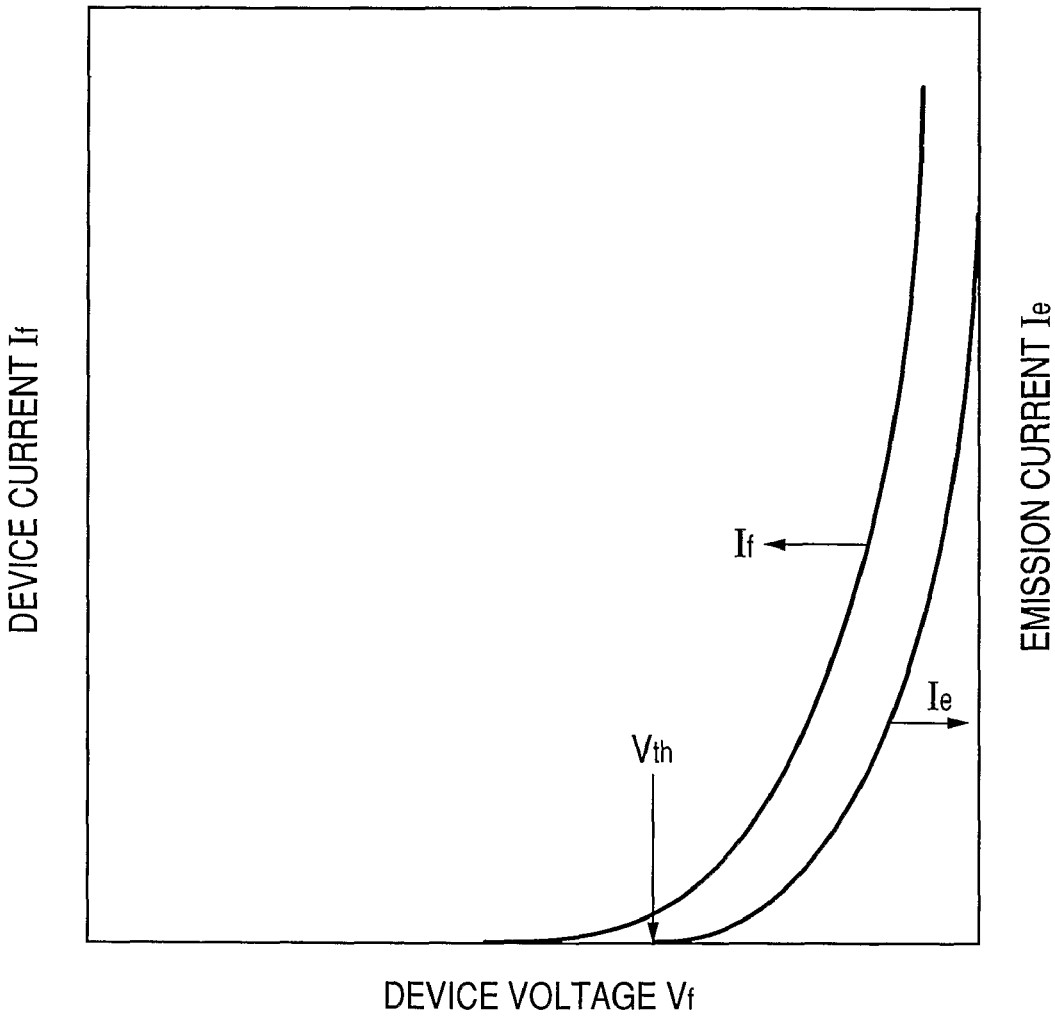
FIG. 12 is a schematic graph illustrating electron emitting characteristics of the electron-emitting device according to the present invention.

FIG. 12 illustrates a typical example of the relationship between the emission current Ie and the device voltage Vf, and the device current If and the device voltage Vf of the electron-emitting device after the above-described "stabilization" process, the values of Ie, Vf, and If are measured by using the measurement/evaluation apparatus shown in FIG. 3.

Since the emission current Ie is considerably smaller than the device current If, the respective measures of current are selected accordingly in FIG. 12. As is clear from FIG. 12, the electron-emitting device according to the present invention has three properties with regard to the emission current Ie.

First, the emission current Ie of the electron-emitting device according to the present invention suddenly begins to increase when the applied device voltage reaches a certain level (Vth in FIG. 12 and referred to as the threshold voltage). On the other hand, the emission current Ie is almost undetectable when the device voltage is equal to or lower than the threshold voltage Vth. In other words, the electron-emitting device according to the present invention is a nonlinear device having the clear threshold voltage Vth with respect to the emission current Ie.

Second, since the emission current Ie depends on the device voltage Vf, the emission current Ie can be controlled by the device voltage Vf.

Third, the emitted electric charge captured by the anode electrode 44 depends on the time period during which the device voltage Vf is applied. In other words, the amount of electric charge captured by the anode electrode 44 can be controlled by the time period during which the device voltage Vf is applied.

By utilizing the above properties of the electron-emitting device, the electron emitting characteristics can be easily controlled according to an input signal.

Although a case where the electron-emitting device is disposed on a plate-like substrate 1 is described here, the electron-emitting device according to the present invention may be disposed on an upper surface or a side surface of an insulating member in a predetermined shape (i.e., in a cubic shape or polyhedron) prepared on the substrate. In particular, by disposing a side surface of the insulating member so as to form an angle with respect to the plane of the anode electrode 44 and disposing the electron-emitting device according to the present invention on the side surface (by setting the opposed direction between the electroconductive films 21*a* and 21*b* to a direction heading to the anode), the electron emitting efficiency can be improved. For example, when the electron-emitting device having the structure illustrated in FIGS. 1A to 1D and FIGS. 2A to 2D are used, it is preferable that the electron-emitting device is disposed such that a line through the auxiliary electrodes 2 and 3 intersects the anode electrode 44, where the carbon film 21*b* is disposed nearer to the anode electrode 44 than the carbon film 21*a*. By making the potential of the auxiliary electrode 3 higher than that of the auxiliary electrode 2, particularly satisfactory electron emitting efficiency can be materialized.

Next, a method of observing the neighborhood of the gap 8 of the electron-emitting device according to the present invention illustrated in FIGS. 1B, 2B, 11C, or the like is described with reference to FIGS. 22A and 22B.

A plan SEM, a section SEM, a section TEM, 3D-TEM (tomography), or the like can be used for the observation. When a microstructure such as that of the electron-emitting device according to the present invention is observed, it is preferable to use 3D-TEM (tomography).

Figure 22A:
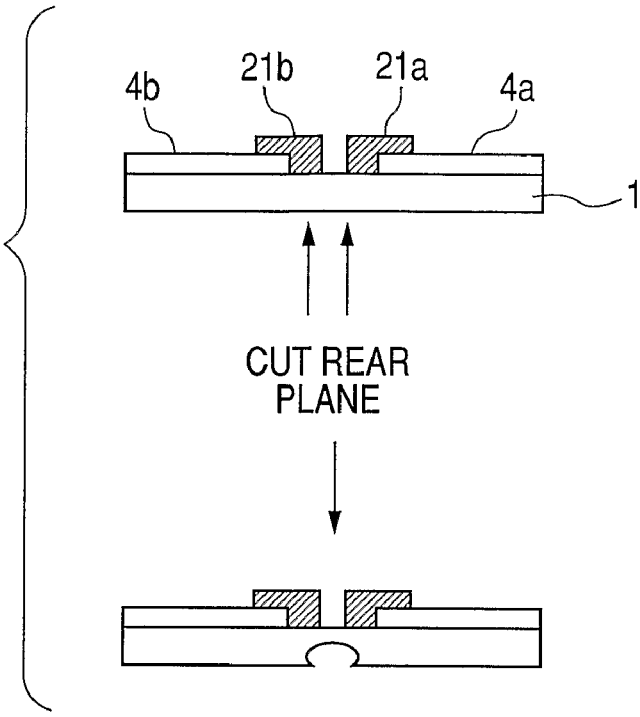
FIGS. 22A and 22B are schematic views for explaining an exemplary method of observing the electron-emitting device according to the present invention.
Figure 22B:
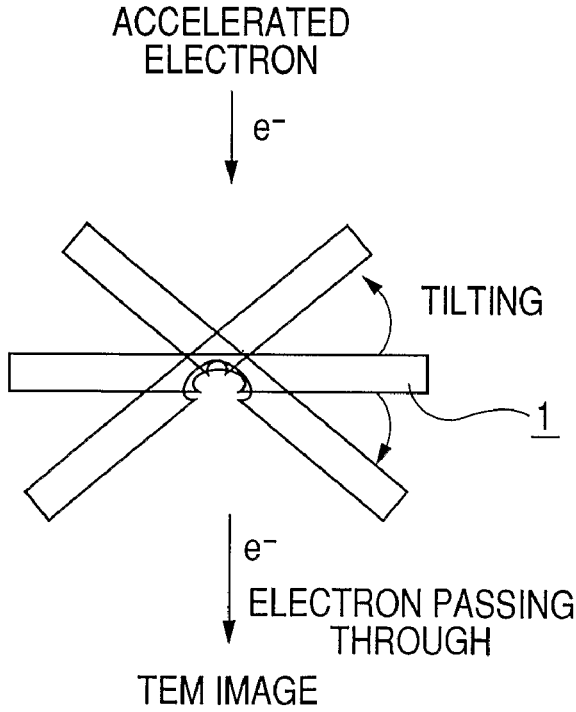

In order to obtain a 3D-TEM image, first, the substrate 1 is cut (etched) from a side opposite to the surface where the electron-emitting device is disposed (from a rear side) (FIG. 22A). More specifically, the substrate 1 is cut such that the thickness of the substrate 1 immediately below the electron-emitting device (in proximity to the gap 8) is 100 nm or less. Next, a transmission electron microscope (TEM) is used to observe a TEM image in proximity to the gap 8 with the transmission angle being varied (FIG. 22B). Here, when necessary, it is preferable to cover the neighborhood of the gap 8 with a protective film (the protective film can be formed by, for example, vapor deposition of gold on the whole electron-emitting device). After that, by integrating into a three-dimensional image a plurality of TEM images taken, a 3D-TEM (tomography) image can be obtained. Using such 3D-TEM, the structure of the gap 8 which is 10 nm or less can be observed three-dimensionally in detail.

Next, an exemplary application of the electron-emitting device according to the present invention is described in the following.

A plurality of the electron-emitting devices according to the present invention can be arranged on a substrate to form, for example, an electron source or an image display apparatus such as a flat panel television set.

Exemplary arrangements of the electron-emitting devices on the substrate includes an arrangement where m X-directional wirings and n Y-directional wirings are prepared and the first electroconductive film 21*a* (typically the first auxiliary electrode 2) of the electron-emitting device according to the present invention is electrically connected to one of the m X-directional wirings, while the second electroconductive film 21*b* (typically the second auxiliary electrode 3) is electrically connected to one of the n Y-directional wirings (referred to as a "matrix arrangement") (m and n are positive integers).

Next, this matrix arrangement is described in detail.

According to the above-described three basic properties of the electron-emitting device according to the present invention, when the voltage is the threshold voltage or higher, the electron-emitting device can be controlled by the pulse height value and the width of the pulse-like voltage applied between the first and second electroconductive films 21*a* and 21*b*. On the other hand, when the voltage is lower than the threshold voltage, substantially no electrons are emitted. According to this property, even when a lot of electron-emitting devices are arranged, by appropriately applying the above-described pulse-like voltage to the respective electron-emitting devices, the amount of electrons emitted from a selected electron-emitting device can be controlled based on an input signal.

Figure 13:
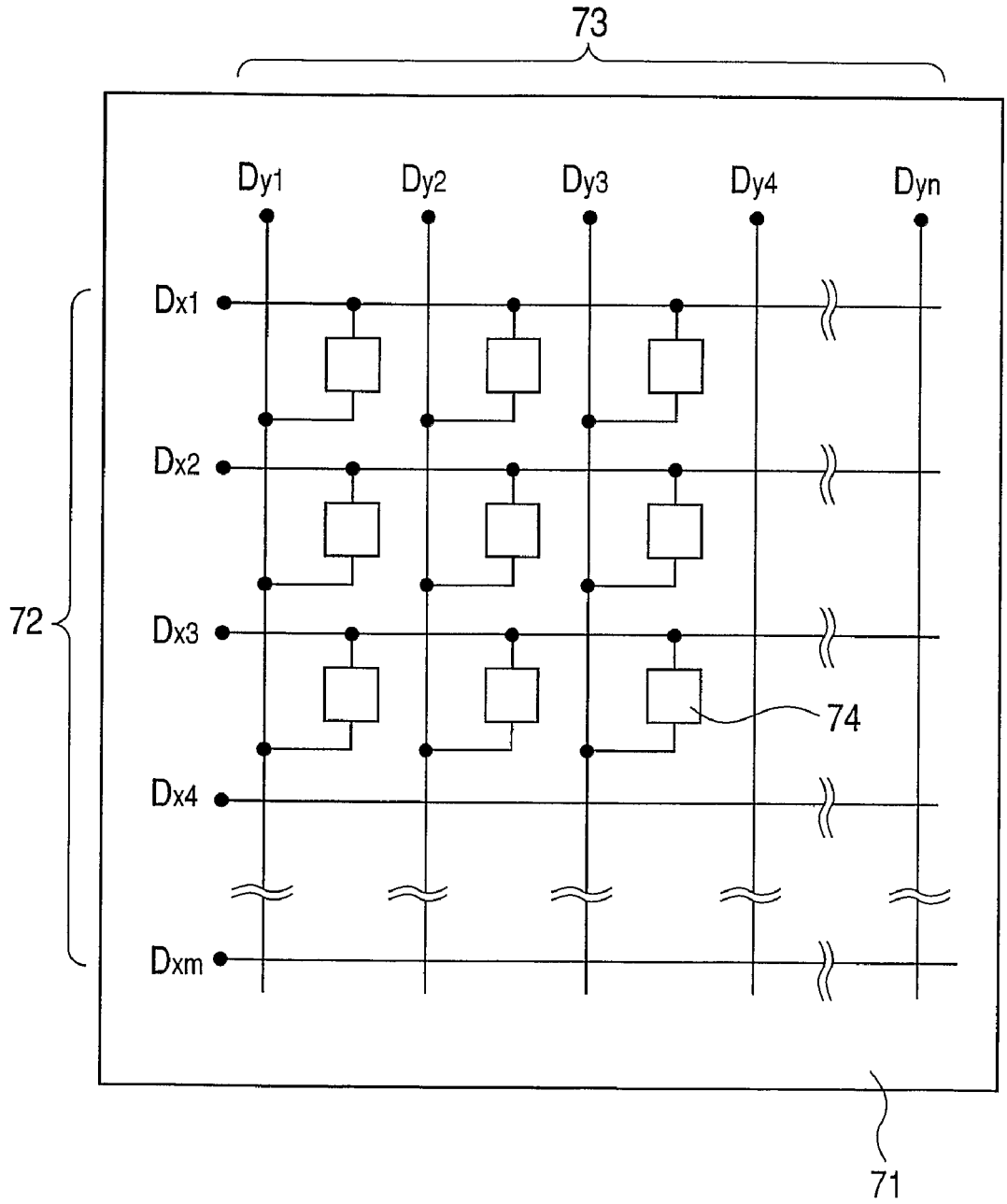
FIG. 13 is a schematic view for explaining an electron source substrate using the electron-emitting devices according to the present invention.

Next, a structure of an electron source substrate of matrix arrangement formed based on the above is described with reference to FIG. 13.

M X-directional wirings 72 Dx1, Dx2, . . . , Dxm are formed on an insulating substrate 71 using vacuum evaporation, printing, sputtering, or the like. The X-directional wirings 72 are made of a conductive material such as a metal. N Y-directional wirings 73 Dy1, Dy2, . . . , Dyn may be formed by a similar method and may be made of a similar material to those of the X-directional wirings 72. An insulating layer (not shown) is disposed between the m X-directional wirings 72 and n Y-directional wirings 73. The insulating layer may be formed using vacuum evaporation, printing, sputtering, or the like.

A scan signal applying means (not shown) for applying a scan signal is electrically connected to the X-directional wirings 72. A modulation signal applying means (not shown) for applying a modulation signal for modulating an electron emitted from a selected electron-emitting device in synchronization with a scan signal is electrically connected to the Y-directional wirings 73. Drive voltage Vf applied to the electron-emitting devices is supplied as difference voltage between the applied scan signal and the modulation signal.

Figure 14:
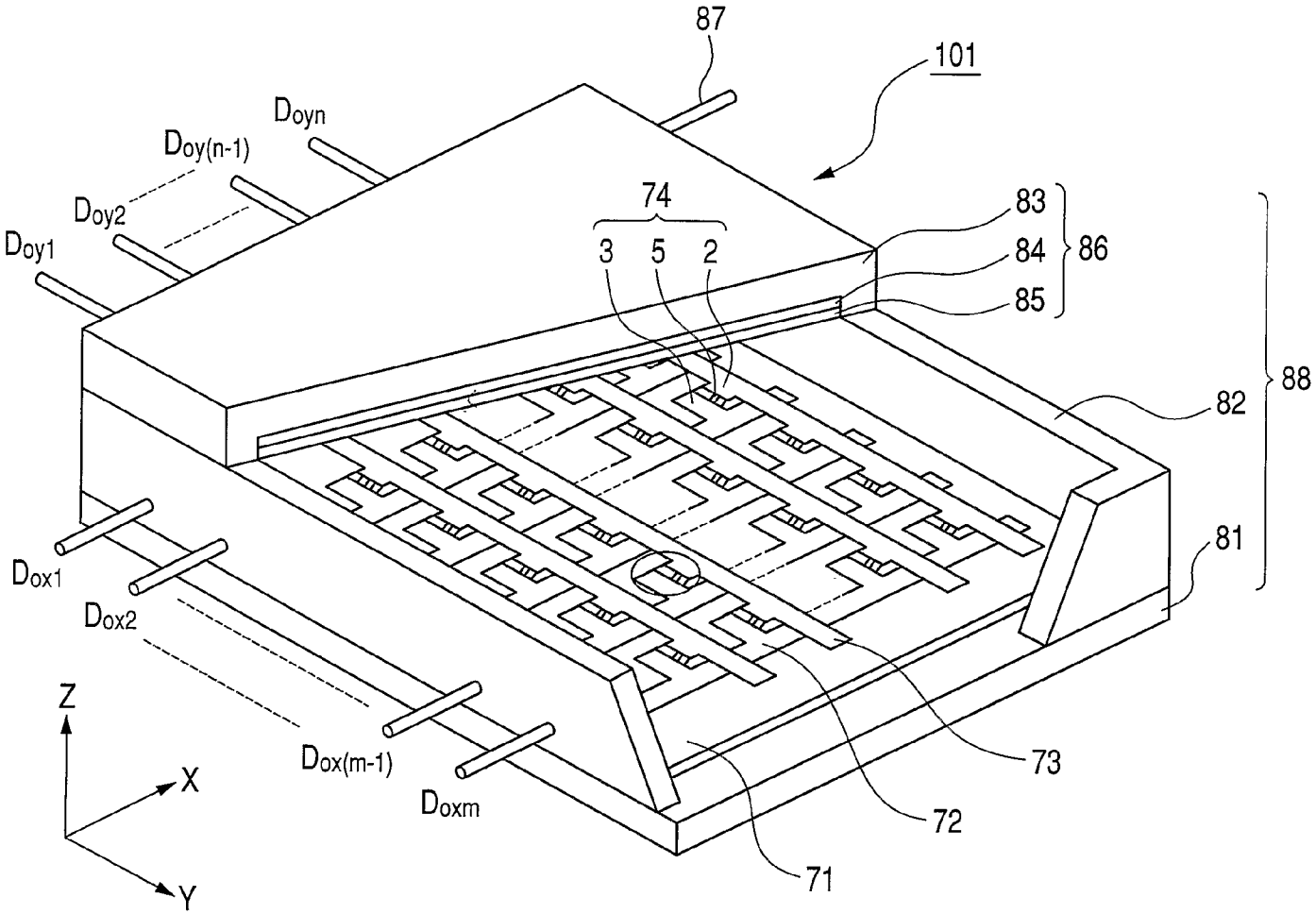
FIG. 14 is a schematic view for illustrating an exemplary structure of an image display apparatus using the electron-emitting devices according to the present invention.
Figure 15A:
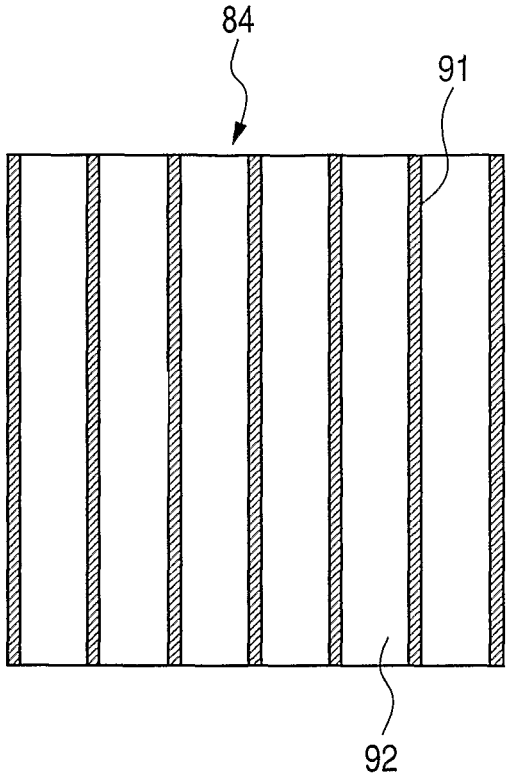
FIGS. 15A and 15B are schematic views for explaining a phosphor film.
Figure 15B:
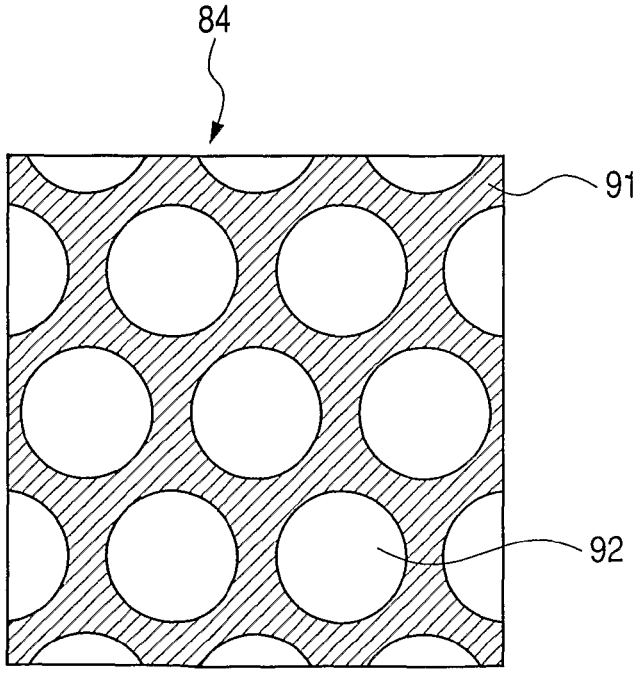

Next, an exemplary electron source and an exemplary image display apparatus using the electron source substrate of matrix arrangement are described with reference to FIGS. 14, 15A and 15B. FIG. 14 is a schematic view showing a basic configuration of an container (display panel) 88 forming the image display apparatus, and FIGS. 15A and 15B are schematic views illustrating the structure of a phosphor film.

In FIG. 14, reference numeral 71 denotes an electron source substrate having a plurality of electron-emitting devices 74 according to the present invention disposed thereon, reference numeral 81 denotes a rear plate having the electron source substrate 71 fixed thereon, and reference numeral 86 denotes a face plate where a phosphor film 84, an electroconductive film 85, and the like are formed on the inner surface of a transparent substrate 83 such as glass. Reference numeral 82 denotes a support frame. The rear plate 81, the support frame 82, and the face plate 86 are seal-bonded to each other by applying and heating adhesive such as frit glass or indium. This seal-bonded structure forms the container 88. It is to be noted that the electroconductive film 85 is a member corresponding to the anode electrode 44 described with reference to FIG. 3.

The container (display panel) 88 can be formed by the face plate 86, the support frame 82, and the rear plate 81. However, the main object of providing the rear plate 81 is to reinforce the substrate 71. Therefore, when the substrate 71 itself is strong enough, the rear plate 81 is not necessary. In that case, the support frame 82 may be directly seal-bonded to the substrate 71 such that the face plate 86, the support frame 82, and the substrate 71 form the container (display panel) 88.

Further, by providing a support member called a spacer (not shown) between the face plate 86 and the substrate 71, the container 88 can be sufficiently strong against atmospheric pressure.

FIGS. 15A and 15B are exemplary specific structures of the phosphor film 84 illustrated in FIG. 14. The phosphor film 84 is, in a monochrome case, formed only of a monochrome phosphor 92. However, when a color image display apparatus is structured, the phosphor film 84 includes phosphors 92 in the three primary colors (RGB) and a light absorbing member 91 disposed between the respective colors. The light absorbing member 91 is preferably a black member. FIG. 15A illustrates a configuration where the light absorbing member 91 is arranged so as to form stripes. FIG. 15B illustrates a configuration where the light absorbing member 91 is arranged so as to form a matrix. Generally, the configuration illustrated in FIG. 15A is referred to as "black stripes" while the configuration illustrated in FIG. 15B is referred to as a "black matrix". The light absorbing member 91 is provided in order to make less noticeable color mixing at portions where the color changes between the respective phosphors 92 of the three primary colors, which is necessary in color display, and in order to suppress decrease in the contrast due to reflection of outside light on the phosphor film 84. The material for the light absorbing member 91 is not limited to a popular material the main component of which is graphite, and may be any material which does not allow excessive transmission and reflection of light. Further, the material may be either conductive or insulative.

An electroconductive film 85 referred to as a "metal back" is provided on the inner surface side (on the side of the electron-emitting device 74) of the phosphor film 84. The electroconductive film 85 is provided in order to specularly reflect light toward the side of the electron-emitting device 74 out of light emitted from the phosphor 92 to the side of the face plate 86 to improve the brightness, in order to utilize the electroconductive film 85 as an electrode for applying voltage for accelerating the electron beam, in order to suppress damage of the phosphor due to collision of negative ions generated in the envelope 88, and the like.

The electroconductive film 85 is preferably an aluminum film. The electroconductive film 85 may be formed by, after the phosphor film 84 is formed, smoothing the surface of the phosphor film 84 (normally referred to as "filming"), and after that, depositing Al using vacuum evacuation or the like.

The face plate 86 may be provided with a transparent electrode (not shown) made of ITO or the like between the phosphor film 84 and the transparent substrate 83 in order to enhance the conductivity of the phosphor film 84.

By applying voltage to the respective electron-emitting devices 74 in the envelope 88 via terminals Dox1 to Doxm and Doy1 to Doyn connected to the X-directional wirings and Y-directional wirings which are described with reference to FIG. 13 and which are in turn connected to the respective electron-emitting devices, a desired electron-emitting device can be made to emit an electron. Here, voltage of 5 kV or higher and 30 kV or lower, preferably voltage of 10 kV or higher and 25 kV or lower, is applied to the electroconductive film 85 through a high voltage terminal 87. The distance between the face plate 86 and the substrate 71 is set to be 1 mm or more and 5 mm or less, more preferably 1 mm or and 3 mm or less. This allows electrons emitted from the selected electron-emitting device to go through the electroconductive film 85 to collide with the phosphor film 84. By exciting the phosphors 92 and make them emit light, an image is displayed.

The details of the above-described structure such as the materials of the members are not limited to the above, and are appropriately changed according to the object.

The container (display panel) 88 according to the present invention described with reference to FIG. 14 can be used to form an information displaying and reproducing apparatus.

More specifically, the information displaying and reproducing apparatus includes a receiver for receiving a broadcast signal for television broadcast or the like, a tuner for selecting a received signal, and an image display apparatus for outputting at least one of image information, character information, and audio information contained in the selected signal to the display panel 88 to display and/or reproduce the information on a screen. It can be said that the "screen" here corresponds to the phosphor film 84 of the display panel 88 illustrated in FIG. 14. In this way, an information displaying and reproducing apparatus such as a television set can be formed. Of course, when the broadcast signal is encoded, the information displaying and reproducing apparatus according to the present invention may include a decoder. With regard to an audio signal, the signal is outputted to audio reproducing means such as a speaker additionally provided, and is reproduced in synchronization with image information or character information displayed on the display panel 88.

Outputting image information or character information to the display panel 88 to display and/or reproduce the information on the screen can be carried out in the following way. For example, first, image signals corresponding to the respective pixels of the display panel 88 are generated from the received image information or character information. Then, the generated image signals are inputted to a drive circuit of the display panel 88. Next, based on the image signals inputted to the drive circuit, voltage applied from the drive circuit to the respective electron-emitting devices in the display panel 88 is controlled to display the image.

Figure 32:
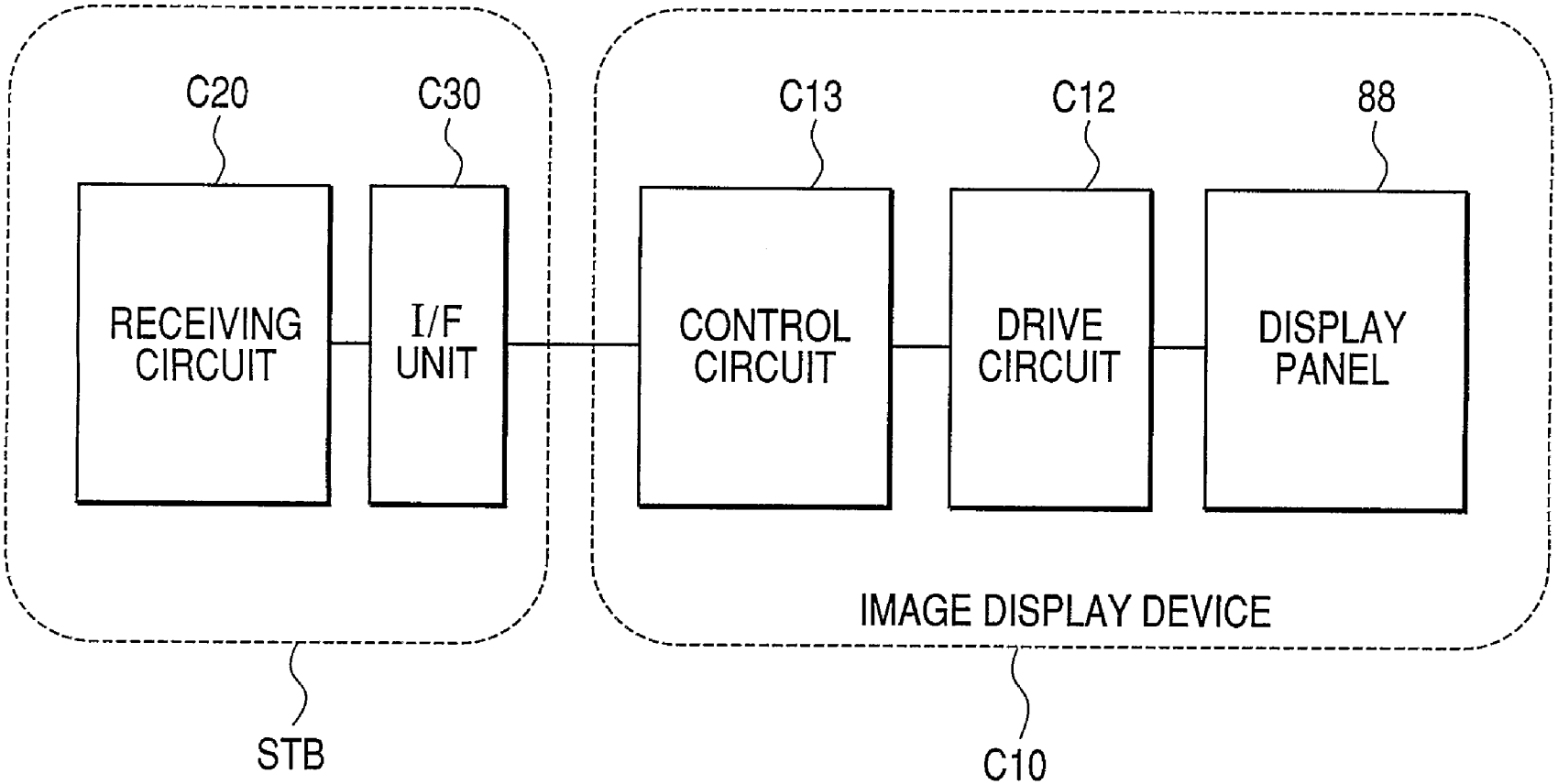
FIG. 32 is a block diagram of a television set according to the present invention.

FIG. 32 is a block diagram of a television set according to the present invention. A receiving circuit C20 includes a tuner, a decoder, and the like, and receives television signals for satellite broadcasting, terrestrial broadcasting, and the like, data broadcasting through a network, and the like, and outputs decoded image data to an I/F unit C30 (interface unit). The I/F unit C30 converts the image data into the display format of a image display apparatus C10 and outputs the image data to the display panel 88. The image display apparatus C10 includes the display panel 88, a drive circuit C12, and a control circuit C13. The control circuit C13 carries out image processing such as correction suitable for the display panel 88 with regard to the inputted image data, and outputs image data and various kinds of control signals to the drive circuit C12. The drive circuit C12 outputs a drive signal to the respective wirings of the display panel 88 (see Dox1 to Doxm and Doy1 to Doyn in FIG. 14) based on the inputted image data, and a television image is displayed. The receiving circuit C20 and the I/F unit C30 may be housed in a case separately from the image display apparatus C10 as a set-top box (STB), or may be housed in the same case where the image display apparatus C10 is housed.

The I/F unit C30 may be configured to be connected to an image recording device or an image output device such as a printer, a digital video camera, a digital camera, a hard disk drive (HDD), or a digital video disk (DVD). This can configure an information displaying and reproducing apparatus (or a television set) with which an image recorded in the image recording device can be displayed on the display panel 88, and an image displayed on the display panel 88 can be processed as needed and can be outputted to the image output device.

The structure of the information displaying and reproducing apparatus is only an example and various variations are possible based on the technical idea of the present invention. Further, the information displaying and reproducing apparatus according to the present invention can form various kinds of information displaying and reproducing apparatus by connecting it to a videoconference system, a computer system, or the like.

EXAMPLES

The present invention is now described in further detail with reference to examples.

Example 1

The basic structure of an electron-emitting device according to this example is similar to that illustrated in FIGS. 1A to 1C. The basic structure of and a method of manufacturing the device according to this example are described in the following with reference to FIGS. 1A to 1C, 3, and 4A to 4D.

(Process-a)

First, photoresist shaped correspondingly to the pattern of the auxiliary electrodes 2 and 3 was formed on the cleaned quartz substrate 1. Then, Ti at the thickness of 5 nm and Pt at the thickness of 45 nm were deposited in this order by electron beam vapor deposition. The photoresist pattern was dissolved away by organic solvent, the Pt/Ti deposition film was lifted off, and the first and second auxiliary electrodes 2 and 3 in opposition to each other with a length L of 20 μm therebetween were formed. The width W of the auxiliary electrodes 2 and 3 (see FIGS. 1A to 1C) was 500 μm (FIG. 4A).

(Process-b)

After an organic palladium compound solution was spin coated by a spinner so as to connect the first and second auxiliary electrodes 2 and 3, bake processing were carried out. In this way, an electroconductive thin film the main component of which was Pd was formed.

(Process-c)

Next, the electroconductive thin film was patterned to form the electroconductive thin film 4 (FIG. 4B) having the width W' (see FIGS. 1A to 1C) of 100 μm.

The device electrodes 2 and 3 and the electroconductive thin film 4 were formed through the above-described processes.

(Process-d)

Next, the substrate 1 was disposed in the measurement/evaluation apparatus illustrated in FIG. 3, the measurement/evaluation apparatus was evacuated by a vacuum pump, and after the vacuum reached $1\times10^{-6}$ Pa, voltage was applied between the auxiliary electrodes 2 and 3 using a power source 41, "forming" process was carried out, the second gap 7 was formed in the electroconductive thin film 4, and the electrodes 4*a* and 4*b* were formed (FIG. 4C). The voltage used in the "forming" process had the waveform illustrated in FIG. 7B.

In FIG. 7B, T1 and T2 denote a pulse width and a pulse interval, respectively, of the voltage waveform. In this example, T1 was 1 msec, T2 was 16.7 msec, and the pulse height value of the triangular wave was raised by 0.1 V to carry out the "forming" process. During the "forming" process, a resistance measurement pulse of 0.1V was intermittently applied between the auxiliary electrodes 2 and 3 to measure the resistance. The "forming" process ended when the measurement using the resistance measurement pulse was about 1 mΩ or more.

(Process-e)

Next, in order to carry out the "activation" process, acrylonitrile was introduced into the vacuum chamber through a slow leak valve and $1.3\times10^{-4}$ Pa was maintained. Then, the pulse voltage having the waveform illustrated in FIG. 8A was applied between the auxiliary electrodes 2 and 3 under a condition in which T1 is 2 msec and T2 is 7 msec. The "activation" process was curried out with the first auxiliary electrode 2 fixed at the ground potential and pulse voltage having the waveform illustrated in FIG. 8A was applied to the second auxiliary electrode 3.

After 100 minutes lapsed from the beginning of the "activation" process, it was confirmed that the graph entered deep enough the region which was on the right side of the dotted line in FIG. 9, the application of the voltage was stopped, and the slow leak valve was closed to end the "activation" process. As a result, the first and second carbon films 21*a* and 21*b* were formed (FIG. 4D).

In this process, electron-emitting devices A which underwent "activation" process with the highest voltage value being ±14 V, electron-emitting devices B which underwent "activation" process with the highest voltage value being ±16 V, and electron-emitting devices C which underwent "activation" process with the highest voltage value being ±18 V were manufactured. Eight electron-emitting devices A (A1 to A8)

in total were manufactured by the same manufacturing method as described above. Six electron-emitting devices B (B1 to B6) in total were manufactured by the same manufacturing method as described above. Four electron-emitting devices C (C1 to C4) in total were manufactured by the same manufacturing method as described above.

SEM plan images and SEM section images of electron-emitting devices (A', B', and C') manufactured by the same manufacturing method as Process-a to Process-e in the above were observed. It was found that, regardless of the voltage applied in the "activation" process, the thickness of the end of the first carbon film 21*a* (the portion forming the periphery of the gap 8) and the thickness of the end of the second carbon films 21*b* (the portion forming the periphery of the gap 8) are almost the same, and the gap 8 was serpentine. Further, in all the electron-emitting devices, there were a lot of portions (portions A and B) where the gap between the first and second electroconductive films 21*a* and 21*b* is smaller than that in other portions.

3D-TEM image in the neighborhood of the gap 8 of the electron-emitting devices (A', B', and C') manufactured by the same manufacturing method as that of the respective electron-emitting devices A, B, and C was observed. The distance d1 between a portion A of the first carbon film 21*a* and a portion B of the second carbon film 21*b* was 2.3 nm on average with regard to the electron-emitting devices A', 2.8 nm on average with regard to the electron-emitting devices B', and 3.3 nm on average with regard to the electron-emitting devices C'.

The minimum distance d2 between a portion of the first electroconductive film 21*a* which is away from a portion A along the periphery of the gap 8 by the same distance as d1 and a portion of the second electroconductive film 21*b* in opposition to that portion which was measured using 3D-TEM images was 2.5 nm on average with regard to the electron-emitting devices A' (d2/d1 was 1.1 or less with regard to all the electron-emitting devices A'), 3.0 nm on average with regard to the electron-emitting devices B' (d2/d1 was 1.1 or less with regard to all the electron-emitting devices B'), and 3.5 nm on average with regard to the electron-emitting devices C' (d2/d1 was 1.1 or less with regard to all the electron-emitting devices C').

(Process-f)

Then, the electron-emitting devices according to this example (A, B, and C) after Process-e were taken out from the measurement/evaluation apparatus illustrated in FIG. 3 to the atmosphere, and, as described with reference to the configuration, the first carbon film 21*a* was processed using an AFM (see FIGS. 10A and 10B).

In this example, first by cutting the end of the first carbon film 21*a* using an AFM, the distance d1 between a portion A and a portion B was set to be 2.5 nm with regard to all the electron-emitting devices A (A1 to A8), 3.0 nm with regard to all the electron-emitting devices B (B1 to B6), and 3.5 nm with regard to all the electron-emitting devices C (C1 to C4).

Further, each of the end of the first carbon film 21*a* was processed using an AFM such that d2 of the electron-emitting device A1 was 2.8 nm, d2 of the electron-emitting device A2 was 3.0 nm, d2 of the electron-emitting device A3 was 3.3 nm, d2 of the electron-emitting device A4 was 3.6 nm, d2 of the electron-emitting device A5 was 4.0 nm, d2 of the electron-emitting device A6 was 4.2 nm, d2 of the electron-emitting device A7 was 5.0 nm, and d2 of the electron-emitting device A8 was 10 nm. It is to be noted that d2/d1 was 1.1 with regard to the electron-emitting device A1 and was 1.2 or more with regard to the electron-emitting devices A2 to A8.

Further, each of the end of the first carbon film 21*a* was processed using an AFM such that d2 of the electron-emitting device B1 was 3.3 nm, d2 of the electron-emitting device B2 was 3.6 nm, d2 of the electron-emitting device B3 was 4.0 nm, d2 of the electron-emitting device B4 was 4.2 nm, d2 of the electron-emitting device B5 was 5.0 nm, d2 of the electron-emitting device B6 was 10 nm. It is to be noted that d2/d1 was 1.1 with regard to the electron-emitting device B1 and was 1.2 or more with regard to the electron-emitting devices B2 to B6.

Further, each of the end of the first carbon film 21*a* was processed using an AFM such that d2 of the electron-emitting device C1 was 4.0 nm, d2 of the electron-emitting device C2 was 4.2 nm, d2 of the electron-emitting device C3 was 5.0 nm, d2 of the electron-emitting device C4 was 10 nm. It is to be noted that d2/d1 was 1.1 with regard to the electron-emitting device C1 and was 1.2 or more with regard to the electron-emitting devices C2 to C4.

Further, in the same method as the above Process-a to Process-e, three kinds of electron-emitting devices were manufactured as Comparative Example 1. Each of the electron-emitting devices of Comparative Example 1 had different voltages to be applied in the activation process. In the activation process, the highest voltage value was ±14 V with regard to the first device, ±16 V with regard to the second device, and ±18 V with regard to the third device. The above Process-f was not carried out with regard to the electron-emitting devices of Comparative Example 1.

(Process-g)

Next, the electron-emitting devices manufactured according to this example after Process-f and the electron-emitting devices of Comparative Example 1 were disposed in the measurement/evaluation apparatus illustrated in FIG. 3. After the measurement/evaluation apparatus was evacuated, the "stabilization" process was carried out.

More specifically, with the vacuum chamber and the electron-emitting devices maintained at about 250° C. by heating them by a heater, the vacuum chamber was evacuated. After 20 hours elapsed, the heating by the heater was stopped to allow them to reach room temperature. The pressure in the vacuum chamber reached about $1\times10^{-8}$ Pa. Next, electron emitting characteristics were measured.

In measuring the electron emitting characteristics, the distance H between the anode electrode 44 and the electron-emitting device was 2 mm, and a high voltage power source 43 gave a potential of 1 kV to the anode electrode 44. With this state maintained, the power source 41 was used to apply drive voltage between the auxiliary electrodes 2 and 3 of the respective electron-emitting devices so that the potential of the first auxiliary electrode 2 was lower than that of the second auxiliary electrode 3. Square pulse voltage having the pulse height value of 12 V was applied to the electron-emitting devices A1 to A8 and the first device of Comparative Example 1, square pulse voltage having the pulse height value of 14 V was applied to the electron-emitting devices B1 to B6 and the second device of Comparative Example 1, and square pulse voltage having the pulse height value of 16 V was applied to the electron-emitting devices C1 to C4 and the third device of Comparative Example 1.

In the measurement, the device current If and the emission current Ie of the electron-emitting devices of this example and that of Comparative Example 1 were measured by ammeters 40 and 42, respectively, and electron emitting efficiency (Ie/If) was calculated.

Table 1 shows the calculated electron emitting efficiency and Table 2 shows the emission current Ie. The device current If was about 1.0 mA with regard to all the electron-emitting devices.

TABLE 1

| | Comparative example 1 | d2 [nm] 2.8 | 3 | 3.3 | 3.6 | 4 | 4.2 | 5 | 10 |
|---|---|---|---|---|---|---|---|---|---|
| Drive voltage 12 V (d1 = 2.5 nm) | 0.05% | 0.06% (A1) | 0.09% (A2) | 0.10% (A3) | 0.11% (A4) | 0.12% (A5) | 0.13% (A6) | 0.14% (A7) | 0.14% (A8) |
| drive voltage 14 V (d1 = 3.0 nm) | 0.08% | | | 0.09% (B1) | 0.14% (B2) | 0.14% (B3) | 0.15% (B4) | 0.16% (B5) | 0.16% (B6) |
| drive voltage 16 V (d1 = 3.5 nm) | 0.12% | | | | | 0.13% (C1) | 0.16% (C2) | 0.18% (C3) | 0.19% (C4) |

TABLE 2

| | Comparative example 1 | d2 [nm] 2.8 | 3 | 3.3 | 3.6 | 4 | 4.2 | 5 | 10 |
|---|---|---|---|---|---|---|---|---|---|
| Drive voltage 12 V (d1 = 2.5 nm) | 0.5 μA | 0.6 μA (A1) | 0.9 μA (A2) | 0.9 μA (A3) | 1.1 μA (A4) | 1.1 μA (A5) | 1.1 μA (A6) | 1.2 μA (A7) | 1.4 μA (A8) |
| Drive voltage 14 V (d1 = 3.0 nm) | 0.8 μA | | | 0.9 μA (B1) | 1.3 μA (B2) | 1.3 μA (B3) | 1.4 μA (B4) | 1.5 μA (B5) | 1.6 μA (B6) |
| Drive voltage 16 V (d1 = 3.5 nm) | 1.1 μA | | | | | 1.3 μA (C1) | 1.7 μA (C2) | 1.7 μA (C3) | 1.9 μA (C4) |

The result shows that, when d2/d1 is 1.2 or more, the electron-emitting devices of this example has larger emission current Ie and higher electron emitting efficiency than those of the electron-emitting devices of Comparative Example 1. Further, after the evaluation of the characteristics, the same pulse voltage as that applied in the evaluation of the characteristics was applied to the electron-emitting devices of this example and the devices were driven for a long time. The characteristics shown in Tables 1 and 2 were maintained for a long time without much fluctuation over time.

After the evaluation of the characteristics described above, the neighborhood of the gap 8 of the electron-emitting devices (A, B, and C) manufactured in this example was observed using the above-described 3D-TEM. The distance d1 between a portion A of the first carbon film 21*a* and a portion B of the second carbon film 21*b* was confirmed to be 2.5 nm with regard to the electron-emitting devices A, 3.0 nm with regard to the electron-emitting devices B, and 3.5 nm with regard to the electron-emitting devices C. Similarly, the distance d2 was confirmed to be 2.8 nm with regard to the electron-emitting device A1, 3.0 nm with regard to the electron-emitting device A2, 3.3 nm with regard to the electron-emitting device A3, 3.5 nm with regard to the electron-emitting device A4, 4.0 nm with regard to the electron-emitting device A5, 4.2 nm with regard to the electron-emitting device A6, 5.0 nm with regard to the electron-emitting device A7, 10 nm with regard to the electron-emitting device A8, 3.3 nm with regard to the electron-emitting device B1, 3.5 nm with regard to the electron-emitting device B2, 4.0 nm with regard to the electron-emitting device B3, 4.2 nm with regard to the electron-emitting device B4, 5.0 nm with regard to the electron-emitting device B5, 10 nm with regard to the electron-emitting device B6, 4.0 nm with regard to the electron-emitting device C1, 4.2 nm with regard to the electron-emitting device C2, 5.0 nm with regard to the electron-emitting device C3, and 10 nm with regard to the electron-emitting device C4.

With regard to all the electron-emitting devices, it was confirmed that the transformed portion of the substrate (concave) 22 was formed in the surface of the substrate 1 between the first and second carbon films 21*a* and 21*b*.

Figure 24:
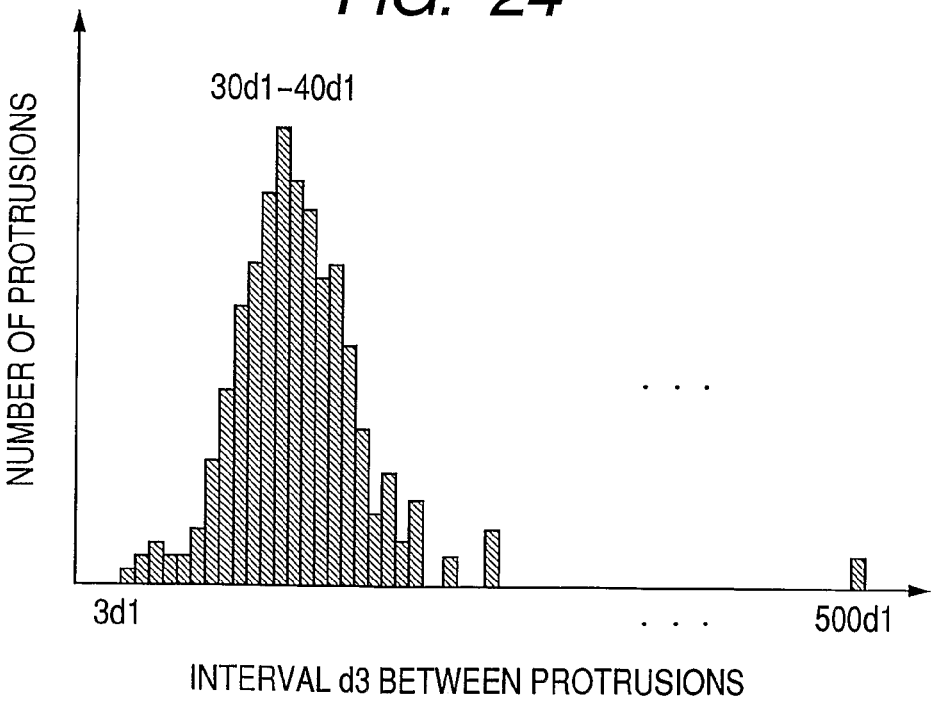
FIG. 24 is a schematic graph for explaining distribution of interval between protrusions in the electron-emitting device according to the present invention.

The distance d3 between the respective protrusions was measured using SEM plan views, and the distribution was studied. FIG. 24 illustrates a schematic graph of the distribution.

With regard to all the electron-emitting devices, the distribution of the distance d3 was from 3 d1 to 500 d1 with the peak being 30 to 40 d1. Although the distribution of the distance d3 was as described above with regard to the electron-emitting devices A to C of this example, the present invention is not limited thereto, and the distance d3 may have a broader distribution. However, in order to obtain the emission current Ie in a practical range, it is preferable that the distribution is within 2000 d1.

Further, in order to obtain larger emission current Ie, it is most preferable that d3 is from 3 d1 to 40 d1 and all d3 are the same (the distribution is concentrated).

Example 2

This example is a further preferable example of the present invention.

In this example, electron-emitting devices were manufactured in the same way as that in Example 1 except that Process-e and Process-f of Example 1 were modified as described in the following. Thus, here, Process-e and Process-f will be described.

(Process-e)

Following Process-e, in order to carry out the activation process, acrylonitrile was introduced into the vacuum chamber through a slow leak valve. Then, the pulse voltage having the waveform illustrated in FIG. 8B was applied between the auxiliary electrodes 2 and 3 with T1 being 1 msec, T1' being 0.3 msec, and T2 being 5 msec. The "activation" process was curried out with the first auxiliary electrode 2 fixed at the ground potential and pulse voltage having the waveform illustrated in FIG. 8B was applied to the second auxiliary electrode 3.

After 120 minutes lapsed from the beginning of the activation process, it was made sure that the graph entered deep enough the region which was on the right side of the dotted line in FIG. 9, and the application of the voltage was stopped and the slow leak valve was closed to end the "activation" process. As a result, the first and second carbon films 21*a* and 21*b* were formed (FIG. 4D).

In this process, electron-emitting devices D which underwent "activation" process with the highest voltage value being ±14 V, electron-emitting devices E which underwent "activation" process with the highest voltage value being ±16 V, and electron-emitting devices C which underwent "activation" process with the highest voltage value being ±18 V were manufactured. Eight electron-emitting devices D (D1 to D8) in total were manufactured by the same manufacturing method as described above. Six electron-emitting devices E (E1 to E6) in total were manufactured by the same manufacturing method as described above. Four electron-emitting devices F (F1 to F4) in total were manufactured by the same manufacturing method as described above.

SEM plan views and SEM sectional views of electron-emitting devices manufactured by the same manufacturing method as Process-a to Process-e in the above were observed. It was found that, regardless of the voltage applied in the "activation" process, the thickness of the end of the first carbon film 21*a* and the thickness of the end of the second carbon films 21*b* (the portion forming the periphery of the gap 8) are asymmetric, and the gap 8 was serpentine. Further, in all the electron-emitting devices, there were a plurality of portions (portions A and B) where the gap between the first and second electroconductive films 21*a* and 21*b* is smaller than that in other portions.

3D-TEM image observation in the neighborhood of the gap 8 of the electron-emitting devices (D', E', and F') manufactured by the same manufacturing method as that of the respective electron-emitting devices D, E, and F was made. The distance d1 between a portion A of the first carbon film 21*a* and a portion B of the second carbon film 21*b* was 2.3 nm on average with regard to the electron-emitting devices D', 2.8 nm on average with regard to the electron-emitting devices E', and 3.3 nm on average with regard to the electron-emitting devices F'.

The minimum distance d2 between a portion of the first electroconductive film 21*a* which is away from a portion A along the periphery of the gap 8 by the same distance as d1 and a portion of the second electroconductive film 21*b* in opposition to that portion which was measured using 3D-TEM images was 2.5 nm on average with regard to the electron-emitting devices D' (d2/d1 was 1.1 or less with regard to all the electron-emitting devices D'), 3.0 nm on average with regard to the electron-emitting devices E' (d2/d1 was 1.1 or less with regard to all the electron-emitting devices E'), and 3.5 nm on average with regard to the electron-emitting devices F' (d2/d1 was 1.1 or less with regard to all the electron-emitting devices F').

The neighborhood of the gap 8 of the electron-emitting devices D' was observed using SEM section views. The thickness of the end of the first carbon film 21*a* was 20 nm and the thickness of the end of the second carbon film 21*b* was 75 nm. The thickness of the second carbon film 21*b* which exists on a line extending in a direction in which a portion A of the first carbon film 21*a* is in opposition to a portion B of the second carbon film 21*b* (in a direction of emission of electrons) was 100 nm.

(Process-f)

Then, the electron-emitting devices according to this example (D, E, and F) after Process-e were taken out from the measurement/evaluation apparatus illustrated in FIG. 3 to the atmosphere, and, as described with reference to the embodiment, the first carbon film 21*a* was processed using an AFM (see FIGS. 11A, 11B, and 11C).

By cutting the end of the first carbon film 21*a*, the distance d1 between a portion A of the first carbon film 21*a* and a portion B of the second carbon film 21*b* was set to be 2.5 nm with regard to all the electron-emitting devices D (D1 to D8), 3.0 nm with regard to all the electron-emitting devices E (E1 to E4), and 3.5 nm with regard to all the electron-emitting devices F (F1 to F4).

Further, each of the end of the first carbon film 21*a* was processed using an AFM such that d2 of the electron-emitting device D1 was 2.8 nm, d2 of the electron-emitting device D2 was 3.0 nm, d2 of the electron-emitting device D3 was 3.3 nm, d2 of the electron-emitting device D4 was 3.6 nm, d2 of the electron-emitting device D5 was 4.0 nm, d2 of the electron-emitting device D6 was 4.2 nm, d2 of the electron-emitting device D7 was 5.0 nm, and d2 of the electron-emitting device D8 was 10 nm. It is to be noted that d2/d1 was 1.1 with regard to the electron-emitting device D1 and was 1.2 or more with regard to the electron-emitting devices D2 to D8. Further, each of the end of the first carbon film 21*a* was processed using an AFM such that d2 of the electron-emitting device E1 was 3.3 nm, d2 of the electron-emitting device E2 was 3.6 nm, d2 of the electron-emitting device E3 was 4.0 nm, d2 of the electron-emitting device E4 was 4.2 nm, d2 of the electron-emitting device E5 was 5.0 nm, d2 of the electron-emitting device E6 was 10 nm. It is to be noted that d2/d1 was 1.1 with regard to the electron-emitting device E1 and was 1.2 or more with regard to the electron-emitting devices E2 to E6.

Further, each of the end of the first carbon film 21*a* was processed using an AFM such that d2 of the electron-emitting device F1 was 4.0 nm, d2 of the electron-emitting device F2 was 4.2 nm, d2 of the electron-emitting device F3 was 5.0 nm, d2 of the electron-emitting device F4 was 10 nm. It is to be noted that d2/d1 was 1.1 with regard to the electron-emitting device F1 and was 1.2 or more with regard to the electron-emitting devices F2 to F4.

With regard to each electron-emitting device, cutting was carried out so that the thickness of the portions B of the second electroconductive film 21*b* is equal to that of the portions A of the first electroconductive film 21*a*, and the thickness difference h between the portions B and the portions 35 and 36 of the second electroconductive film 21*b* (the height h of the "projected portions" (see FIGS. 2C and 2D)) was made to be 50 nm. Further, the width w between portions 35 and 36 (the width w between "projected portions") was 5 nm with regard to the electron-emitting devices D, 6 nm with regard to the electron-emitting devices E, and 7 nm with regard to the electron-emitting devices F.

The thickness of the second carbon film 21*b* which exists on a line extending in a direction in which a portion A of the first carbon film 21*a* is in opposition to a portion B of the second carbon film 21*b* (in a direction of emission of electrons) was 100 nm.

Further, in the same method as the above Processes-a to Processes-e, three kinds of electron-emitting devices were manufactured as Comparative Example 2. Each of the electron-emitting devices of Comparative Example 2 had different voltages to be applied in the activation process. In the activation process, the highest voltage value was ±14 V with regard to the first device, ±16 V with regard to the second device, and ±18 V with regard to the third device. The above Process-f was not carried out with regard to the electron-emitting devices of Comparative Example 2.

(Process-g)

Next, the electron-emitting devices after Process-f and the electron-emitting devices of Comparative Example 2 were disposed in the measurement/evaluation apparatus illustrated in FIG. 3. After the measurement/evaluation apparatus was evacuated, the "stabilization" process was carried out.

More specifically, with the vacuum chamber and the electron-emitting devices maintained at about 250° C. by heating them by a heater, the vacuum chamber was evacuated. After 20 hours elapsed, the heating by the heater was stopped to allow them to reach room temperature. The pressure in the vacuum chamber reached about $1\times10^{-8}$ Pa. Next, electron emitting characteristics were measured.

In measuring the electron emitting characteristics, the distance H between the anode electrode 44 and the electron-emitting device was 2 mm, and a high voltage power source 43 gave a potential of 1 kV to the anode electrode 44. With this state maintained, the power source 41 was used to apply drive voltage between the auxiliary electrodes 2 and 3 of the respective electron-emitting devices such that the potential of the first auxiliary electrode 2 was lower than that of the second auxiliary electrode 3. Square pulse voltage having the pulse height value of 12 V was applied to the electron-emitting devices D1 to D8 and the first device of Comparative Example 2, square pulse voltage having the pulse height value of 14 V was applied to the electron-emitting devices E1 to E6 and the second device of Comparative Example 2, and square pulse voltage having the pulse height value of 16 V was applied to the electron-emitting devices F1 to F4 and the third device of Comparative Example 2.

In the measurement, the device current If and the emission current Ie of the electron-emitting devices of this example and of Comparative Example 2 were measured by ammeters 40 and 42, respectively, and electron emitting efficiency (Ie/If) was calculated.

Table 3 shows the calculated electron emitting efficiency and Table 4 shows the emission current Ie. The device current If was about 1.0 mA with regard to all the electron-emitting devices.

TABLE 3

| | Comparative example 2 | d2 [nm] 2.8 | 3 | 3.3 | 3.6 | 4 | 4.2 | 5 | 10 |
|---|---|---|---|---|---|---|---|---|---|
| Drive voltage 12 V (d1 = 2.5 nm) | 0.08% | 0.13% (D1) | 0.18% (D2) | 0.19% (D3) | 0.20% (D4) | 0.21% (D5) | 0.22% (D6) | 0.24% (D7) | 0.25% (D8) |
| Drive voltage 14 V (d1 = 3.0 nm) | 0.11% | | | 0.18% (E1) | 0.23% (E2) | 0.24% (E3) | 0.26% (E4) | 0.28% (E5) | 0.29% (E6) |
| Drive voltage 16 V (d1 = 3.5 nm) | 0.16% | | | | | 0.23% (F1) | 0.32% (F2) | 0.34% (F3) | 0.34% (F4) |

TABLE 4

| | Comparative example 2 | d2 [nm] 2.8 | 3 | 3.3 | 3.6 | 4 | 4.2 | 5 | 10 |
|---|---|---|---|---|---|---|---|---|---|
| Drive voltage 12 V (d1 = 2.5 nm) | 0.9 μA | 1.2 μA (D1) | 1.6 μA (D2) | 1.6 μA (D3) | 1.8 μA (D4) | 1.9 μA (D5) | 1.9 μA (D6) | 2.0 μA (D7) | 2.2 μA (D8) |
| Drive voltage 14 V (d1 = 3.0 nm) | 1.2 μA | | | 1.6 μA (E1) | 2.0 μA (E2) | 2.1 μA (E3) | 2.4 μA (E4) | 2.5 μA (E5) | 2.7 μA (E6) |
| Drive voltage 16 V (d1 = 3.5 nm) | 1.9 μA | | | | | 2.2 μA (F1) | 2.8 μA (F2) | 3.0 μA (F3) | 3.2 μA (F4) |

The result shows that, when d2/d1 is 1.2 or more, the electron-emitting devices of this example has larger emission current Ie and higher electron emitting efficiency η than those of the electron-emitting devices of Comparative Example 2. Further, after the evaluation of the characteristics, the same pulse voltage as that applied in the evaluation of the characteristics was applied to the electron-emitting devices of this example and the devices were driven for a long time. The characteristics shown in Tables 3 and 4 were maintained for a long time without much fluctuation over time.

After the evaluation of the characteristics described above, the neighborhood of the gap 8 of the electron-emitting devices (D, E, and F) manufactured in this example was observed using the above-described 3D-TEM. The distance d1 between a portion A of the first carbon film 21*a* and a portion B of the second carbon film 21*b* was confirmed to be 2.5 nm with regard to the electron-emitting devices D (D1 to D8), 3.0 nm with regard to the electron-emitting devices E (E1 to E6), and 3.5 nm with regard to the electron-emitting devices F (F1 to F4). Similarly, the distance d2 was confirmed to be 2.8 nm with regard to the electron-emitting device D1, 3.0 nm with regard to the electron-emitting device D2, 3.3 nm with regard to the electron-emitting device D3, 3.6 nm with regard to the electron-emitting device D4, 4.0 nm with regard to the electron-emitting device D5, 4.2 nm with regard to the electron-emitting device D6, 5.0 nm with regard to the electron-emitting device D7, 10 nm with regard to the electron-emitting device D8, 3.3 nm with regard to the electron-emitting device E1, 3.6 nm with regard to the electron-emitting device E2, 4.0 nm with regard to the electron-emitting device E3, 4.2 nm with regard to the electron-emitting device E4, 5.0 nm with regard to the electron-emitting device E5, 10 nm with regard to the electron-emitting device E6, 4.0 nm with regard to the electron-emitting device F1, 4.2 nm with regard to the electron-emitting device F2, 5.0 nm with regard to the electron-emitting device F3, and 10 nm with regard to the electron-emitting device F4.

With regard to all the electron-emitting devices, it was confirmed that the transformed portion of the substrate (concaved portion) 22 was formed in the surface of the substrate 1 between the first and second carbon films 21*a* and 21*b*.

Further, the width w between portions 35 and 36 (the width w between "projected portions") was confirmed to be 5 nm with regard to the electron-emitting devices D, 6 nm with regard to the electron-emitting devices E, and 7 nm with regard to the electron-emitting devices F. These values (of the width w) were d1 of the respective electron-emitting devices multiplied by two.

The distance d3 between the respective protrusions (portions A) was measured using SEM plan views, and the distribution was studied. The distribution was similar to that illustrated in FIG. 24. With regard to all the electron-emitting devices, the distribution of the distance d3 between the protrusions was from about 3 d1 to 500 d1 with the peak being 35 d1 to 45 d1. Although the distribution of the distance d3 was as described above with regard to the electron-emitting devices D to F of this example, the present invention is not limited thereto, and the distance d3 may have a broader distribution. However, in order to obtain the emission current Ie in a practical range, it is preferable that the distribution is within 2000 d1. It is to be noted that, when d3 was set to be less than 3 d1, it was found that fluctuations in the electron emission current over time were larger than those of electron-emitting devices where d3 was 3 d1 or more. This is thought to be because protrusions (portions A), which are thought to contribute to electron emission, are so close to each other that they interfere with each other.

Further, in order to obtain larger emission current Ie, it is most preferable that d3 is from 3 d1 to 45 d1 and all d3 are the same (the distribution is concentrated).

In addition, with regard to electron-emitting devices manufactured by a similar manufacturing method to that of the electron-emitting device E3, seven kinds of electron-emitting devices (E3-1 to E3-7) having different values of the width w were manufactured, and the characteristics of the respective devices were evaluated. The width w was 3 nm with regard to the electron-emitting device E3-1, 5 nm with regard to the electron-emitting device E3-2, 6 nm with regard to the electron-emitting device E3-3, 15 nm with regard to the electron-emitting device E3-4, 50 nm with regard to the electron-emitting device E3-5, 150 nm with regard to the electron-emitting device E3-6, and 300 nm with regard to the electron-emitting device E3-7. When voltage of 14 V was applied to these electron-emitting devices to drive the devices, the electron emitting efficiency η and the emission current Ie of E3-2 were almost the same as those of E3-1. The emission current Ie of E3-3 was almost the same as that of E3-2, but the electron emitting efficiency η of E3-3 was improved to be about 1.1 times as much as that of E3-2. The emission current Ie and the electron emitting efficiency η of E3-4 were improved to be about 1.2 times as much as that of E3-3. The electron emitting efficiency η of E3-5 was improved to be about 1.1 times as much as that of E3-4. The electron emitting efficiency η and the emission current Ie of E3-6 were almost the same as those of E3-5. The electron emitting efficiency η and the emission current Ie of E3-7 decreased compared with that of E3-6. Such tendency was similarly observed in other electron-emitting devices (D, E, and F) of this example. The above result indicated that setting w to be twice as large as d1 or more had an effect of improving the emission current Ie and the electron emitting efficiency η. It was also made clear that, when w exceeds 50 d1, that effect began to decrease.

Also, with regard to the thickness difference h (the height h of the "projected portions"), characteristics of five kinds of electron-emitting devices (E3-8 to E3-12) having different values of the thickness difference h and manufactured by a similar manufacturing method to that of the electron-emitting device E3 were evaluated. The thickness difference h was 3 nm with regard to the electron-emitting device E3-8, 4 nm with regard to the electron-emitting device E3-9, 6 nm with regard to the electron-emitting device E3-10, 10 nm with regard to the electron-emitting device E3-11, and 70 nm with regard to the electron-emitting device E3-12.

When voltage of 14 V was applied to these electron-emitting devices to drive the devices, the electron emitting efficiency η and the emission current Ie of E3-9 were almost the same as those of E3-8. The emission current Ie of E3-10 was improved to be about 1.2 times as much as that of E3-9 while the electron emitting efficiency η of E3-10 was almost the same as that of E3-9. The electron emitting efficiency η of E3-11 was improved to be about 1.2 times as much as that of E3-10. The electron emitting efficiency η of E3-12 was improved to be about 1.1 times as much as that of E3-11, but the emission current Ie of E3-12 was almost the same as that of E3-11.

The above result indicated that setting h to be twice as large as d1 or more had an effect of improving the emission current Ie and the electron emitting efficiency η. Such tendency was similarly observed in other electron-emitting devices (D, E, and F) of this example. Further, since it is made clear by calculation by the present inventors that the emission current Ie becomes larger and the electron emitting efficiency η becomes higher even when the thickness difference h is 70 nm or more, the upper limit of the thickness difference h is not limited. However, in view of the manufacturing cost and problems relating to the quality (electric discharge and the like), it is effectively preferable that the thickness difference h is set to be less than 200 d1.

Example 3

Figure 27A:
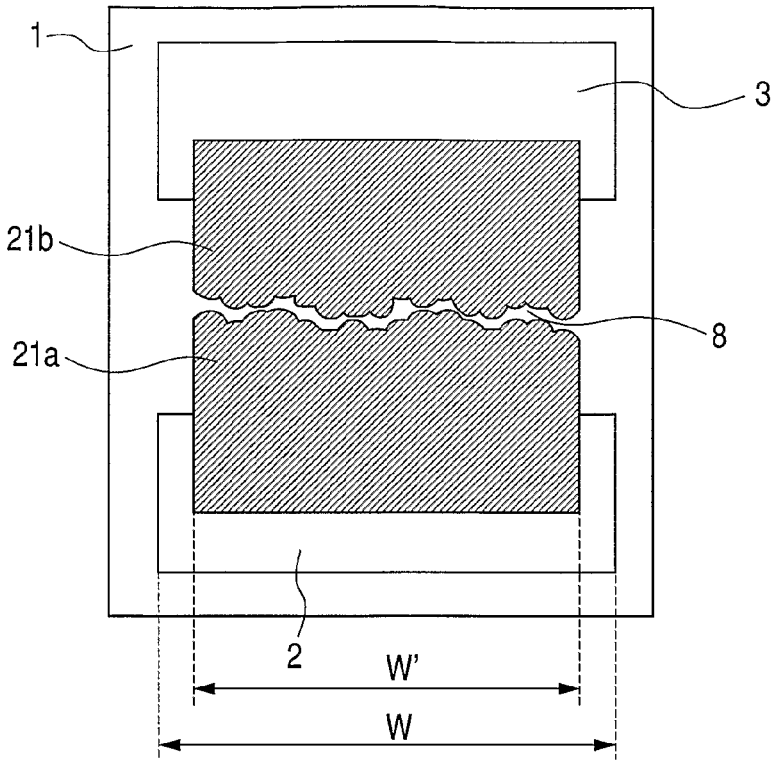
FIGS. 27A, 27B and 27C are a plan view, a plan view, and a sectional view, respectively, schematically illustrating an exemplary structure of the electron-emitting device according to the present invention.
Figure 27B:
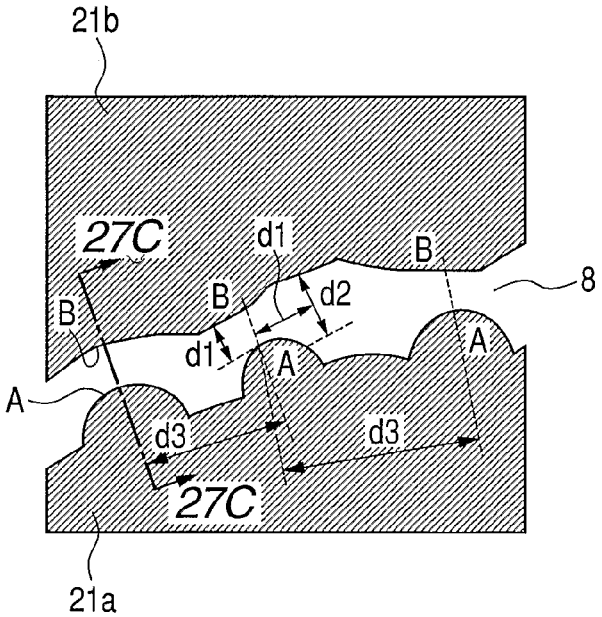
Figure 27C:
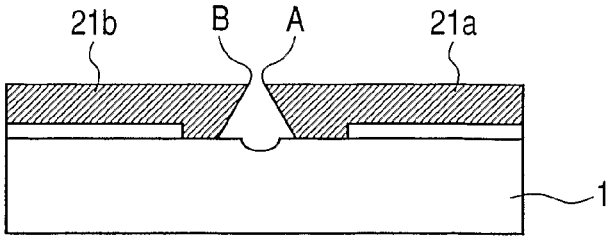
Figure 28A:
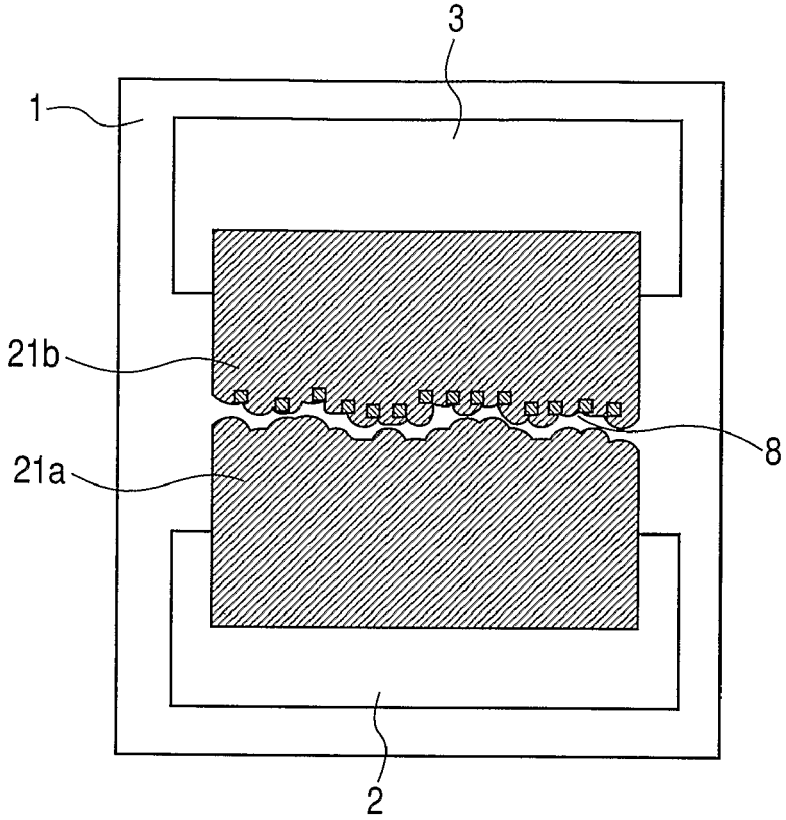
FIGS. 28A, 28B, 28C and 28D are a plan view, a plan view, a sectional view, and a sectional view, respectively, schematically illustrating another exemplary structure of the electron-emitting device according to the present invention.
Figure 28B:
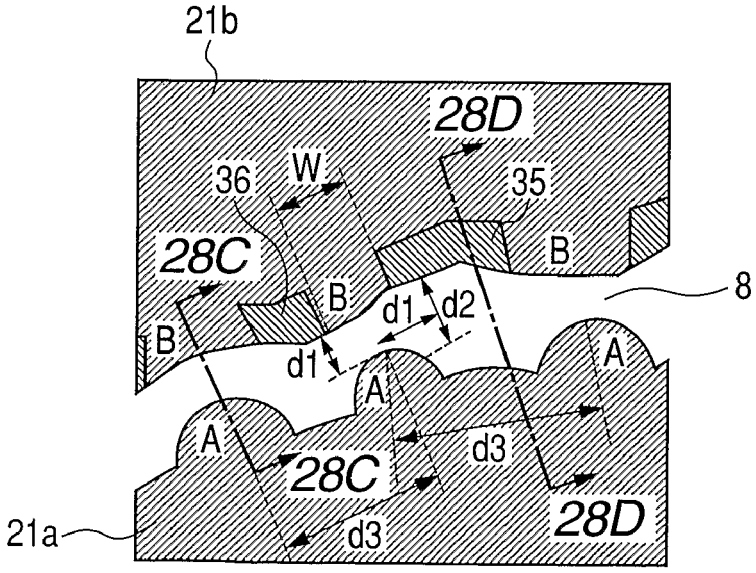
Figure 28C:
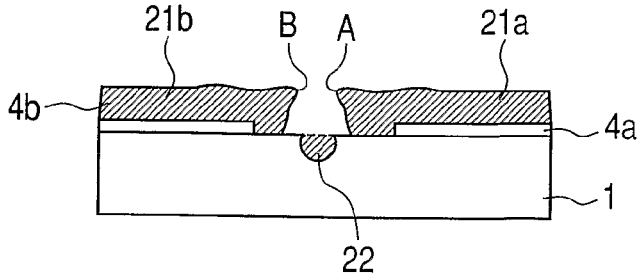
Figure 28D:
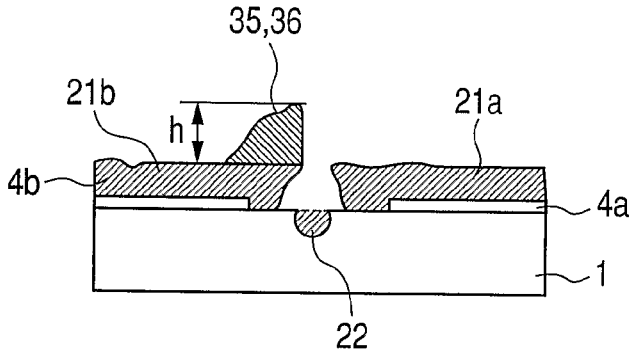

In this example, the electron-emitting device illustrated in FIGS. 27A to 27C was manufactured using electron beam irradiation. Since Process-a of this example is the same as Process-a of Example 1, the description thereof is omitted in the following.

(Process-b)

Next, the substrate 1 having the auxiliary electrodes 2 and 3 formed thereon was disposed in the measurement/evaluation apparatus illustrated in FIG. 3 (with an electron beam irradiating means (not shown)). Then, the measurement/evaluation apparatus was evacuated by a vacuum pump until the vacuum reached $1\times10^{-6}$ Pa. After that, acrylonitrile was introduced into the vacuum chamber through a slow leak valve. Then, the electrodes 2 and 3 were set at the ground potential and electron beam irradiation was carried out so that the first and second carbon films 21*a* and 21*b* as illustrated in FIGS. 27A to 27C were formed. The acceleration voltage of the electron beam was 5 kV and the current was 10 μA. The width W' of the carbon films 21*a* and 21*b* were 100 μA.

Here, the thickness of the end of the first carbon film 21*a* and the thickness of the end of the second carbon films 21*b* (the portion forming the periphery of the gap 8) were set to form a symmetrical structure (see FIG. 27C), and the gap 8 was serpentine. By controlling the irradiation time of the electron beam, the distance d1 between a portion A of the first carbon film 21*a* and a portion B of the second carbon film 21*b* was made to be 3.5 nm.

By using such a method, electron-emitting devices (G1 to G5) having different values of d2 were manufactured. The distance d2 was 3.7 nm with regard to the electron-emitting device G1, 4.0 nm with regard to the electron-emitting device G2, 4.2 nm with regard to the electron-emitting device G3, 5.0 nm with regard to the electron-emitting device G4, and 10 nm with regard to the electron-emitting device G5. The distance d3 of the electron-emitting devices was set to be 30 d1.

It is to be noted that d2/d1 was 1.1 with regard to the electron-emitting devices G1 and G2 and was 1.2 or more with regard to the electron-emitting devices G3 to G5.

(Process-c)

Then, with the vacuum chamber being evacuated, the electron-emitting devices of this example after Process-b were heated and voltage was applied to them. After 20 hours elapsed, the heating by the heater was stopped to allow them to reach room temperature. The pressure in the vacuum chamber reached about $1\times10^{-8}$ Pa. Next, electron emitting characteristics were measured.

In measuring the electron emitting characteristics, the distance H between the anode electrode 44 and the electron-emitting device was 2 mm, and the high voltage power source 43 gave a potential of 1 kV to the anode electrode 44. With this state maintained, the power source 41 was used to apply square pulse voltage having the pulse height value of 16 V between the auxiliary electrodes 2 and 3 so that the potential of the first auxiliary electrode 2 was lower than that of the second auxiliary electrode 3.

In the measurement, the device current If and the emission current Ie of the electron-emitting devices of this example were measured by the ammeters 40 and 42, respectively, and electron emitting efficiency was calculated.

Table 5 shows the calculated electron emitting efficiency and the emission current Ie. The device current If was about 2.5 mA with regard to all the electron-emitting devices.

TABLE 5

| | d2 [nm] | Efficiency [%] | Ie [μA] |
|---|---|---|---|
| G1 | 3.7 | 0.12 | 3 |
| G2 | 4 | 0.12 | 3 |
| G3 | 4.2 | 0.16 | 4 |
| G4 | 5 | 0.18 | 4.25 |
| G5 | 10 | 0.19 | 4.75 |

The result showed that, when d2/d1 was 1.2 or more, the electron-emitting devices of this example had larger emission current Ie and higher electron emitting efficiency η. Further, after the evaluation of the characteristics, the same pulse voltage as that applied in the evaluation of the characteristics was applied to the electron-emitting devices of this example and the devices were driven for a long time. The characteristics shown in Table 5 were maintained for a long time without much fluctuation over time compared with the electron-emitting devices manufactured in Example 1.

Figure 25:
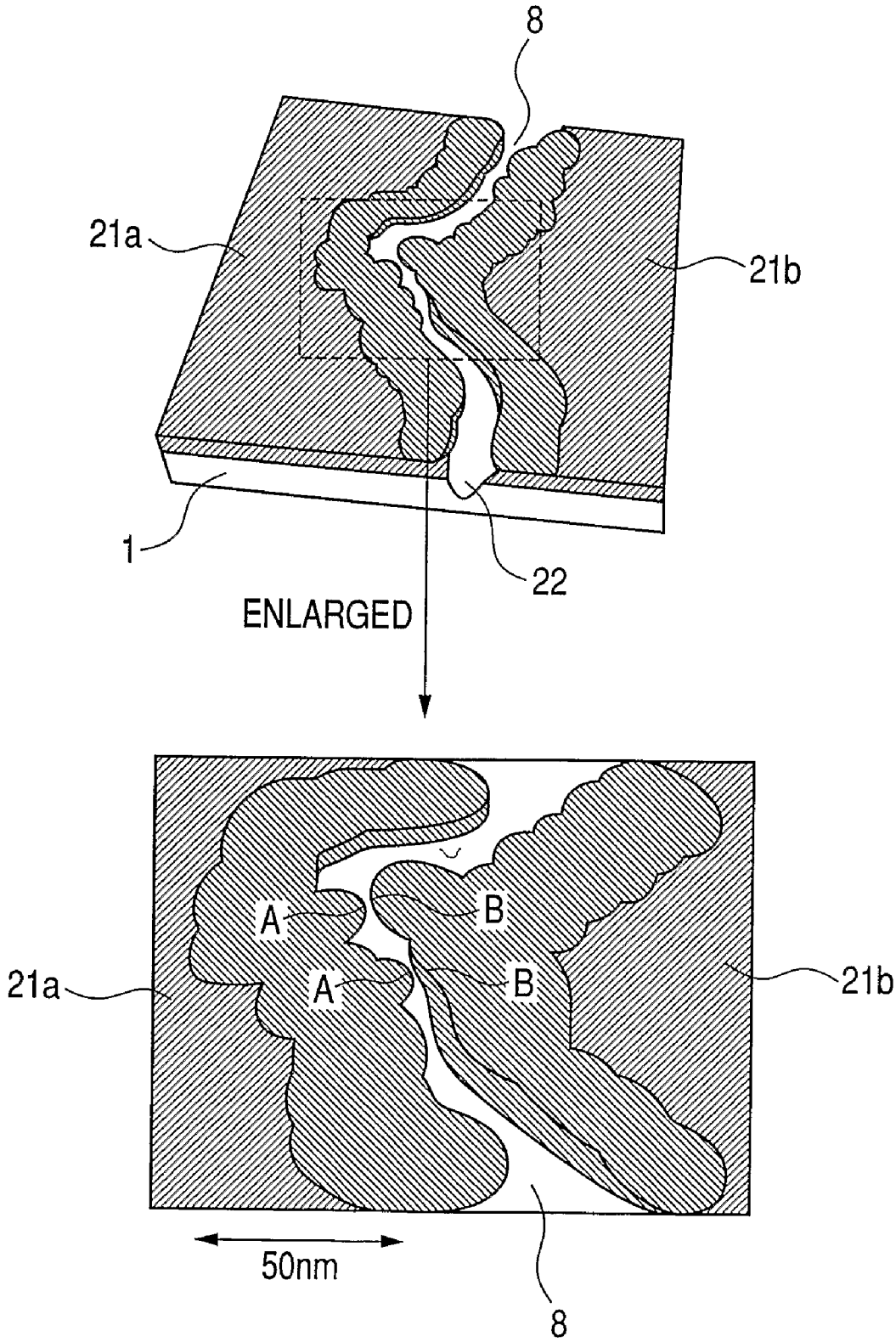
FIG. 25 is schematic view illustrating exemplary 3D-TEM image observation of the electron-emitting device according to the present invention.

After the evaluation of the characteristics, the neighborhood of the gap 8 of the electron-emitting devices manufactured in this example was observed using 3D-TEM images, and the structure was approximately as schematically illustrated in FIG. 25. By further observation in detail, it is confirmed that there were a lot of portions along the gap 8 where the gap is smaller than that in other portions and the distance (d1) was 10 nm or less. The distance d1 was 3.5 nm. Further, a concave 22 was formed in the surface of the substrate 1 the depth of which was smaller than that of the concave formed in Example 2.

The distance d2 was 3.7 nm with regard to the electron-emitting devices G1, 4.0 nm with regard to the electron-emitting device G2, 4.2 nm with regard to the electron-emitting device G3, 5.0 nm with regard to the electron-emitting device G4, and 10 nm with regard to the electron-emitting device G5.

Figure 29:
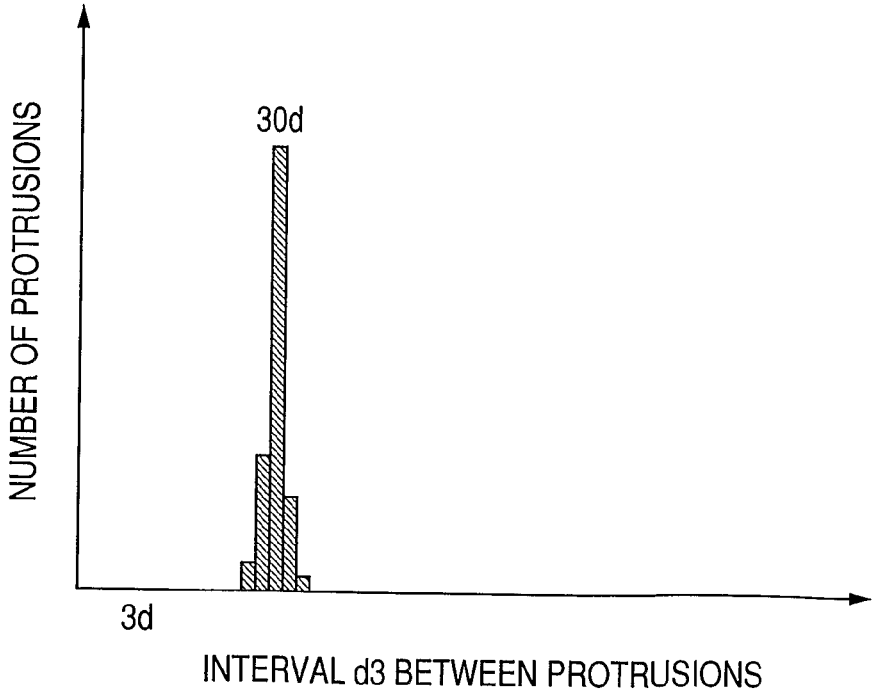
FIG. 29 is a schematic graph for explaining ideal distribution of interval between protrusions in the electron-emitting device according to the present invention.

The distribution of the distance d3 was studied using SEM plan views. FIG. 29 illustrates a schematic graph of the distribution. With regard to all the electron-emitting devices, the distribution of the distance d3 between the protrusions along the direction of the gap 8 had a sharp peak at 30 d1.

Example 4

In this example, electron-emitting devices with the first and second carbon films 21*a* and 21*b* illustrated in FIGS. 28A to 28D were manufactured using electron beam irradiation. In this example, electron-emitting devices (G1' to G5') were manufactured with the following modifications to Process-b in the manufacturing method of the electron-emitting devices (G1 to G5) of Example 3. The rest of the manufacturing method was basically similar to that of Example 3.

Four modifications were made to Process-b of the electron-emitting devices of Example 3: (1) with regard to the electron-emitting devices (G1 to G5), electron beam irradiation was used so that the thickness of the portions B of the second carbon film 21*b* was equal to that of the portions A of the first carbon film 21*a* (see FIG. 28C); (2) electron beam irradiation was used so that the thickness difference h between the portions B and the portions 35 and 36 of the second electroconductive film 21*b* (the height h of the "projected portions") was made to be 50 nm; (3) electron beam irradiation was used so that the width w between portions 35 and 36 (the width w between "projected portions") was made to be 7 nm (see FIG. 28B); and (4) the thickness of the second carbon film 21*b* which exists on a line extending in a direction in which a portion A of the first carbon film 21*a* is in opposition to a portion B of the second carbon film 21*b* (in a direction of emission of electrons) was made to be 100 nm (see FIG. 28D).

In measuring the electron emitting characteristics manufactured in this example, the distance H between the anode electrode 44 and the electron-emitting device was 2 mm, and the high voltage power source 43 gave a potential of 1 kV to the anode electrode 44. With this state maintained, the power source 41 was used to apply square pulse voltage having the pulse height value of 16 V between the auxiliary electrodes 2 and 3 so that the potential of the first auxiliary electrode 2 was lower than that of the second auxiliary electrode 3.

In the measurement, the device current If and the emission current Ie of the electron-emitting devices of this example were measured by the ammeters 40 and 42, respectively, and electron emitting efficiency was calculated.

Table 6 shows the calculated electron emitting efficiency and the emission current Ie. The device current If was about 2.5 mA with regard to all the electron-emitting devices.

TABLE 6

| | d2 [nm] | Efficiency [%] | Ie [μA] |
|---|---|---|---|
| G1' | 3.7 | 0.2 | 5 |
| G2' | 4 | 0.2 | 5 |
| G3' | 4.2 | 0.27 | 7 |
| G4' | 5 | 0.29 | 7.3 |
| G5' | 10 | 0.32 | 8 |

The result showed that, when d2/d1 was 1.2 or more, the electron-emitting devices (G1' to G5') of this example had larger emission current Ie and higher electron emitting efficiency η. Further, after the evaluation of the characteristics, the same pulse voltage as that applied in the evaluation of the characteristics was applied to the electron-emitting devices of this example and the devices were driven for a long time. The characteristics shown in Table 6 were maintained for a long time without much fluctuation over time compared with the electron-emitting devices manufactured in Example 2.

After the evaluation of the characteristics, the electron-emitting devices manufactured in this example were observed using 3D-TEM. The value of d1 was 3.5 nm. The value of d2 was 3.7 nm with regard to the electron-emitting device G1', 4.0 nm with regard to the electron-emitting device G2', 4.2 nm with regard to the electron-emitting device G3', 5.0 nm with regard to the electron-emitting device G4', and 10 nm with regard to the electron-emitting device G5'.

The thickness of the portions B of the second carbon film 21*b* was equal to that of the portions A of the first carbon film 21*a*, and the thickness difference h between the portions B and the portions 35 and 36 of the second electroconductive film 21*b* (the height h of the "projected portions") was 50 nm. Further, the width w between portions 35 and 36 (the width w between "projected portions") was 7 nm.

The distance d3 between the respective protrusions was measured using SEM plan views, and the distribution was studied. Similarly to the distribution illustrated in FIGS. 27A to 27C, with regard to all the electron-emitting devices, the distribution of the distance d3 had a sharp peak at 30 d1.

Example 5

In this example, a lot of electron-emitting devices manufactured by a similar manufacturing method to that of the electron-emitting device C3 manufactured in Example 1 of the present invention were arranged in a matrix on a substrate to form an electron source, and the electron source was used to manufacture the image display apparatus illustrated in FIG. 14. The manufacturing process of the image display apparatus manufactured in this example will be described in the following.

<Auxiliary Electrode Manufacturing Process>

Figure 16:
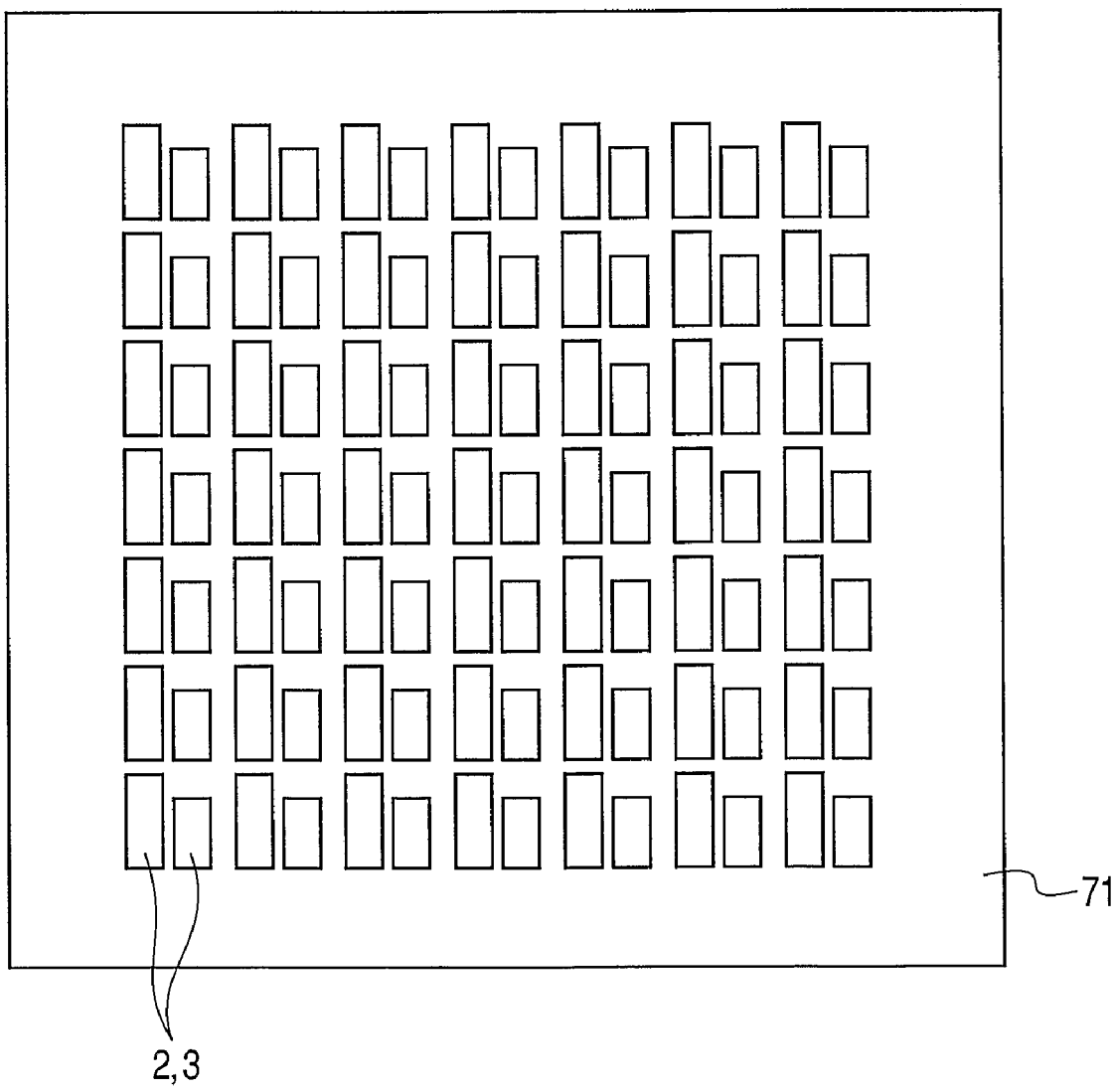
FIG. 16 is a schematic view illustrating an exemplary manufacturing process of the electron source and the image display apparatus according to the present invention.

An $SiO_2$ film was formed on the glass substrate 71. Further, a lot of first and second auxiliary electrodes 2 and 3 were formed on the substrate 71 (FIG. 16). More specifically, after a multilayer of titanium Ti and platinum Pt at the thickness of 40 nm was formed on the substrate 71, the multilayer was patterned using photolithography. In this example, the length L between the first and second auxiliary electrodes 2 and 3 was 10 μm and the width W of the auxiliary electrodes 2 and 3 was 100 μm.

<Y-Directional Wiring Forming Process>

Figure 17:
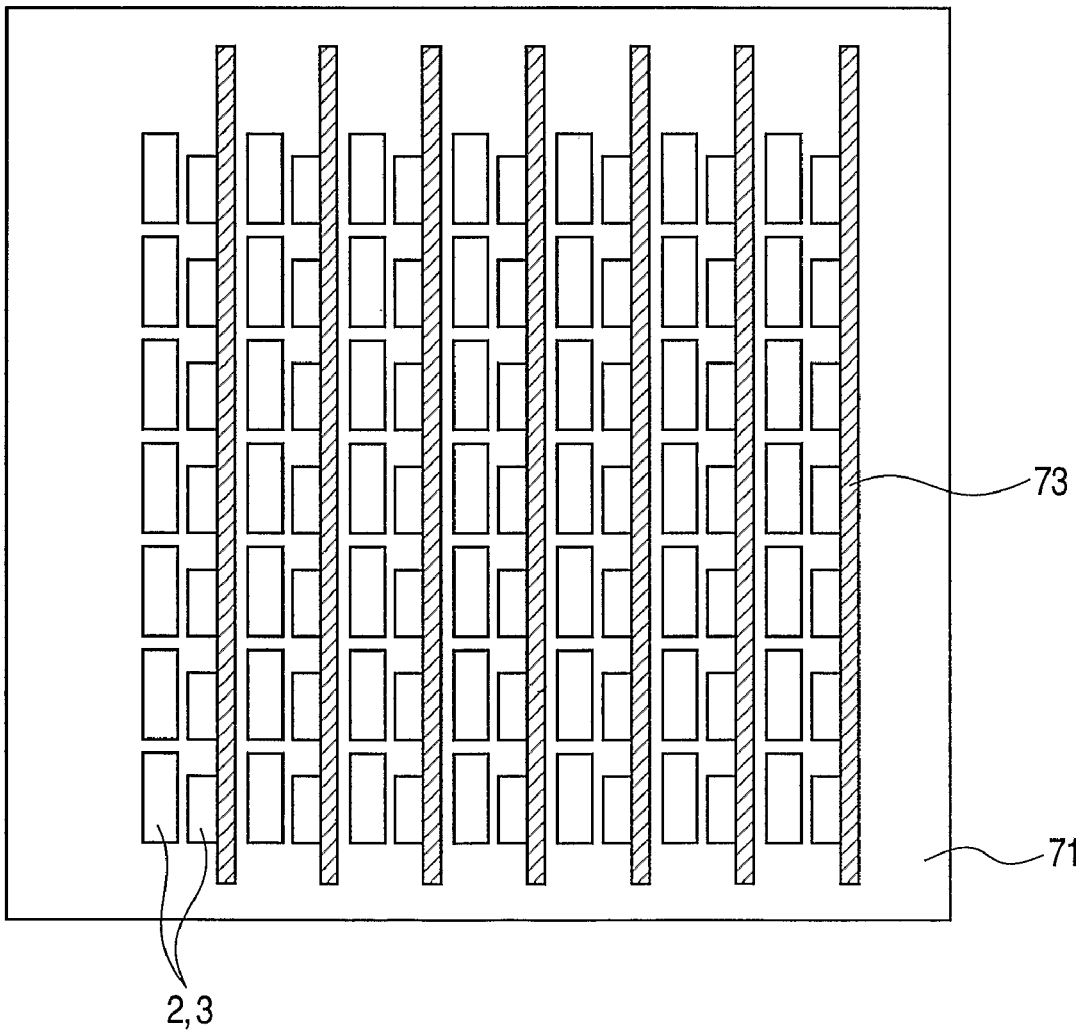
FIG. 17 is a schematic view illustrating the exemplary manufacturing process of the electron source and the image display apparatus according to the present invention.

Then, as illustrated in FIG. 17, the Y-directional wirings 73 the main component of which was silver were formed so as to be connected to the auxiliary electrodes 3. The Y-directional wirings 73 function as wirings to which a modulation signal is applied.

<Insulating Layer Forming Process>

Figure 18:
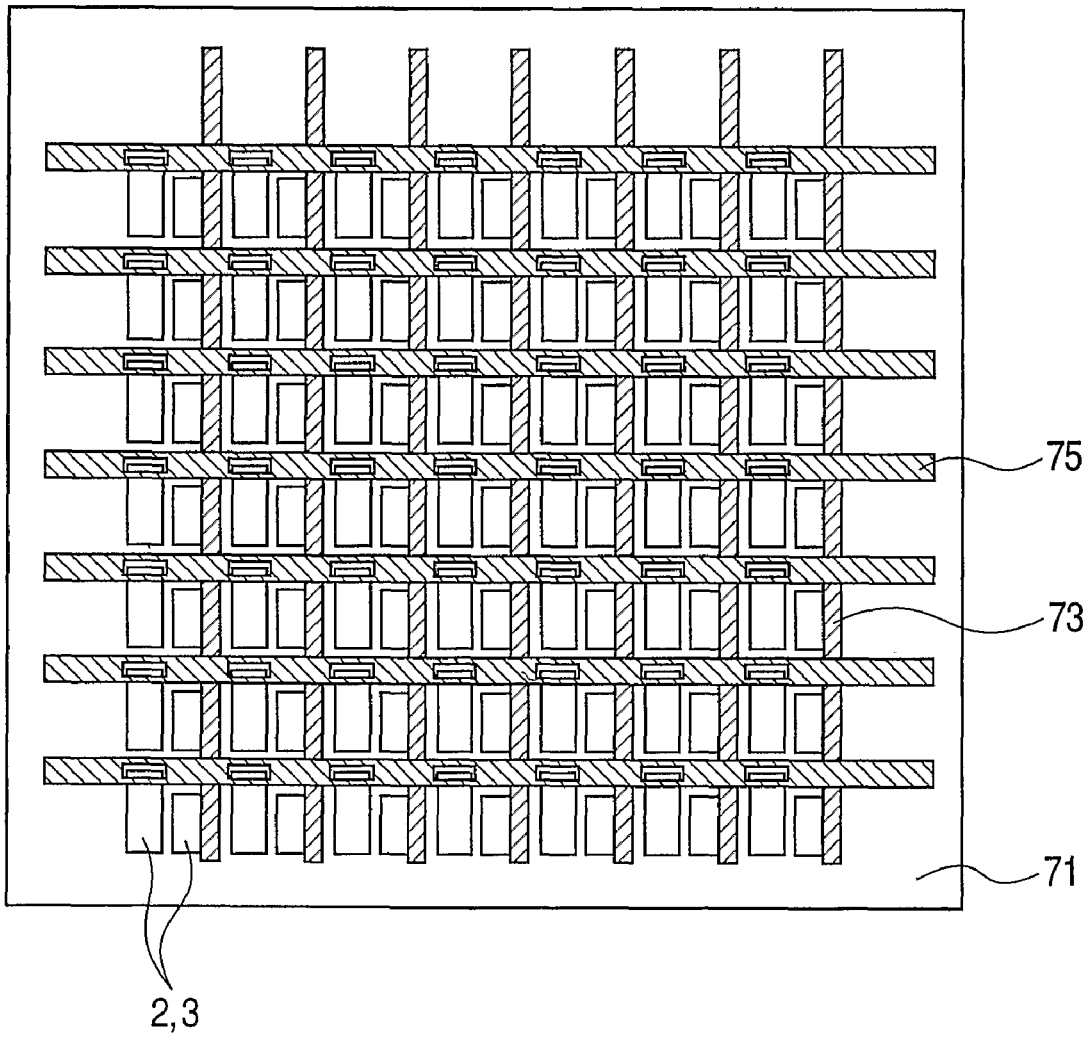
FIG. 18 is a schematic view illustrating the exemplary manufacturing process of the electron source and the image display apparatus according to the present invention.

Then, as illustrated in FIG. 18, in order to insulate the X-directional wirings 72 to be formed in the next process and the above-described Y-directional wirings 73, an insulating layer 75 made of silicon oxide is provided. The insulating layer 75 is disposed under the X-directional wirings 72 to be described below so as to cover the Y-directional wirings 73 previously formed. Contact holes are formed in the insulating layer 75 to allow electric connection between the X-directional wirings 72 and auxiliary electrodes 2.

<X-Directional Wiring Forming Process>

Figure 19:
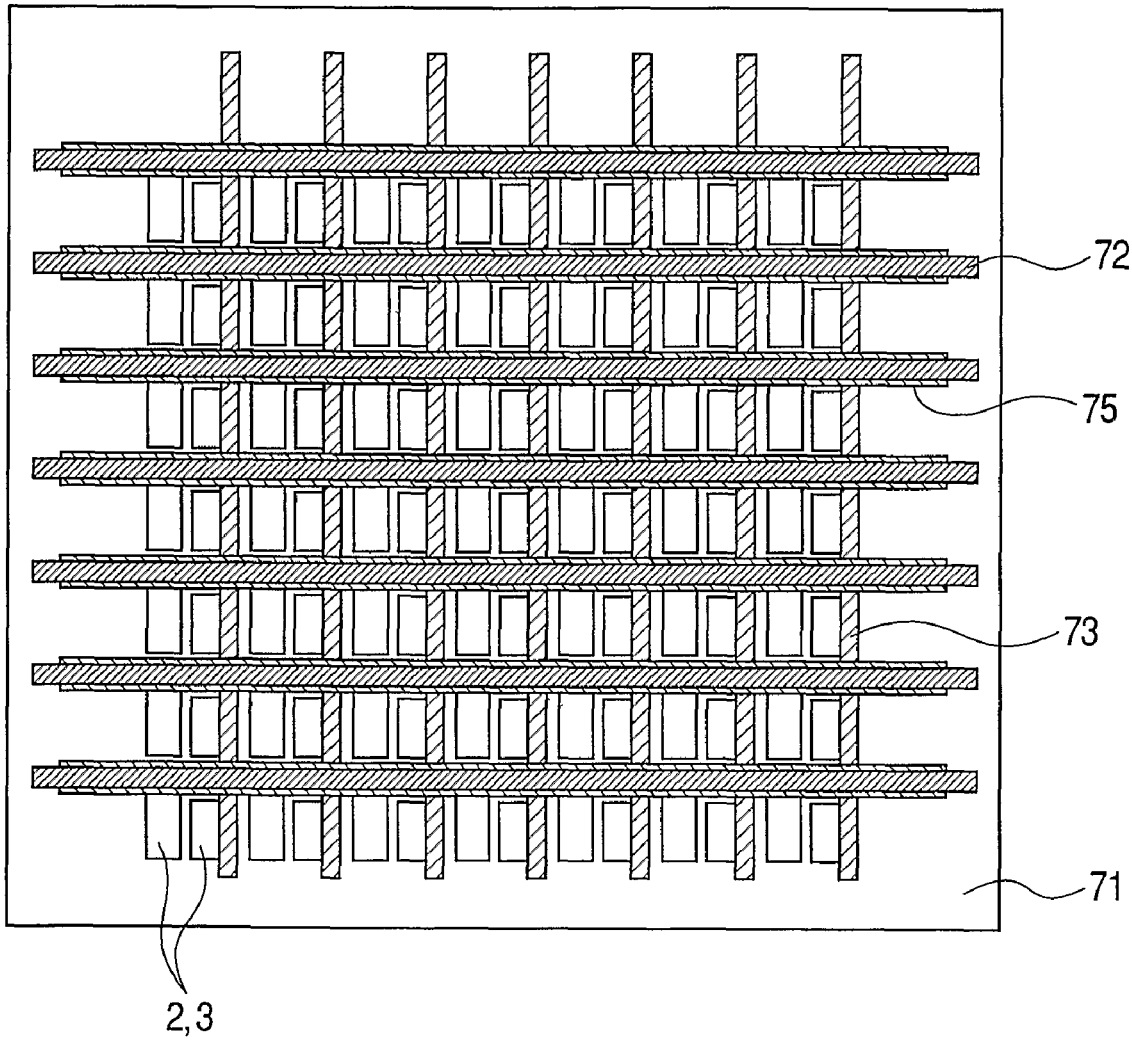
FIG. 19 is a schematic view illustrating the exemplary manufacturing process of the electron source and the image display apparatus according to the present invention.

As illustrated in FIG. 19, the X-directional wirings 72 the main component of which was silver were formed on the insulating layer 75 previously formed. The X-directional wirings 72 intersect the Y-directional wirings 24 with the insulating layer 75 therebetween, and are connected to the auxiliary electrodes 2 via the contact holes in the insulating layer 75. The X-directional wirings 72 function as wirings to which a scan signal is applied. In this way, the substrate 71 having matrix wirings was formed.

<First and Second Electrode Forming Process>

Figure 20:
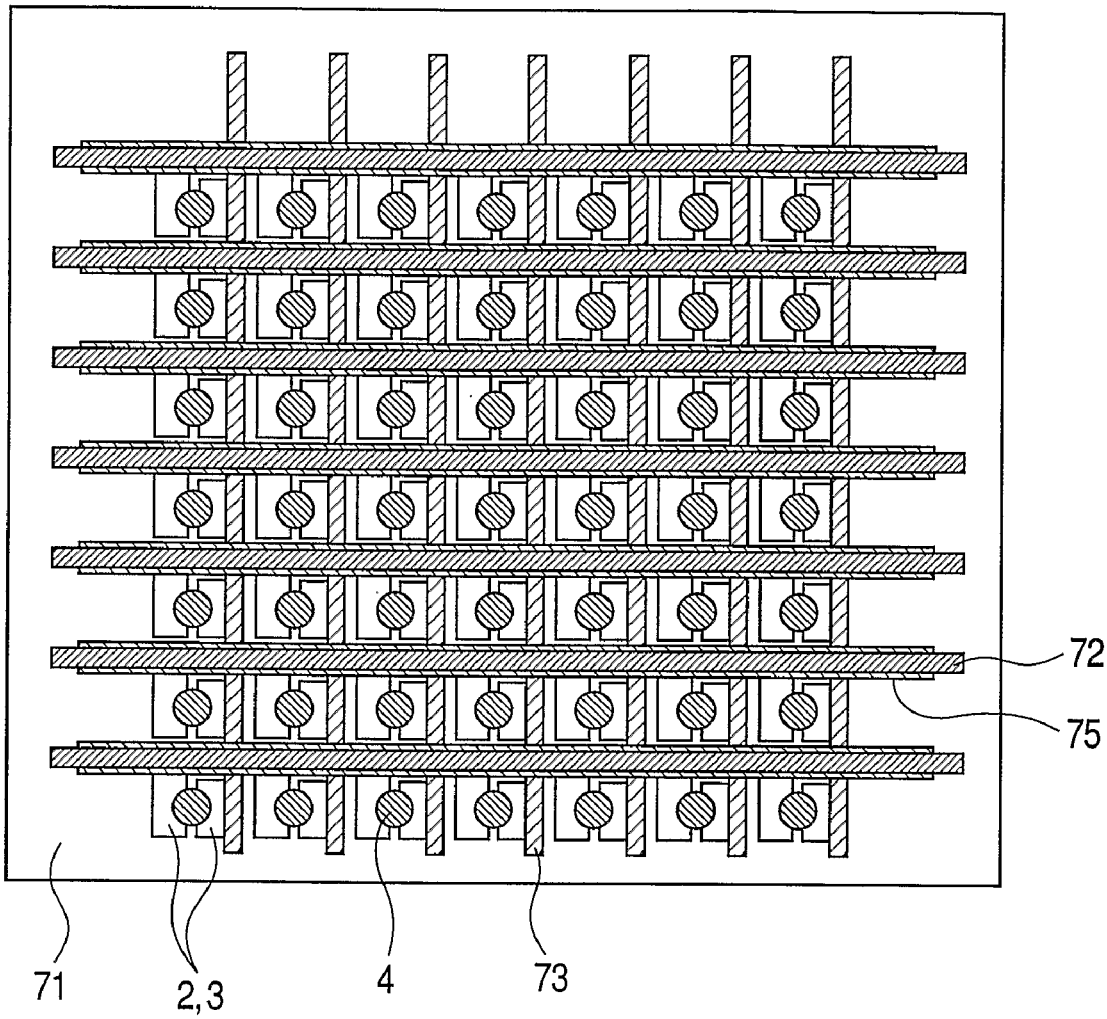
FIG. 20 is a schematic view illustrating the exemplary manufacturing process of the electron source and the image display apparatus according to the present invention.
Figure 21:
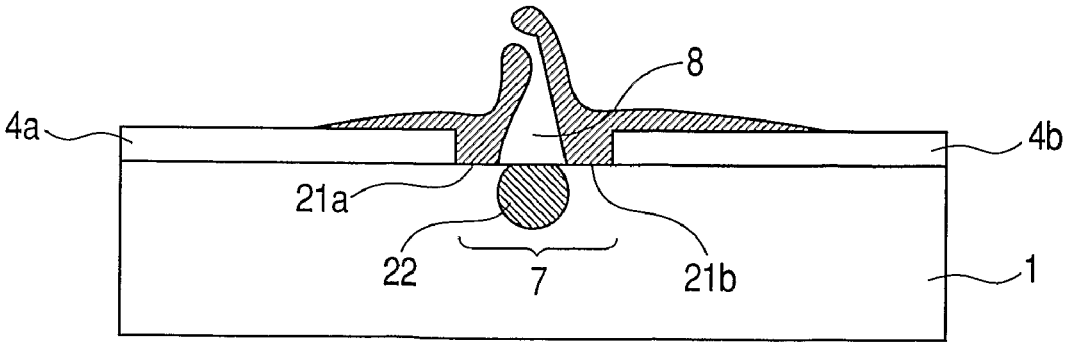
FIG. 21 is a schematic sectional view of an exemplary conventional electron-emitting device.

By ink jetting, the electroconductive thin film 4 was formed between the auxiliary electrodes 2 and 3 on the substrate 71 having the matrix wirings formed thereon (FIG. 20).

In this example, an organic palladium complex solution was used as the ink used for the ink jetting. The organic palladium complex solution was applied between the auxiliary electrodes 2 and 3. After that, the substrate 71 was heated and baked in the air to form the electroconductive thin film 4 made of palladium oxide (PdO).

<Forming Process and Activation Process>

Then, the substrate 71 having thereon a plurality of units formed by the auxiliary electrodes 2 and 3 and the electroconductive thin film 4 for connecting the auxiliary electrodes 2 and 3 was disposed in the vacuum chamber 23. After the vacuum chamber was evacuated, the "forming" process and the "activation" process were carried out. The waveform of voltage applied to the respective unit during the "forming" process and the "activation" process and the like were as described in the method of manufacturing the electron-emitting device C3 of Example 1.

The "forming" process was carried out by applying pulses one by one to the plurality of X-directional wirings 72 selected one by one in sequence. More specifically, a process where "after one pulse is applied to one X-directional wiring selected from the plurality of X-directional wirings 72, another X-directional wiring is selected and one pulse is applied thereto" was repeated.

In this way, the substrate 71 having a plurality of electron-emitting devices formed thereon could be manufactured.

<Processing>

Then, the two kinds of substrates 1 having a lot of electron-emitting devices formed thereon after the "activation" process were taken out from the vacuum chamber to the atmosphere, and, as described in the method of manufacturing the electron-emitting device C3 of Example 1, the carbon was shaped using an AFM.

With regard to all the electron-emitting devices, d1 was set to be 3.5 nm and d2 was set to be 5.0 nm (d2/d1=1.4).

In this way, the substrate 71 having the electron source of this example (the plurality of electron-emitting devices) formed thereon was manufactured.

Next, as illustrated in FIG. 14, the face plate 86 having the phosphor film 84 and the metal back 85 laminated on the inner surface thereof was disposed 2 mm above the substrate 71 via the support frame 82.

Although FIG. 14 illustrates a case where the rear plate 81 is provided as a reinforcing member of the substrate 71, the rear plate is omitted in this example. Joints of the face plate 86, the support frame 82, and the substrate 1 were seal-bonded by heating and cooling indium (In) which is a low-melting metal. Since the seal bonding process was carried out in the vacuum chamber, the seal bonding and sealing were carried out simultaneously without using an exhaust pipe.

In this example, in order to realize color display, the phosphor film 84 which was an image forming member was a phosphor in the shape of stripes (see FIG. 15A). The black stripes 91 were formed first, and the respective phosphors 92 were applied to spaces between the black stripes by the slurry method to form the phosphor film 84. As the material for the black stripes 91, a popular material the main component of which was graphite was used.

The metal back 85 formed of aluminum was provided on the inner surface side (on the side of the electron-emitting devices) of the phosphor film 84. The metal back 85 was formed by vacuum evaporation of Al on the inner surface side of the phosphor film 84.

A desired electron-emitting device was selected via the X-directional wirings and Y-directional wirings of the image display apparatus manufactured as described above, and pulse voltage of +18 V was applied so that the potential on the side of the second auxiliary electrode of the selected electron-emitting device was higher than that on the side of the first auxiliary electrode. At the same time, voltage of 10 kV was applied to the metal back 73 via a high voltage terminal Hv. A bright and satisfactory image could be displayed for a long time.

The embodiments and examples according to the present invention described above are as exemplary only, and various variations as to the material and the size are not precluded by the present invention.

This application claims priority from Japanese Patent Application No. 2004-379955 filed Dec. 28, 2004, which is hereby incorporated by reference herein.

The invention claimed is:

1. An electron-emitting device comprising:

a substrate; and first and second electroconductive films disposed on the substrate in opposition to each other to form a gap between ends of the first and second electroconductive films, wherein the end of the first electroconductive film has a protrusion protruding toward the second electroconductive film such that a minimum distance d1, which is defined as a distance between an end of the protrusion and the second electroconductive film and which is 10 nm or less, and a minimum distance d2, which is defined as a distance between the second electroconductive film and an edge portion of the first electroconductive film being away from the end of the protrusion by d1, meets a relation: $d2/d1 \geqq 1.2$, and wherein the second electroconductive film has prominent portions disposed to sandwich a nearest portion of the second electroconductive film which is nearest to the end of the protrusion in the first electroconductive film and protruding in a direction substantially perpendicular to the surface of the substrate so that in the second electroconductive film the prominent portions adjacent to the nearest portion are away from the surface of the substrate than the nearest portion.

2. The device according to claim 1, wherein the edge portion is in a plane including the protrusion and being parallel to a surface of the substrate.

3. The device according to claim 1, wherein the first electroconductive film has a plurality of protrusions arranged so as not to be overlapped with each other in a direction normal to a surface of the substrate.

4. The device according to claim 3, wherein the plurality of protrusions are arranged at an interval of 3 d1 or more.

5. The device according to claim 3, wherein the plurality of the protrusions are arranged at an interval of 2000 d1 or more.

6. The device according to claim 1, wherein the gap extends in a staggering manner.

7. The device according to claim 1, wherein the first and second electroconductive films contain carbon.

8. The device according to claim 1, wherein the substrate has a concave portion on a surface thereof between the first and second electroconductive films.

9. An electron source comprising a plurality of electron-emitting devices, wherein each of the electron-emitting devices is an electron-emitting device according to claim 1.

10. An image forming apparatus comprising:

electron sources according to claim 9, and a light emitting member for emitting a light responsive to an irradiation with an electron emitted from the electron source.

11. An information displaying and reproducing apparatus comprising:

a receiver for outputting at least one of image information, a character information and audio information contained in a broadcast signal received; and an image display apparatus connected to the receiver, wherein the image display apparatus is an image forming apparatus according to claim 10.

12. The device according to claim 1, wherein the gap extends in a staggering manner.

* * * * *